US008811861B2

(12) United States Patent
Tsumita

(10) Patent No.: US 8,811,861 B2
(45) Date of Patent: Aug. 19, 2014

(54) DEVELOPER CONTAINER, IMAGE FORMING APPARATUS, AND DEVELOPER CONTAINER CONTROLLING METHOD

(75) Inventor: Toshikazu Tsumita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 13/103,501

(22) Filed: May 9, 2011

(65) Prior Publication Data

US 2012/0114385 A1 May 10, 2012

(30) Foreign Application Priority Data

Nov. 10, 2010 (JP) ..... 2010-252388

(51) Int. Cl.
*G03G 15/08* (2006.01)

(52) U.S. Cl.
USPC ..... 399/262; 399/258

(58) Field of Classification Search
CPC ..... G03G 15/0832; G03G 2215/0692; G03G 15/0837; G03G 15/0867; G03G 15/0872; G03G 15/0886
USPC ..... 399/258, 260, 262
See application file for complete search history.

(56) References Cited

U.S. PATENT DOCUMENTS

2006/0280526 A1* 12/2006 Shimomura ..... 399/258
2006/0285885 A1* 12/2006 Lee ..... 399/262
2011/0052266 A1* 3/2011 Yoon et al. ..... 399/258
2011/0142499 A1* 6/2011 Kuge et al. ..... 399/262

FOREIGN PATENT DOCUMENTS

JP 2005-134452 A 5/2005

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

A developer container includes a containing portion that is capable of containing a developer therein, the containing portion having an opening through which the developer passes; a first opening/closing member that is movable between a first open position at which the opening is open and a first closed position at which the first opening/closing member closes the opening; and a second opening/closing member that is movable between a second closed position at which the second opening/closing member doubly closes the opening by covering an outside of the first opening/closing member and a second open position at which the first opening/closing member is exposed to the outside, wherein a direction in which the second opening/closing member moves between the second open position and the second closed position is different from a direction in which the first opening/closing member moves between the first open position and the first closed position.

14 Claims, 37 Drawing Sheets

XVC
XVD
XVE
XVF
XVG
XVB
(−X)
(−Y)
(−Z)
X
Y
Z

XVIIC
XVIID
XVIIE
XVIIF
XVIIG
XVIIIH
X
(−X)
Y
(−Y)
Z
(−Z)
61
61a
61b
61c
61d
62
63
64
66
67
67a
68
68a
68b
68c
68d
68e

DEVELOPER CONTAINER, IMAGE FORMING APPARATUS, AND DEVELOPER CONTAINER CONTROLLING METHOD

CROSS-REFERENCE TO RELATED APPLICATIONS

This application is based on and claims priority under 35 USC 119 from Japanese Patent Application No. 2010-252388 filed Nov. 10, 2010.

BACKGROUND (i) Technical Field

The present invention relates to a developer container, an image forming apparatus, and a developer container controlling method.

(ii) Related Art

In general, existing image forming apparatuses using an electrophotographic method include a container for storing a developer that is consumed during an image forming operation and a container for storing a developer that is recovered during an image forming operation. Such developer containers are usually configured to be removable and replaceable.

SUMMARY

According to an aspect of the invention, a developer container includes a containing portion that is capable of containing a developer therein, the containing portion having an opening through which the developer passes; a first opening/closing member that is supported by the containing portion so as to be movable between a first open position at which the opening is open and a first closed position at which the first opening/closing member closes the opening; and a second opening/closing member that is supported by the containing portion so as to be movable between a second closed position at which the second opening/closing member doubly closes the opening by covering an outside of the first opening/closing member and a second open position at which the first opening/closing member is exposed to the outside, wherein a direction in which the second opening/closing member moves between the second open position and the second closed position is different from a direction in which the first opening/closing member moves between the first open position and the first closed position.

BRIEF DESCRIPTION OF THE DRAWINGS

Exemplary embodiments of the present invention will be described in detail based on the following figures, wherein:

FIG. 36B illustrates a state in which the inner shutter is attached, and FIG. 36C illustrating an enlarged view of the removal restraining member of FIG. 36A.

DETAILED DESCRIPTION

Hereinafter, exemplary embodiments of the present invention will be described with reference to the drawings. The present invention is not limited to the exemplary embodiments described below.

For ease of understanding, the front-back direction, the left-right direction, and the up-down direction in the figures are respectively defined as the X-axis direction, Y-axis direction, and the Z-axis direction. The directions indicated by arrows X, −X, Y, −Y, Z, and −Z will be respectively referred to as forward, backward, rightward, leftward, upward, and downward, or the front side, the back side, the right side, the left side, the top side, and the bottom side.

In each figure, a small circle with a dot in it indicates an arrow that is oriented from the back side toward the front side of the plane of the figure, and a small circle with a cross in it indicates an arrow that is oriented from the front side toward the back side of the plane of the figure.

For ease of understanding, members that are not necessary for the following description are illustrated in the figures.

First Exemplary Embodiment

Figure 1:
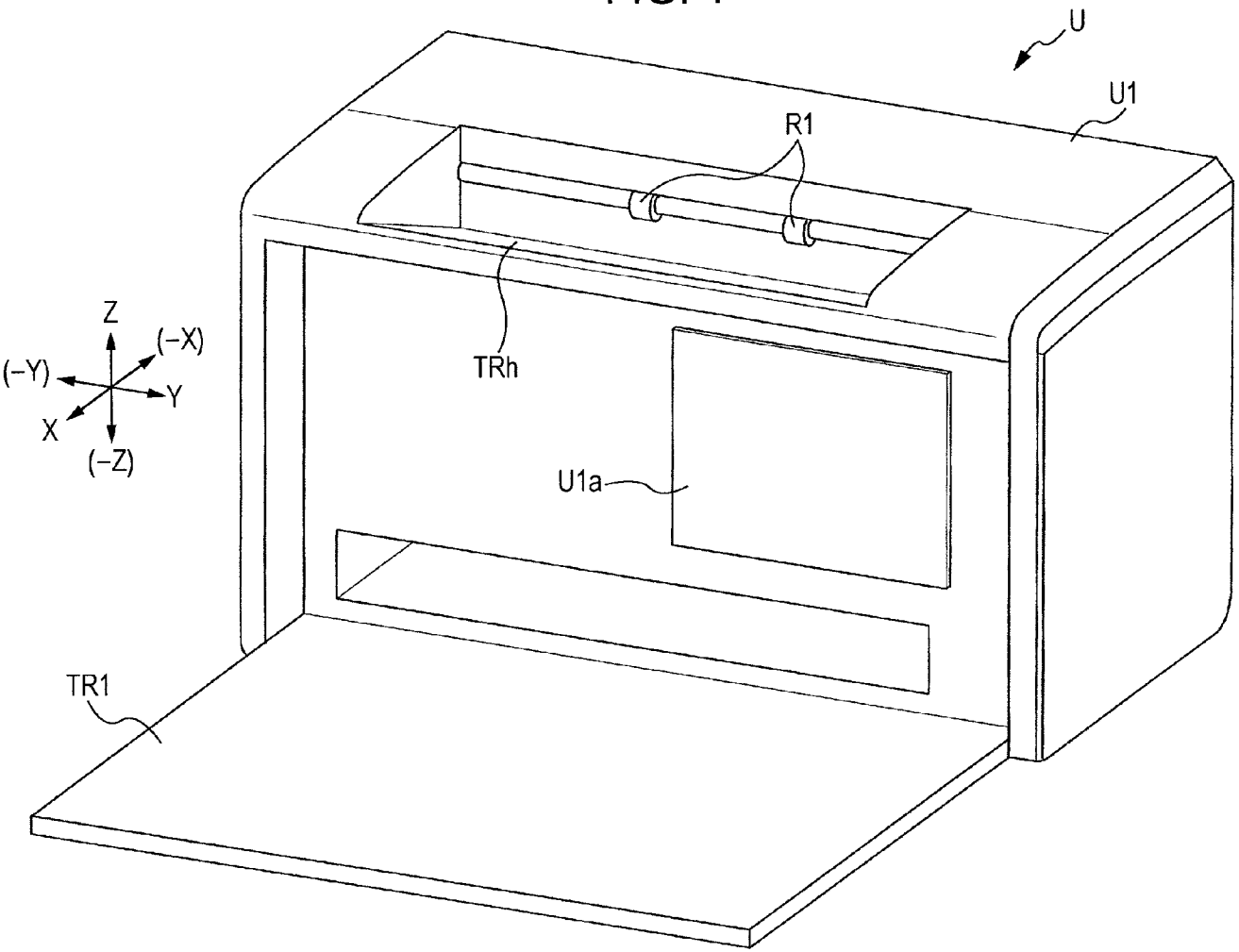
FIG. 1 is a perspective view of an image forming apparatus according to a first exemplary embodiment.

FIG. 1 is a perspective view of an image forming apparatus according to a first exemplary embodiment.

Referring to FIG. 1, a printer U serving as an example of an image forming apparatus according to the first exemplary embodiment includes a sheet feed tray TR1 serving as an example of a medium containing portion in a lower front part thereof. Recording sheets S serving as an example of recording media are placed on the sheet feed tray TR1. An output tray TRh serving as an example of an output portion onto which the sheet S on which an image has been recorded is output is formed on the upper surface of the printer U. A front cover U1*a* serving as an example of an opening/closing portion that is opened and closed when operating a toner cartridge TC that contains a developer is formed in a right front part of the printer U. The toner cartridge TC serves as an example of a removable member and as an example of a developer container as will be described below.

Figure 2:
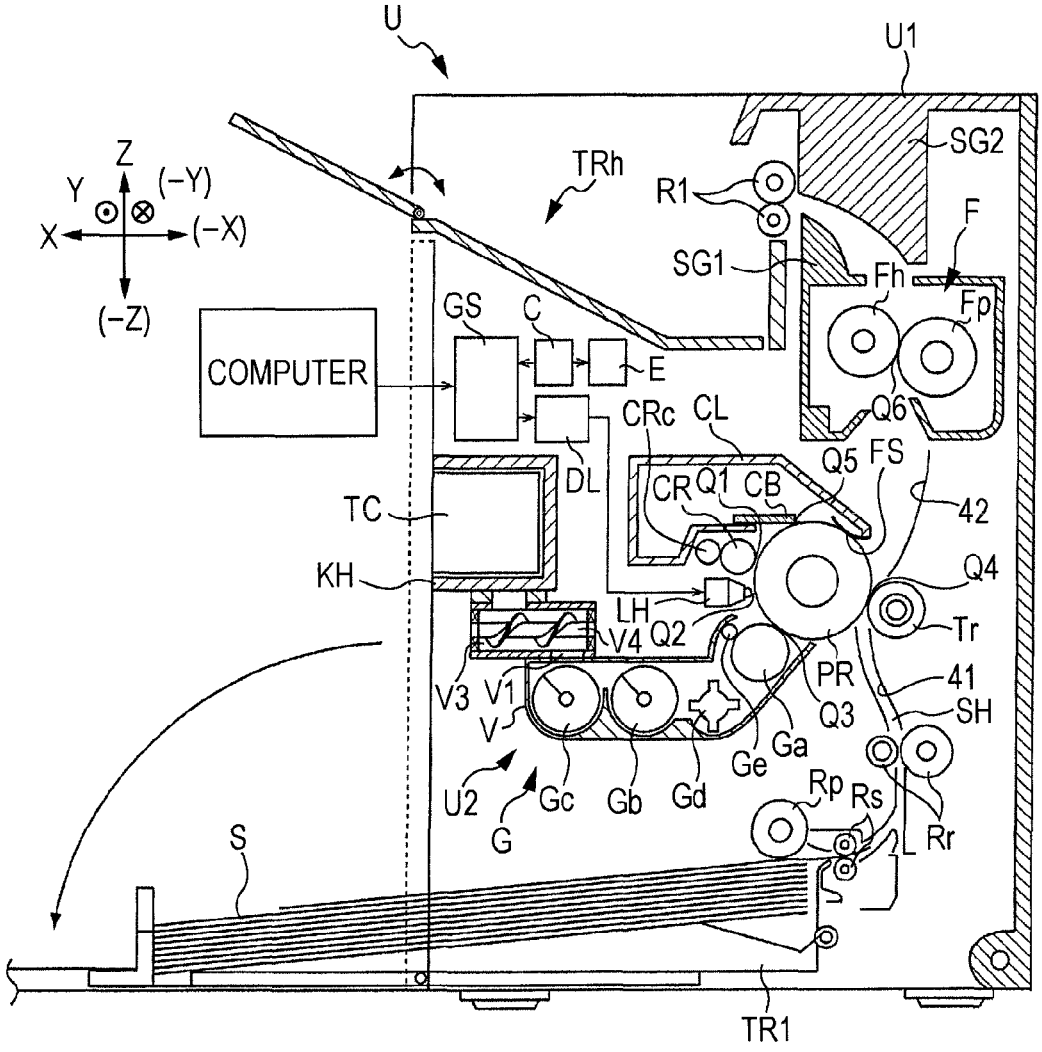
FIG. 2 is an overall view of the image forming apparatus according to the first exemplary embodiment.

FIG. 2 is an overall view of the image forming apparatus according to the first exemplary embodiment.

Referring to FIG. 2, the printer U includes a printer body U1 serving as an example of a body of the image forming apparatus and as an example of an apparatus. The printer body U1 includes a controller C serving as an example of a control unit, an image processor GS controlled by the controller C, a laser driving circuit DL serving as an example of a latent image forming circuit, and a power supply E. The power supply E supplies voltages to a charging roller CR serving as an example of a charger, a developing roller Ga serving as an example of a developing member, a transfer roller Tr serving as an example of a transfer member, and the like.

The image processor GS converts print information that has been input from a computer serving as an example of an external information transmitting device into image information for forming a latent image and outputs the image information to the laser driving circuit DL at a predetermined timing. The laser driving circuit DL outputs a driving signal to the latent image forming device LH in accordance with the input image information that has been input thereto. The latent image forming device LH according to the first exemplary embodiment is an LED head in which LEDs serving as examples of a latent image writing element are arranged with predetermined intervals in the left-right direction.

In a back part of the printer body U1, a photoreceptor PR serving as an example of a rotating image holding member is supported. Around the photoreceptor PR, a charging roller CR serving as an example of a charger, a latent image forming device LH, a developing device G, a transfer roller Tr serving as an example of a transfer device, and a photoreceptor cleaner CL serving as an example of a cleaner for an image holding member are arranged in a direction in which the photoreceptor PR rotates.

Referring to FIG. 2, the charging roller CR faces and contacts a charging roller cleaner CRc serving as an example of cleaner charger for cleaning a surface of the charging roller CR.

The developing device G includes a developer container V that contains a developer. In the developer container V, the developing roller Ga that faces the photoreceptor PR, a pair of conveyers Gb and Gc that agitate and convey the developer, a supply member Gd that supplies the developer that has been agitated by the conveyers Gb and Gc to the developing roller Ga, and a thickness control member Ge that controls the thickness of the developer on a surface of the developing roller Ga are disposed.

A developer supply port V1 serving as an example of a supply portion is formed in an upper front surface of the developer container V. A developer supply passage V3 serving as an example of a developer supply passage is connected to the developer supply port V1. A supply auger V4 serving as an example of a developer conveyer is rotatably supported in the developer supply passage V3. A cartridge holder KH serving as an example of a mount member into which the toner cartridge TC is removably installed is connected to the front end of the developer supply passage V3, and a developer is supplied from the toner cartridge TC to the developer supply passage V3. Thus, when the supply auger V4 is driven as the developer is consumed by the developing device G, the developer is supplied from the toner cartridge TC to the developing device G.

The charging roller CR charges the surface of the rotating photoreceptor PR in a charging region Q1. An electrostatic latent image is formed by latent image forming light emitted by a latent image forming device LH in a latent image forming region Q2. The developing roller Ga develops the electrostatic latent image and forms a toner image serving as an example of a visible image in a developing region Q3. The transfer roller Tr transfers the toner image onto a recording sheet S serving as an example of a medium in a transfer region Q4 in which the photoreceptor PR and the transfer roller Tr face each other. A cleaning blade CB serving as an example of cleaning member removes residual toner from the surface of the photoreceptor PR in a cleaning region Q5 serving as an example of a cleaning region that is located downstream of the transfer region Q4, and the residual toner is recovered into the photoreceptor cleaner CL.

A film seal FS serving as an example of a scatter preventing member is disposed on a side of the photoreceptor PR facing the cleaning blade CB, and the film seal FS prevents the toner that has been recovered into the photoreceptor cleaner CL from overflowing to the outside.

Referring to FIG. 2, a pick-up roller Rp serving as an example of a medium pick-up member is disposed in a sheet feed tray TR1 in a lower part of the printer body U1. The recording sheets S are picked up by the pick-up roller Rp and separated one by one by separation rollers Rs serving as an example of a medium separating member. The separation rollers Rs includes a retard roller and a feed roller. Then, the recording sheet S is transported along a sheet transport path SH and transported to a transfer region Q4 by a registration roller Rr at a predetermined timing. The registration roller Rr serving as an example of a timing control member is disposed upstream of the transfer region Q4 in the sheet transport direction.

The power supply E, which is controlled by the controller C, applies a transfer voltage to the transfer roller Tr, and the transfer roller Tr transfers a toner image from a photoreceptor PR onto the recording sheet S that is passing through the transfer region Q4.

The recording sheet S, onto which the toner image has been transferred in the transfer region Q4, is transported to a fixing device F before the toner image is fixed. The fixing device F includes a pair of fixing rollers Fh and Fp serving as an example of a fixing member, and the pair of fixing rollers Fh and Fp are pressed against each other in a fixing region Q6. In the fixing region Q6, the pair of fixing rollers Fh and Fp fix the toner image onto the recording sheet S, which has been transported to the fixing device F. The recording sheet S, on which a fix toner image has been formed, is guided by sheet guides SG1 and SG2 serving as an example of a medium guide member, and is output by output rollers R1 serving as an example of an output member to the output tray TRh on the upper surface of the printer body U1.

Description of Cartridge Holder KH

Figure 3:
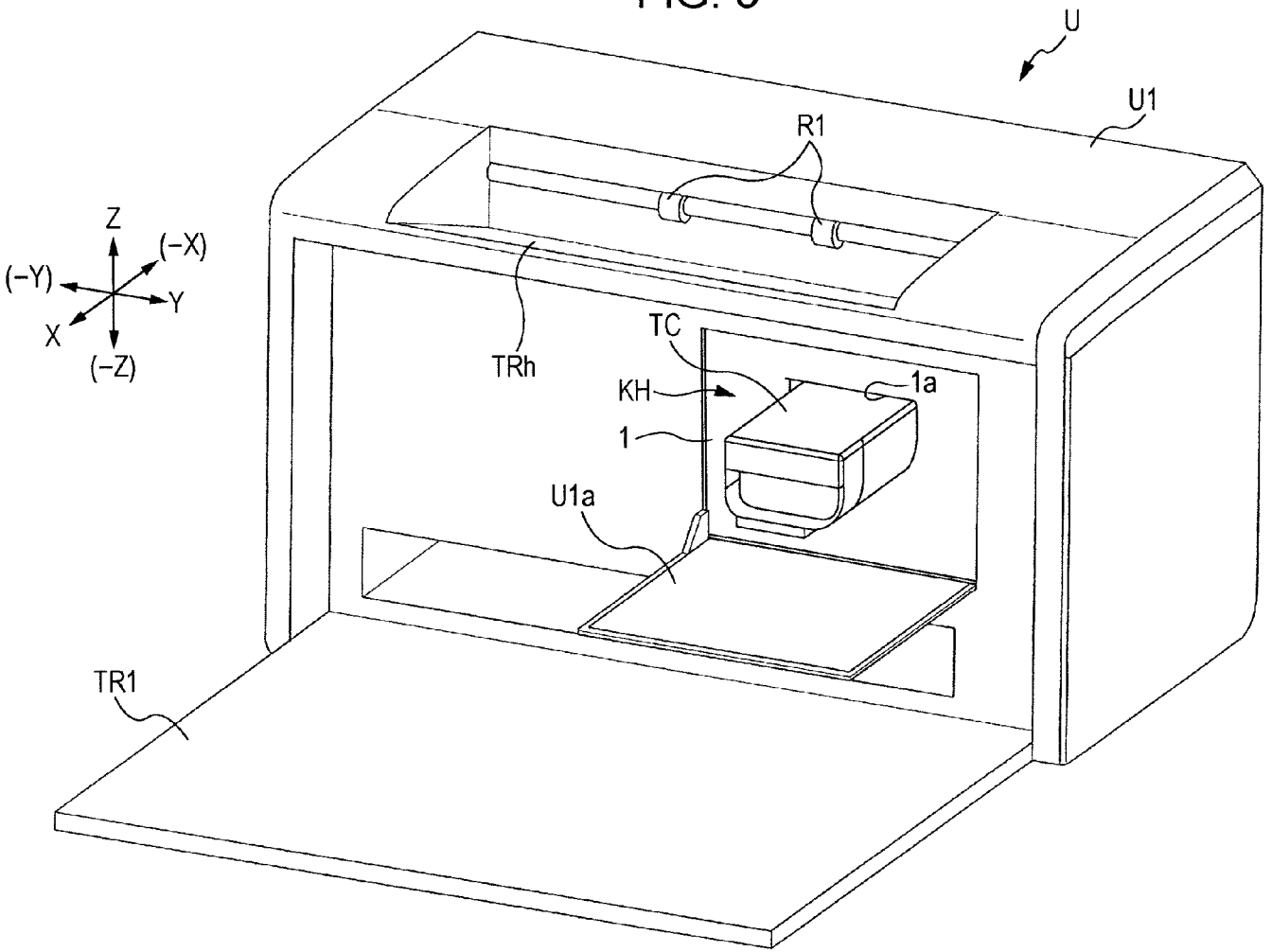
FIG. 3 illustrates an image forming apparatus according to the first exemplary embodiment when a front cover is open.

FIG. 3 illustrates the image forming apparatus according to the first exemplary embodiment when a front cover is open.

Referring to FIGS. 1 and 3, when the front cover U1*a* of the printer U according to the first exemplary embodiment is moved from a normal position illustrated in FIG. 1 to an operation position illustrated in FIG. 3, the toner cartridge TC serving as an example of a developer container and a cartridge holder KH serving as an example of a container supporter for supporting the toner cartridge TC are exposed to the outside. Referring to FIG. 3, the cartridge holder KH is supported by the printer body U1, and the cartridge holder KH includes a front panel 1 serving as an example of a front face member. An opening 1*a* through which the toner cartridge TC is inserted and removed is formed in the front panel 1.

Figure 4:
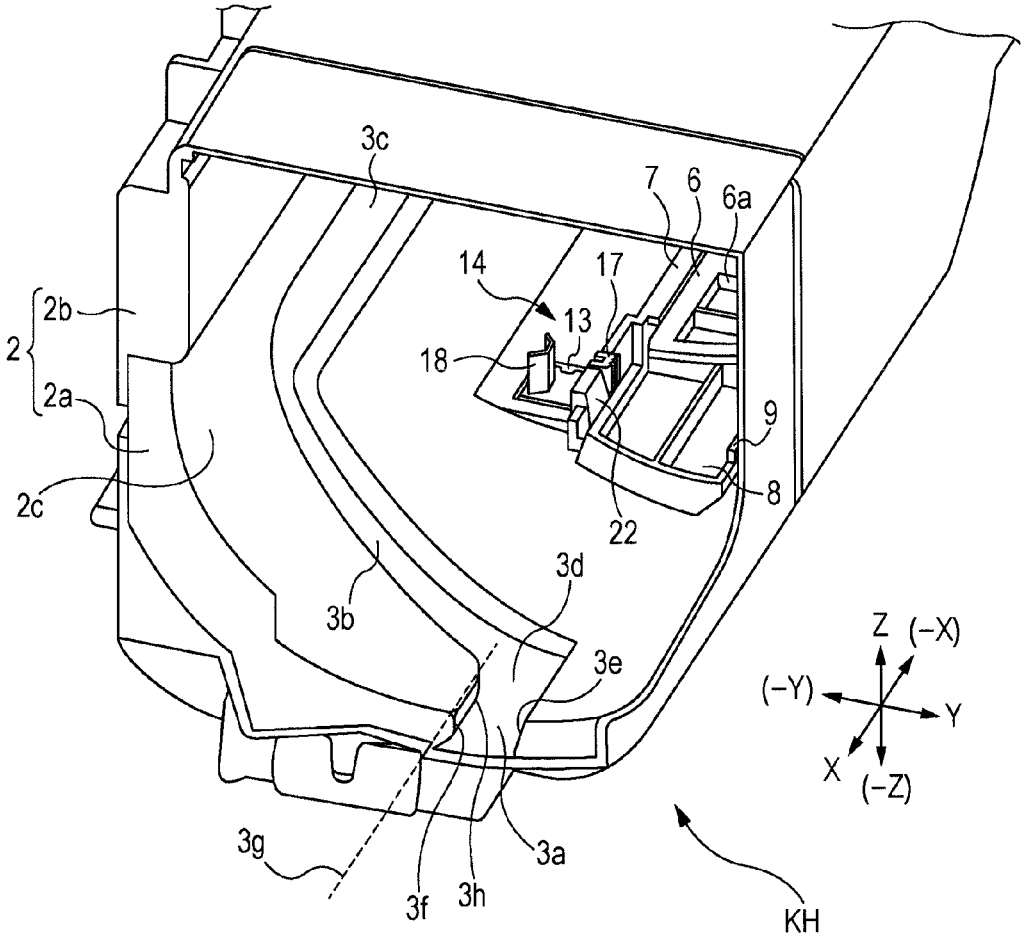
FIG. 4 is a perspective view of a cartridge holder according to the first exemplary embodiment.

FIG. 4 is a perspective view of the cartridge holder KH according to the first exemplary embodiment.

Figure 5A:
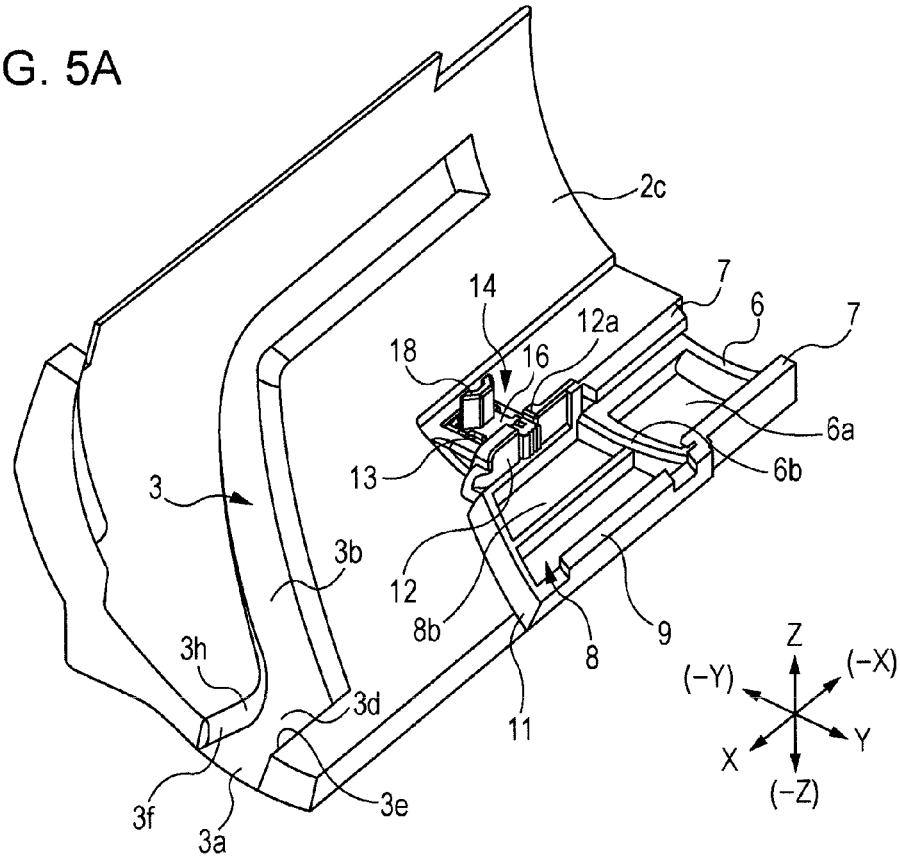
FIGS. 5A and 5B illustrate the cartridge holder according to the first exemplary embodiment, FIG. 5A illustrating a perspective view, and FIG. 5B illustrating an enlarged view of an inner shutter lock.
Figure 5B:
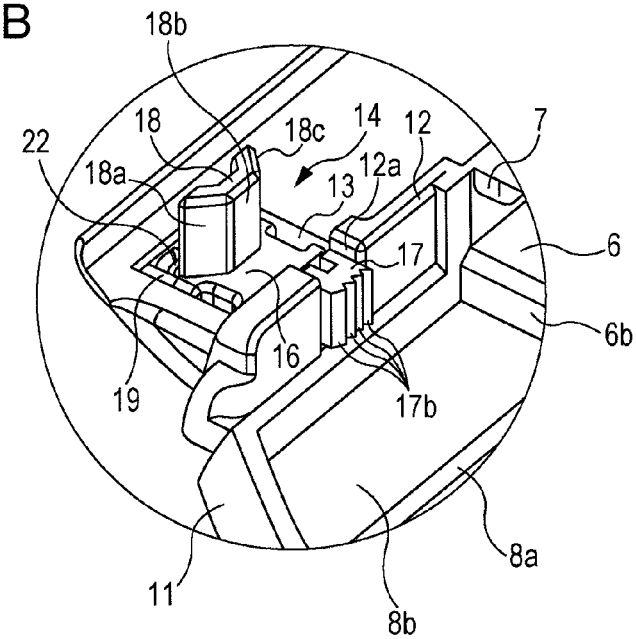

FIGS. 5A and 5B illustrate the cartridge holder according to the first exemplary embodiment, FIG. 5A illustrating a perspective view, and FIG. 5B illustrating an enlarged view of an inner shutter lock.

Figure 6:
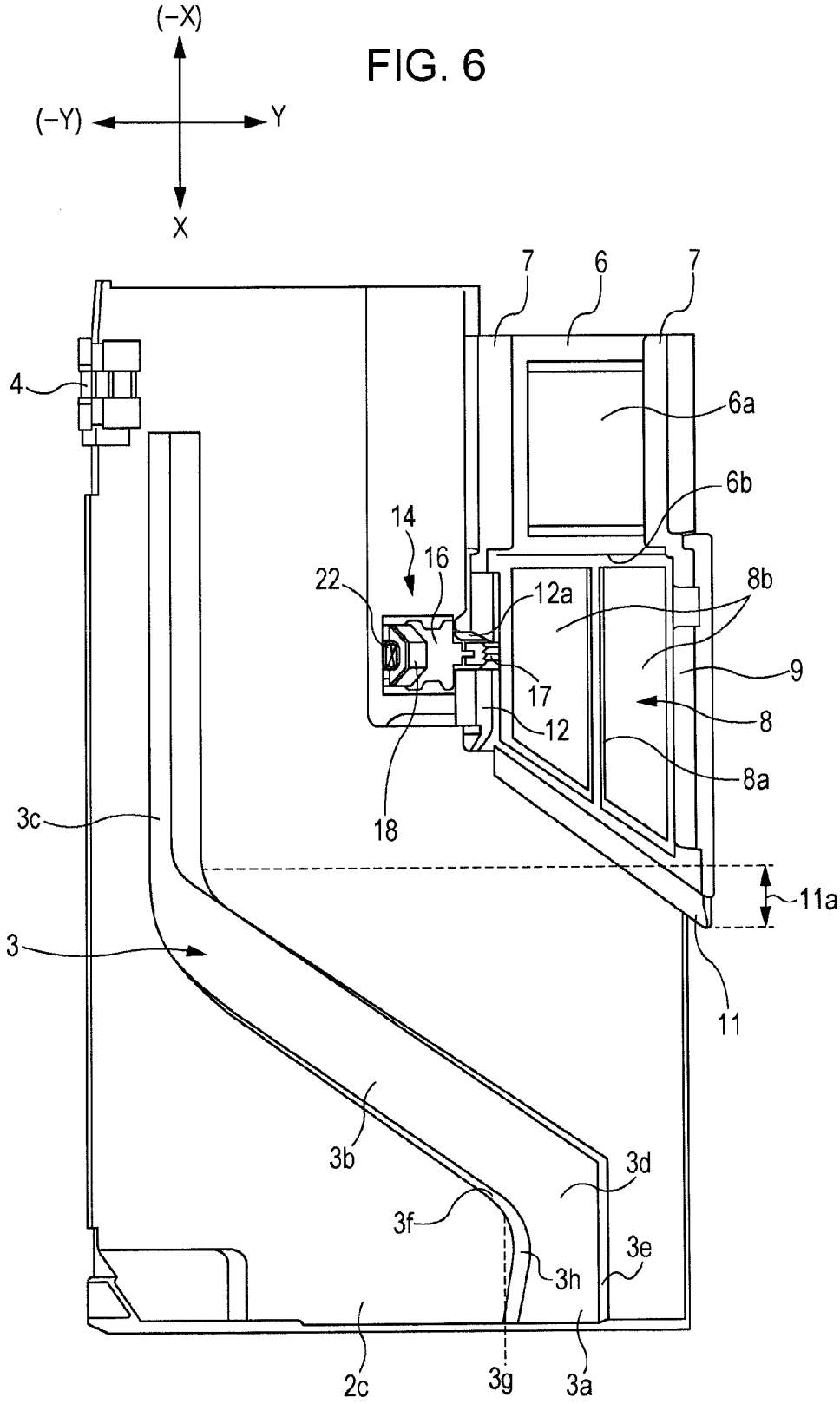
FIG. 6 is a plan view of the cartridge holder according to the first exemplary embodiment.

FIG. 6 is a plan view of the cartridge holder according to the first exemplary embodiment.

Referring to FIGS. 4 to 6, the cartridge holder KH according to the first exemplary embodiment includes a tube-shaped holder body 2 extending backward from the opening 1*a* and serving as an example of a supporter body. The holder body 2 includes a semicylindrical bottom portion 2*a* disposed in a lower part thereof and a rectangular tube-shaped top portion 2*b* formed above the bottom portion 2*a*. An inner surface 2*c* is formed inside the bottom portion 2*a* and the top portion 2*b*.

Description of Opening/Closing Groove for Outer Shutter

An opening/closing groove 3 serving as an example of an opening/closing portion of a second opening/closing member is formed in the inner surface 2*c*. The opening/closing groove 3 extends backward from the front end of the holder body 2. Referring to FIG. 6, the opening/closing groove 3 according to the first exemplary embodiment includes a front groove portion 3*a*, a spiral groove portion 3*b*, and a back groove portion 3*c*. The front groove portion 3*a* serving as an example of a passage extends backward from the front end of the opening/closing groove 3 in a direction in which the toner cartridge TC is inserted and removed. The spiral groove portion 3*b* serving as an example of an opening/closing contacted portion extends diagonally in the left backward direction along the inner surface 2*c*. The back groove portion 3*c* serving as an example of a second passage extends backward from the upper end of the spiral groove portion 3*b*. The opening/closing groove 3 according to the first exemplary embodiment includes a connection portion 3*d* at which the front groove portion 3*a* is connected to the spiral groove portion 3*b*. In the connection portion 3*d*, a right groove inner surface 3*e* that is away from the spiral groove portion 3*b* extends in the front-back direction. A protuberance 3*h* serving as an example of a protrusion is formed on a left groove inner surface 3*f* that is near the spiral groove portion 3*b*. The protuberance 3*h* protrudes rightward from the position of the opening 1*a* with respect to an imaginary line 3*g* represented by a broken line extending in the front-back direction in FIG. 6.

In FIG. 6, a CRUM reader 4 serving as an example of a storage medium reader is supported on an upper left end portion the holder body 2 according to the first exemplary embodiment.

Description of Supply Port

Referring to FIGS. 5 and 6, at the back end of the bottom portion 2*a* of the holder body 2, a supply port portion 6 serving as an example of a first opening portion is formed so as to protrude from the inner surface 2*c* of the bottom portion 2*a*. A supply port 6*a* serving as an example of a first opening is formed in a middle part of the supply port portion 6. The supply port 6*a* extends in the up-down direction and is connected to an upstream end of the developer supply passage V3. An inner shutter stopper surface 6*b* serving as an example of a stopper of a first opening/closing member is formed at the front end of the supply port portion 6.

Holder-side guides 7 serving as an example of a second opening guide portion are formed on the left and right sides of the supply port portion 6. The holder-side guides 7 extend in the front-back direction and inward in the left-right direction from the upper ends of the left and right side walls having a height larger than that of the supply port portion 6.

An inner shutter holding portion 8 serving as an example of a holding portion of the first opening/closing member is formed in front of the supply port portion 6. The inner shutter holding portion 8 has a height larger than that of the inner surface 2*c* and smaller than that of the supply port portion 6. The inner shutter holding portion 8 includes a guide rib 8*a* and recesses 8*b*. The guide rib 8*a* serving as an example of friction reducer is formed in a middle part of the inner shutter holding portion 8 in the left-right direction and extends in the front-back direction. The recesses 8*b* are formed on the left and right sides of the guide rib 8*a* so as to be recessed downward.

A backlash reducing wall 9 serving as an example of a position aligner is formed so as to protrude upward from the right end of the inner shutter holding portion 8.

At the front end of the inner shutter holding portion 8, an inclined surface 11 is formed so as to be inclined from the inner shutter holding portion 8 to the inner surface 2*c*. Referring to FIG. 6, the inclined surface 11 according to the first exemplary embodiment is formed so as to be inclined in the left backward direction. The inclination of the inclined surface 11 corresponds to the inclination of the spiral groove portion 3*b* so that an operator may insert and remove the toner cartridge TC with a small force. In the first exemplary embodiment, the inclined surface 11 has an overlapping region 11*a* in which a front part of the inclined surface 11 in the front-back direction overlaps a part of a back part of the spiral groove portion 3*b* in the front-back direction.

A lock side wall 12 serving as an example of a movement restraining portion of an engaging portion is formed so as to extend upward from the left end of the inner shutter holding portion 8. A lock passage hole 12*a* serving as an example of a passage of an engaging portion is formed in a middle part of the lock side wall 12 in the front-back direction.

Description of Inner Shutter Lock

Figure 7A:
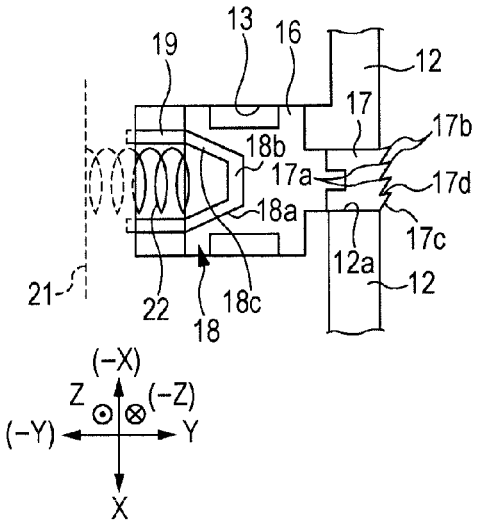
FIGS. 7A to 7C illustrate the inner shutter lock according to the first exemplary embodiment, FIG. 7A illustrating a state in which the inner shutter lock is at a locked position, FIG. 7B illustrating a state in which the inner shutter lock is at an unlocked position, and FIG. 7C illustrating an enlarged view of engagement teeth of the inner shutter lock.
Figure 7B:
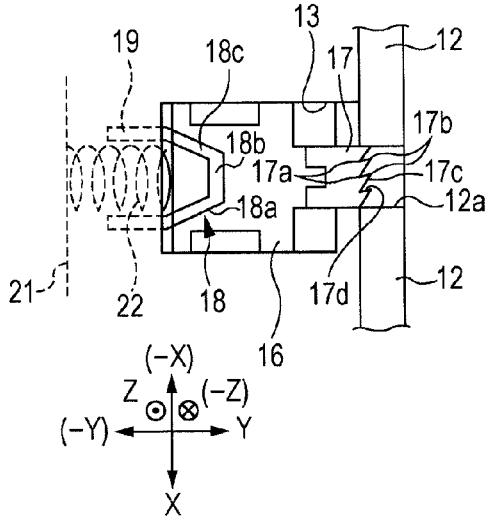
Figure 7C:
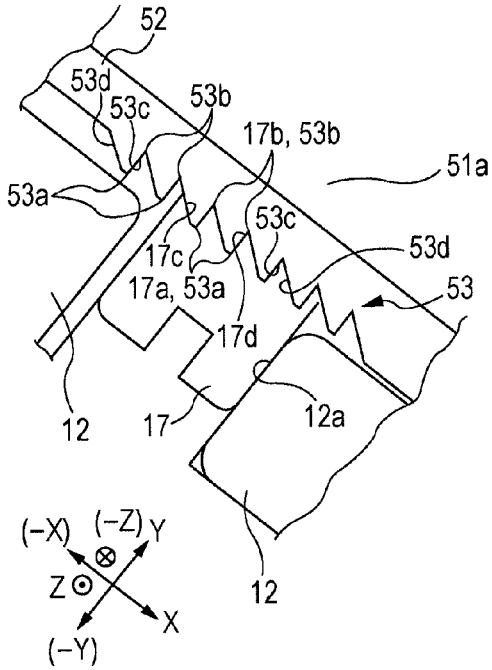

FIGS. 7A to 7C illustrate the inner shutter lock according to the first exemplary embodiment, FIG. 7A illustrating a state in which the inner shutter lock is at a locked position, FIG. 7B illustrating a state in which the inner shutter lock is at an unlocked position, and FIG. 7C illustrating an enlarged view of engagement teeth of the inner shutter lock.

A lock guide 13 serving as an example of a guide portion of an engaging portion is formed on the left side of the lock passage hole 12*a* so as to extend leftward. Referring to FIGS. 6 to 7C, an inner shutter lock 14 serving as an example of a movement restraining member of the first opening/closing member is supported in the lock guide 13. The inner shutter lock 14 includes a lock slider 16 serving as an example of a guided portion of a movement restraining member, and the lock slider 16 is supported by the inner surface of the lock guide 13 so as to be movable in the left-right direction. Thus, the inner shutter lock 14 is supported so as to be movable between the locked position serving as an example of a movement restrained position and the unlocked position serving as a movement allowed position. When the inner shutter lock 14 is at the locked position illustrated in FIG. 7A, the right end surface of the lock slider 16 contacts the left surface of the lock side wall 12 and thereby the inner shutter lock 14 is locked. The movement allowed position is to the left of the locked position as illustrated in FIG. 7B.

A lock body 17 serving as an example of engaging portion is formed at the right end of the lock slider 16. The lock body 17 extends rightward and is capable of protruding into the inner shutter holding portion 8 through the lock passage hole 12*a*. The lock body 17 according to the first exemplary embodiment is configured to be in contact with and guided by the inner surface of the lock passage hole 12*a*. Recesses 17*a* and protrusions 17*b* protruding rightward are formed at a regular pitch on a right end surface of the lock body 17, so that the right end surface of the lock body 17 according to the first exemplary embodiment is saw-tooth shaped.

Referring to FIG. 7C, the protrusions 17*b* according to the first exemplary embodiment have front surfaces 17*c* formed on the upstream sides thereof with respect to the backward direction in which the toner cartridge TC is inserted. The front surfaces 17*c* are inclined in the right backward direction toward the inside of the inner shutter holding portion 8. The protrusions 17*b* has back surfaces 17*d* that are connected to the front surfaces 17*c* and that are formed on the downstream sides thereof. The back surfaces 17*d* are inclined in the left forward direction. The angle of the back surfaces 17*d* with respect to the left-right direction is smaller than that of the front surfaces 17*c*. The back surfaces 17*d* may be inclined in the left forward direction, or may be parallel to the left-right direction.

Referring to FIGS. 7A to 7C, a slider projection 18 serving as an example of a contacted portion for separation is formed so as to protrude upward from the left upper surface of the lock slider 16. The slider projection 18 includes a front guide surface 18*a*, a middle guide surface 18*b*, and a back guide surface 18*c*. The front guide surface 18*a* serving as an example of a first separation guide portion is inclined in the right backward direction. The middle guide surface 18*b* serving as an example of a second separation guide portion extends backward from the back end of the front guide surface 18*a*. The back guide surface 18*c* serving as an example of a third separation guide portion is inclined from the back end of the middle guide surface 18*b* in the left backward direction.

At the left end of the lock slider 16, a spring holding portion 19 serving as an example of an urge holding portion having a tube-like shape is formed so as to extend leftward.

A spring support portion 21 serving as an example of a support portion of a separation urging member is formed on the lower surface of the bottom portion 2*a*. A coil spring 22 serving as an example of an urging member, which is held in the spring holding portion 19, is disposed between the spring support portion 21 and the left surface of the lock slider 16. Therefore, the lock slider 16 is always urged rightward, and the inner shutter lock 14 is urged toward the locked position by an elastic force of the coil spring 22. The urging member is not limited to the coil spring 22, and any urging member such as an elastic rubber may be used.

Description of Toner Cartridge

Figure 8:
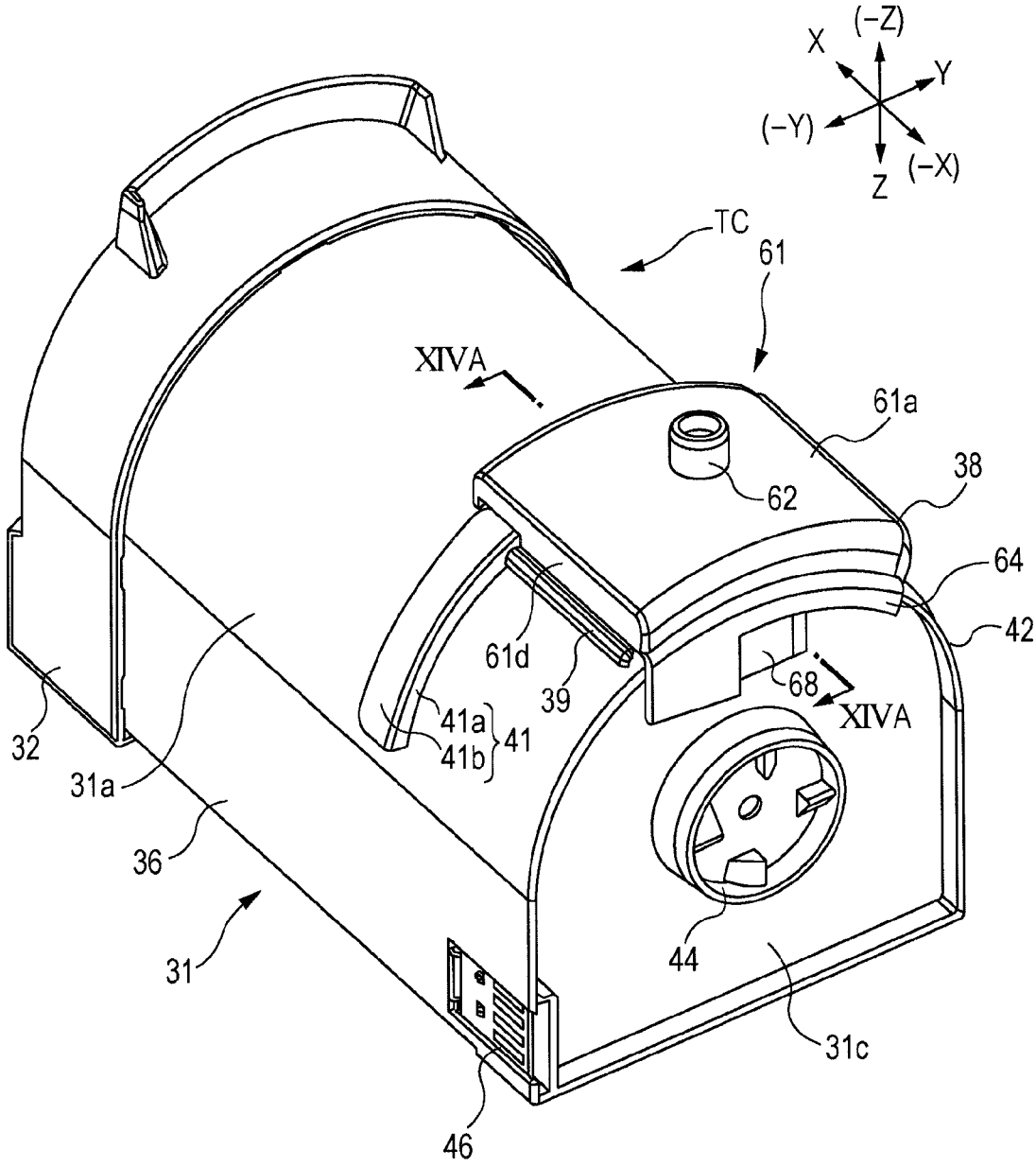
FIG. 8 illustrates a toner cartridge according to the first exemplary embodiment in a state in which an outer shutter and an inner shutter are at closed positions.

FIG. 8 illustrates the toner cartridge according to the first exemplary embodiment in a state in which an outer shutter and the inner shutter are at closed positions.

Figure 9:
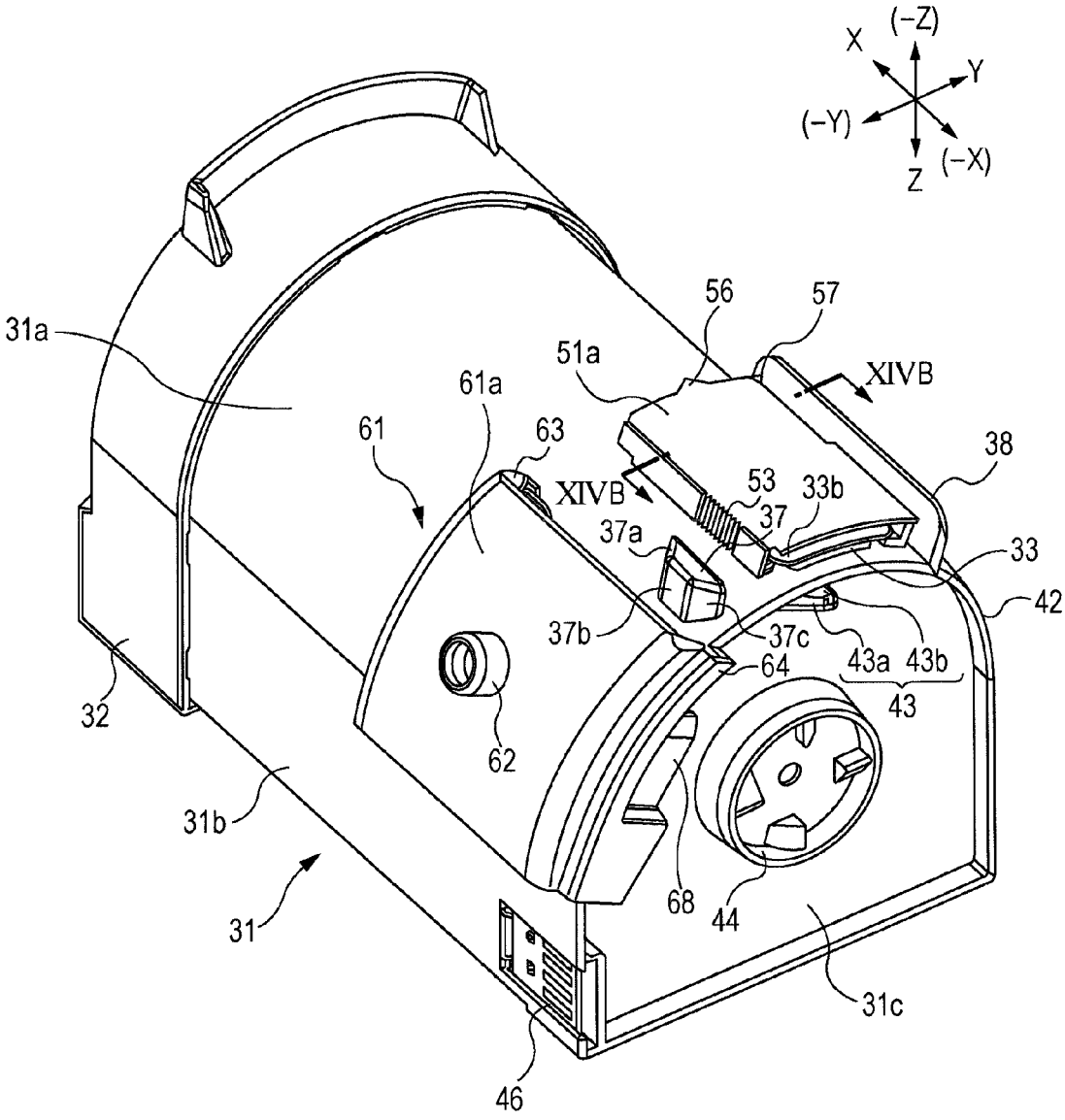
FIG. 9 illustrates the toner cartridge according to the first exemplary embodiment in a state in which the outer shutter is at an open position and the inner shutter is at a closed position.

FIG. 9 illustrates the toner cartridge according to the first exemplary embodiment in a state in which the outer shutter is at an open position and the inner shutter is at a closed position.

Figure 10:
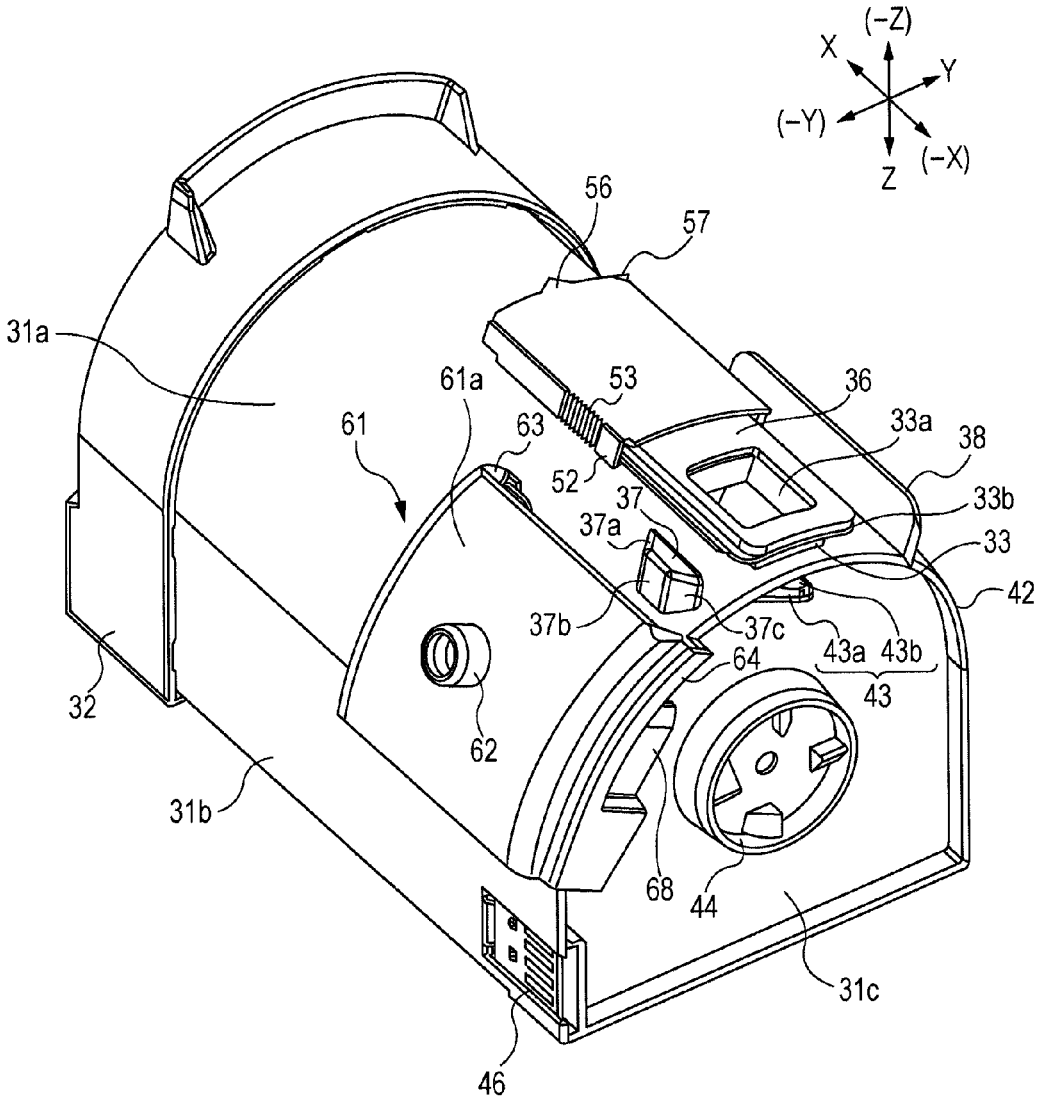
FIG. 10 illustrates the toner cartridge according to the first exemplary embodiment in a state in which the outer shutter and the inner shutter are at open positions.

FIG. 10 illustrates the toner cartridge according to the first exemplary embodiment in a state in which the outer shutter and the inner shutter are at open positions.

Figure 11:
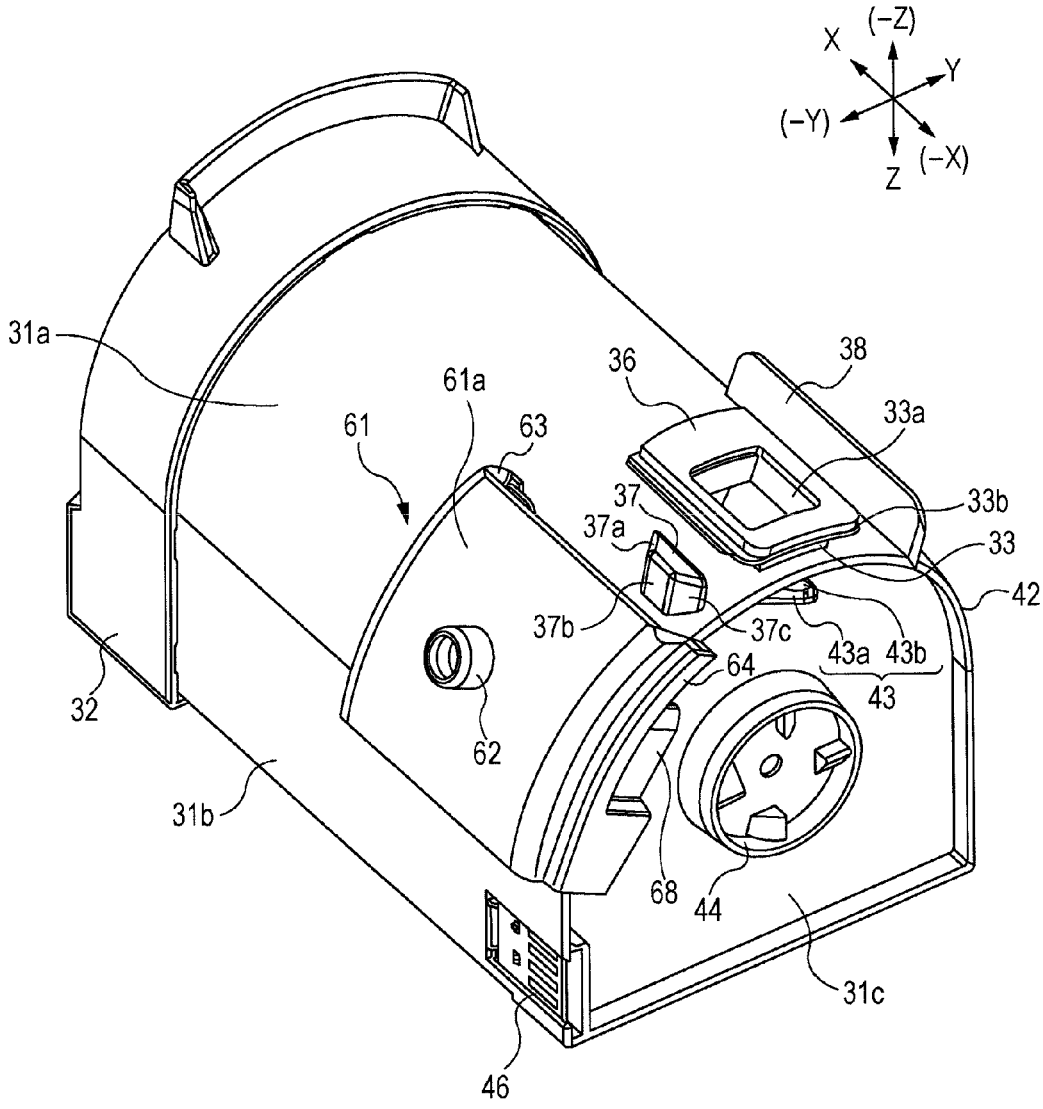
FIG. 11 illustrates the toner cartridge according to the first exemplary embodiment in a state in which the inner shutter has been removed from the state illustrated in FIG. 10.

FIG. 11 illustrates the toner cartridge according to the first exemplary embodiment in a state in which the inner shutter has been removed from the state illustrated in FIG. 10.

Figure 12A:
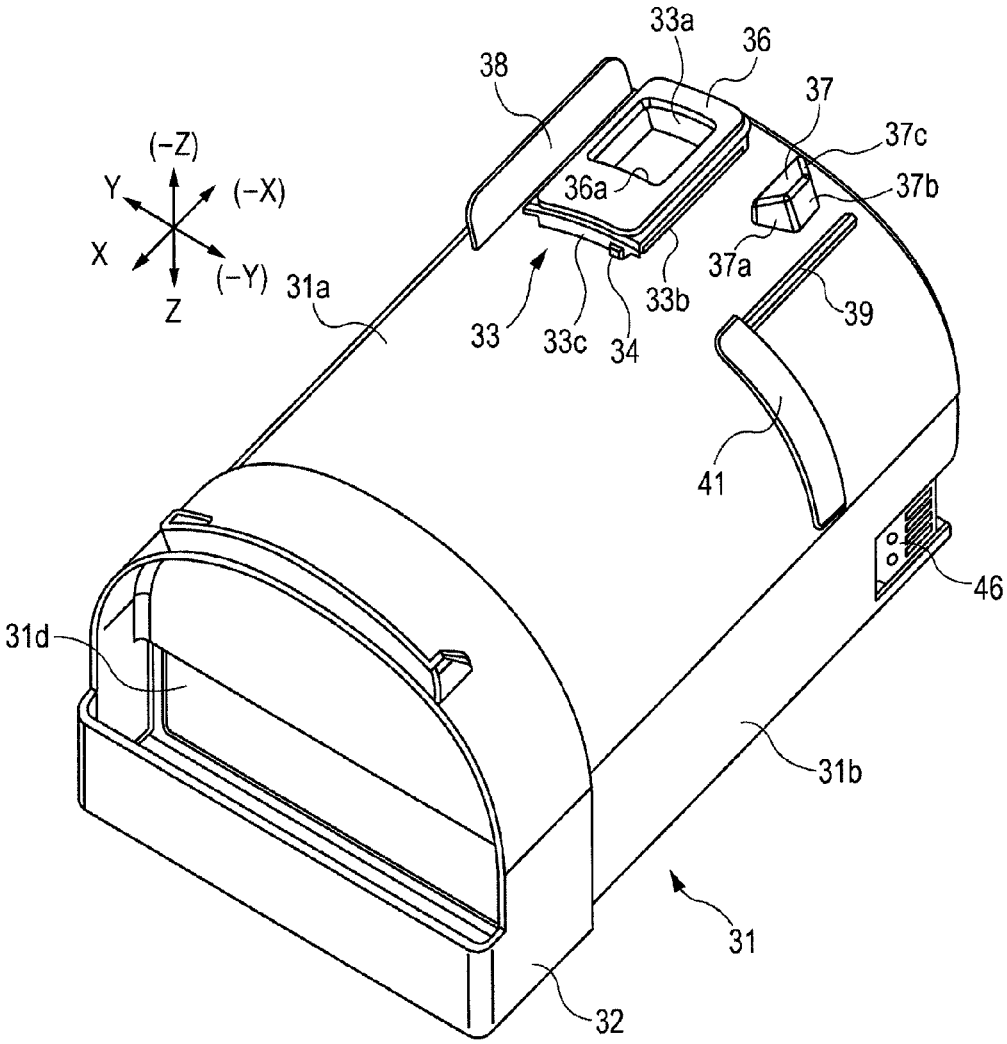
FIGS. 12A and 12B illustrate the toner cartridge in a state in which the outer shutter and the inner shutter have been removed, FIG. 12A illustrating a left front bottom perspective view, and FIG. 12B illustrating a right back bottom perspective view.
Figure 12B:
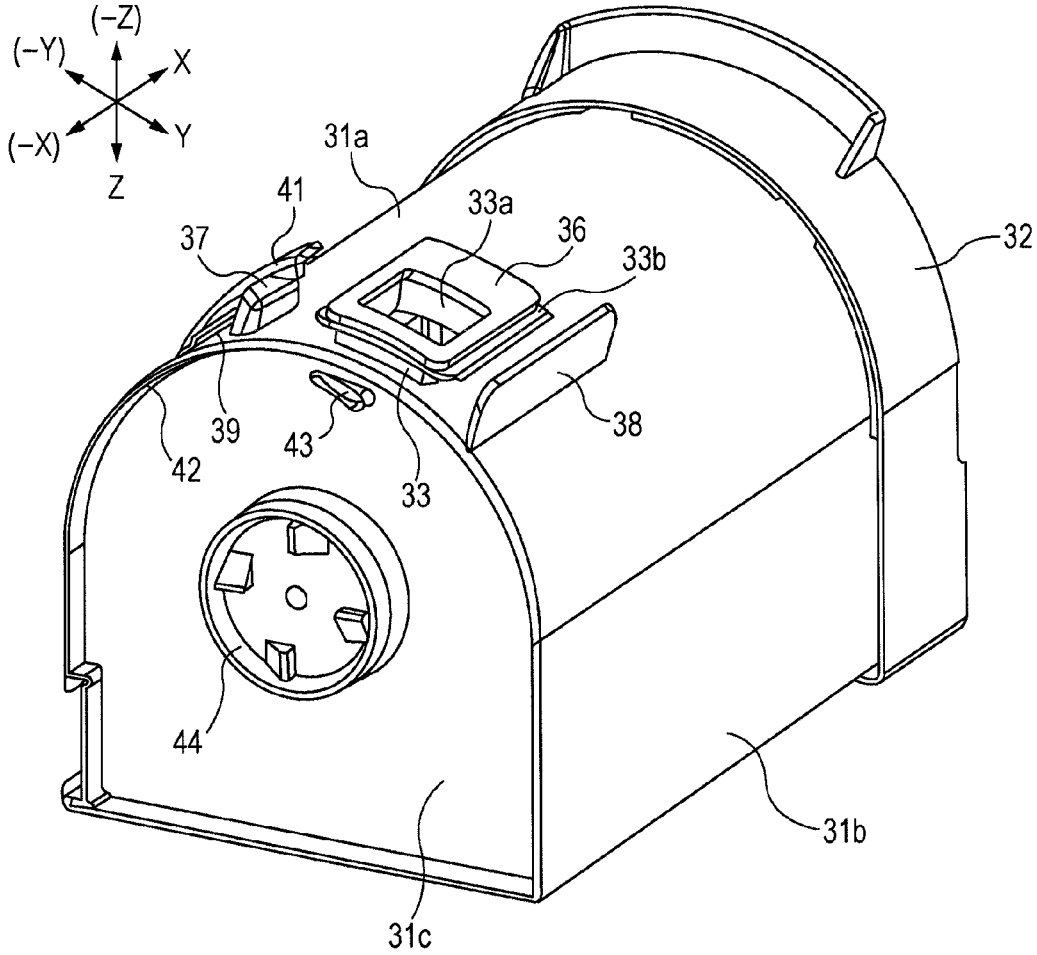

FIGS. 12A and 12B illustrate the toner cartridge in a state in which the outer shutter and the inner shutter have been removed, FIG. 12A illustrating a left front bottom perspective view, and FIG. 12B illustrating a right back bottom perspective view.

Referring to FIGS. 8 to 12B, the toner cartridge TC according to the first exemplary embodiment includes a cartridge body 31 serving as an example of a container body. The cartridge body 31 has a tube-like shape corresponding to the inner surface 2*c* of the holder body 2 and extends in the front-back direction. As with the holder body 2, the cartridge body 31 includes a semicylindrical bottom wall portion 31*a*, a rectangular tube-shaped upper wall portion 31*b* that is integrally formed with an upper part of the bottom wall portion 31*a*, a plate-shaped back wall portion 31*c* disposed at the back end, and a plate-shaped front wall portion 31*d* disposed at the front end. Developer to be supplied to the developing device G is contained inside the cartridge body 31 surrounded by the wall portions 31*a* to 31*d*.

A handle 32 serving as an example of an operation portion is disposed at the front end of the cartridge body 31. An operator holds the handle 32 to move the toner cartridge TC in the front-back direction.

A connection hole portion 33 serving as an example of a second opening portion and serving as an example of a support portion of the first opening/closing member is formed so as to extend downward from the back end of the bottom wall portion 31*a* of the cartridge body 31. A connection hole 33*a* serving as an example of a second opening that is open downward is formed so as to extend backward from a middle part of the connection hole portion 33. At the left and right ends of the connection hole portion 33, a pair of inner shutter guides 33*b* serving as an example of a guide portion of the first opening/closing member are formed so as to protrude from the upper end of the connection hole portion 33 in the left-right direction and in the front-back direction.

Figure 13A:
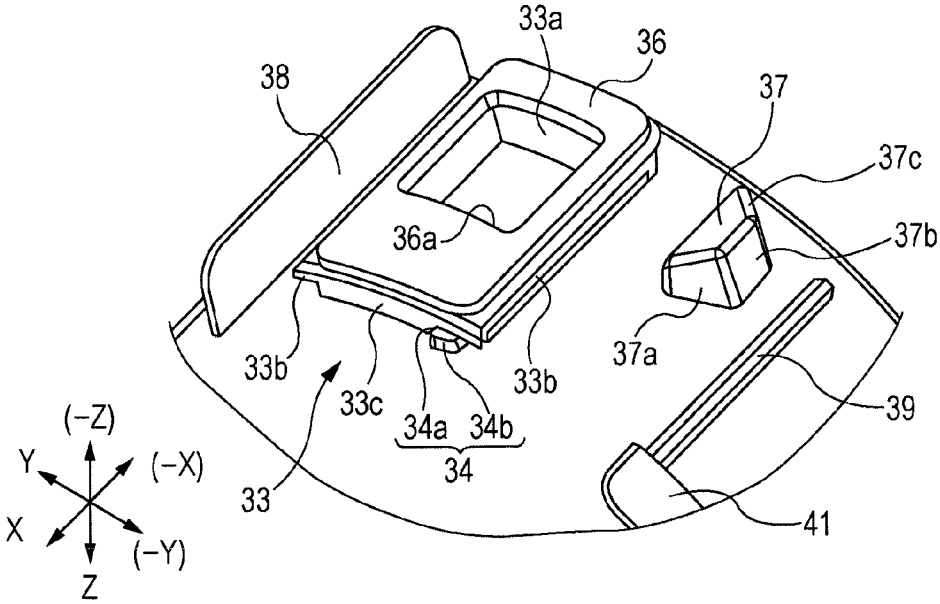
FIGS. 13A and 13B illustrate a connection hole formed in the toner cartridge, FIG. 13A illustrating a left front bottom perspective view, and FIG. 13B illustrating a right back bottom perspective view.
Figure 13B:
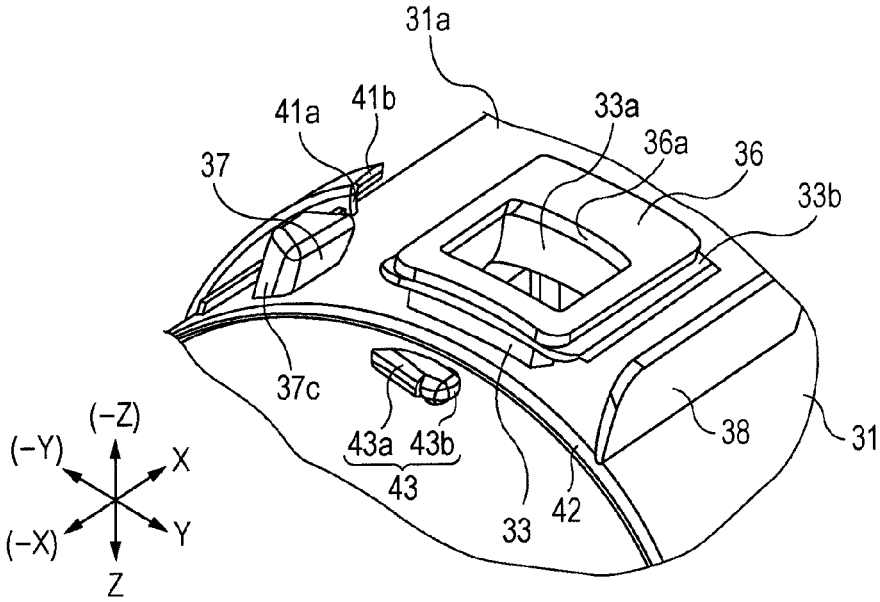

FIGS. 13A and 13B illustrate a connection hole formed in the toner cartridge, FIG. 13A illustrating a left front bottom perspective view, and FIG. 13B illustrating a right back bottom perspective view.

Referring to FIGS. 12A and 13A, an outer lock tab 34 serving as an example of an opening restraining portion is formed so as to protrude forward from the left end of a front end surface 33*c* of the connection hole portion 33. The outer lock tab 34 according to the first exemplary embodiment has a right-angled triangular shape, and includes a right end surface 34*a* and a lock guide surface 34*b*. The right end surface 34*a* serving as an example of a restraining portion body extends forward from the front end surface 33*c* of the connection hole portion 33. The outer lock guide surface 34*b* serving as an example of a restraining guide portion is inclined from the front end of the right end surface 34*a* in the left backward direction.

A connection hole seal 36 serving as an example of a leakage prevention member is supported on a lower surface that is the outer surface of the connection hole portion 33. An opening 36*a* corresponding to the connection hole 33*a* is formed in a middle part of the connection hole seal 36.

Referring to FIGS. 12A to 13B, a lock release projection 37 serving as an example of a contact portion for separation is formed at a position to the left of the connection hole portion 33. The lock release projection 37 is formed at the position corresponding to the slider projection 18 of the inner shutter lock 14 so as to protrude downward. The lock release projection 37 includes a front guided surface 37*a*, a middle guided surface 37*b*, and a back guided surface 37*c*. The front guided surface 37*a* serving as an example of a first separation guided portion is inclined in the left backward direction from the front end thereof. The middle guided surface 37*b* serving as an example of a second separation guided portion extends backward from the back end of the front guided surface 37*a*. The back guided surface 37*c* serving as an example of a third separation guided portion is inclined in the right backward direction from the back end of the middle guided surface 37*b*.

An outer shutter right stopper 38 serving as an example of a stopper of the second opening/closing member is formed at a position to the right of the connection hole portion 33 so as to extend like a wall in the front-back direction.

A rib 39 serving as an example of a protrusion is formed at a position to the left of the lock release projection 37 so as to extend in the front-back direction in order to prevent an inner shutter 51, which will be described below, from being exposed.

An outer shutter front guide 41 serving as an example of a containing portion guide portion is formed at a position to the left front of the lock release projection 37 so as to extend in the circumferential direction of the semicylindrical outer peripheral surface of the cartridge body 31. The outer shutter front guide 41 includes an upright wall 41*a* and an arc-shaped plate 41*b*. The upright wall 41*a* extends from the outer peripheral surface of the cartridge body 31 in the radial direction. The arc-shaped plate 41*b* extends forward from the outer end of the upright wall 41*a*.

Figure 14A:
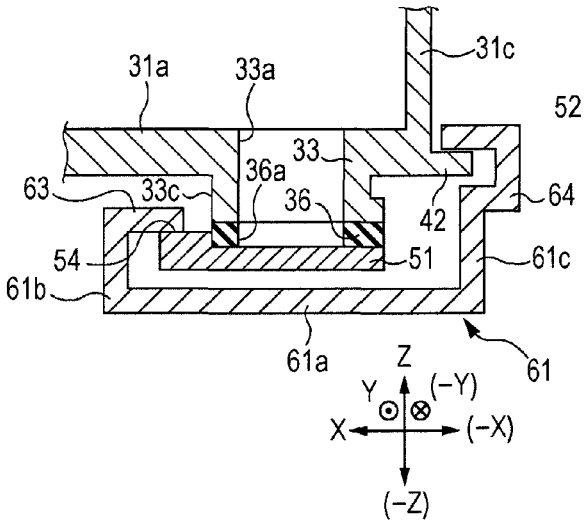
FIGS. 14A to 14C are sectional views of a connection hole portion according to the first exemplary embodiment, FIG. 14A illustrating a sectional view taken along line XIVA-XIVA of FIG. 8, FIG. 14B illustrating a sectional view taken along line XIVB-XIVB of FIG. 9, and FIG. 14C illustrating a state in which the inner shutter has been removed from the state illustrated in FIG. 14A.
Figure 14B:
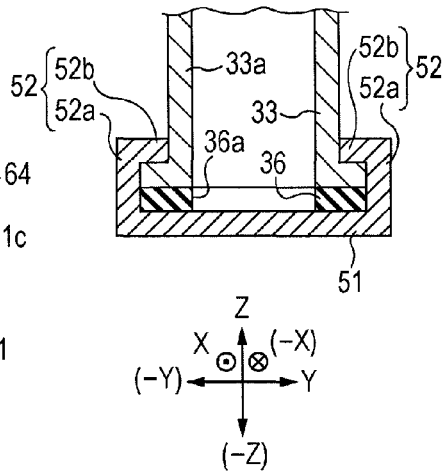
Figure 14C:
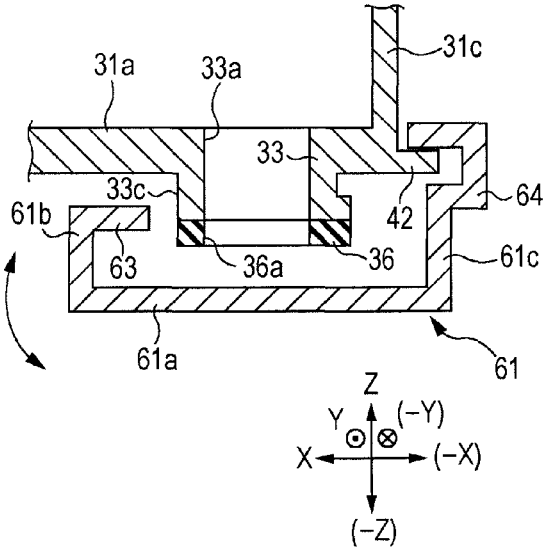

FIGS. 14A to 14C are sectional views of a connection hole portion according to the first exemplary embodiment, FIG. 14A illustrating a sectional view taken along line XIVA-XIVA of FIG. 8, FIG. 14B illustrating a sectional view taken along line XIVB-XIVB of FIG. 9, and FIG. 14C illustrating a state in which the inner shutter has been removed from the state illustrated in FIG. 14A.

Referring to FIGS. 8 to 11, 12B, 13B, 14A, and 14C, an outer shutter back guide 42 serving as an example of a containing portion guide portion is formed so as to protrude backward from the back end of the cartridge body 31. The outer shutter back guide 42 according to the first exemplary embodiment is formed at the back ends of the bottom wall portion 31*a* and the upper wall portion 31*b* of the cartridge body 31. The outer shutter back guide 42 is formed as a step between the back wall portion 31*c* and the back ends of the bottom wall portion 31*a* and the upper wall portion 31*b*.

Referring to FIGS. 12B and 13B, a spring contact projection 43 serving as an example of an urged member is formed so as to protrude backward from a lower end part of the back wall portion 31*c*. The spring contact projection 43 according to the first exemplary embodiment has a right-angled triangular shape, and includes a spring guide portion 43*a* and a right end portion 43*b*. The spring guide portion 43*a* serving as an example of a guide portion is inclined in the right backward direction. The right end portion 43*b* extends forward from the right end of the spring guide portion 43*a*.

A coupling 44 serving as an example of a drive transmitting member is rotatably supported on a middle part of the back wall portion 31*c*. When the toner cartridge TC is installed in the printer body U1, the coupling 44 engages with another coupling serving as an example of a drive transmitting member that is disposed at a back end part of the cartridge holder KH, so that driving force is transmitted. A known conveyer (not shown) is disposed in the cartridge body 31, and the conveyer conveys a developer in the cartridge body 31 toward the connection hole 33*a* when the back end of the cartridge body 31 is supported by the coupling 44 and rotation is transmitted.

Referring to FIGS. 8 to 12B, a CRUM 46 serving as an example of a storage medium is supported at a position corresponding to the CRUM reader 4 at the left back end of the upper wall portion 31*b*. The CRUM 46 stores information regarding whether or not a developer remains in the toner cartridge TC. When the toner cartridge TC is installed, the CRUM 46 is electrically connected to the CRUM reader 4 and reading and writing of information is enabled.

Description of Inner Shutter

Figures 15A, 15B, 15C, 15D, 15E, 15F, 15G:
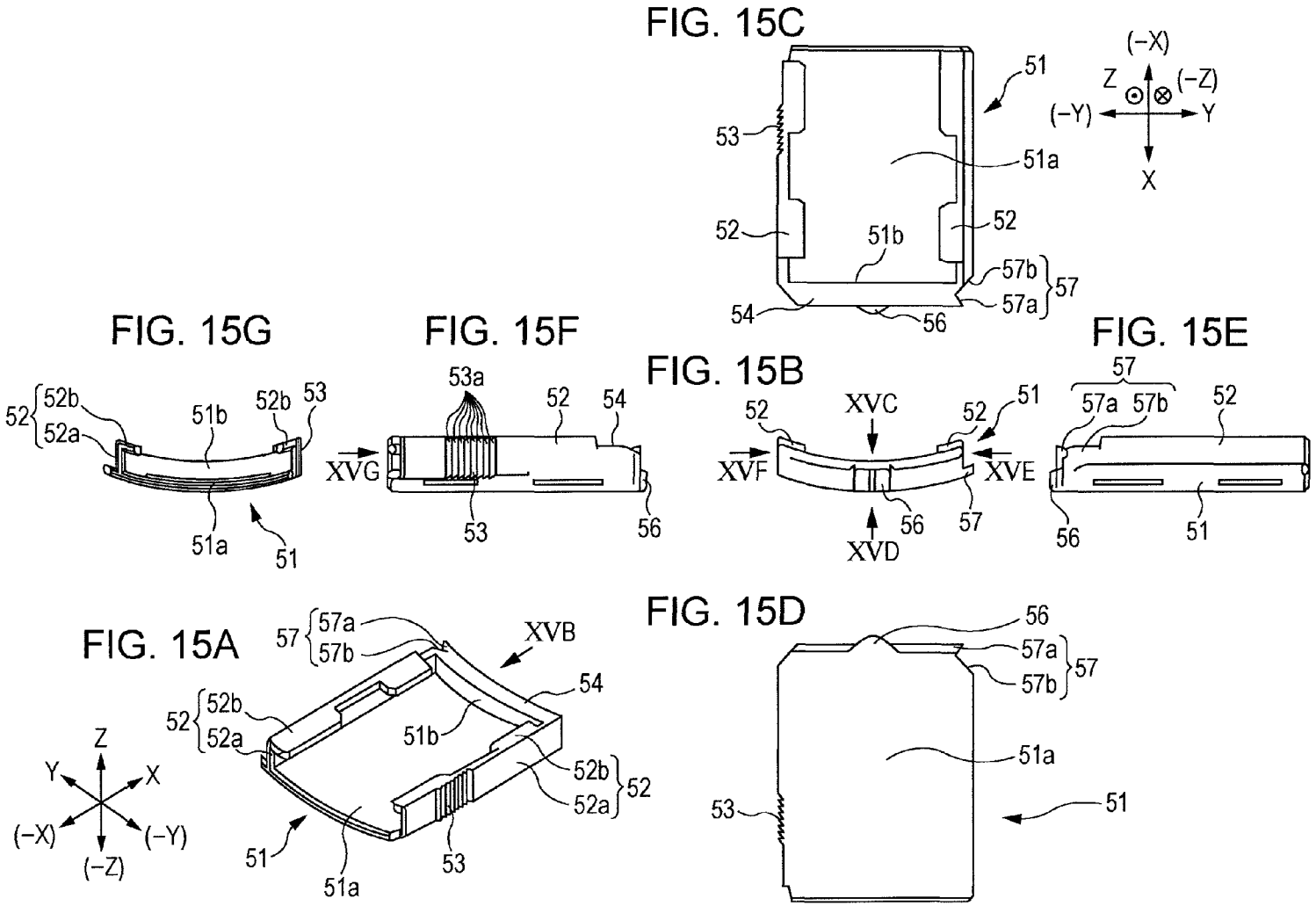
FIGS. 15A to 15G illustrate the inner shutter according to the first exemplary embodiment, FIG. 15A illustrating a perspective view, FIG. 15B illustrating a view seen in the direction of arrow XVB of FIG. 15A, FIG. 15C illustrating a view seen in the direction of arrow XVC of FIG. 15B, FIG. 15D illustrating a view seen in the direction of arrow XVD of FIG. 15B, FIG. 15E illustrating a view seen in the direction of arrow XVE of FIG. 15B, FIG. 15F illustrating a view seen in the direction of arrow XVF of FIG. 15B, and FIG. 15G illustrating a view seen in the direction of arrow XVG of FIG. 15F.

FIGS. 15A to 15G illustrate the inner shutter according to the first exemplary embodiment, FIG. 15A illustrating a perspective view, FIG. 15B illustrating a view seen in the direction of arrow XVB of FIG. 15A, FIG. 15C illustrating a view seen in the direction of arrow XVC of FIG. 15B, FIG. 15D illustrating a view seen in the direction of arrow XVD of FIG. 15B, FIG. 15E illustrating a view seen in the direction of arrow XVE of FIG. 15B, FIG. 15F illustrating a view seen in the direction of arrow XVF of FIG. 15B, and FIG. 15G illustrating a view seen in the direction of arrow XVG of FIG. 15F.

Referring to FIGS. 9, 10, 14, and 15, the inner shutter 51 serving as an example of a first opening/closing member is supported on the connection hole portion 33. The inner shutter 51 according to the first exemplary embodiment includes an inner shutter body 51*a* serving as an example of an opening/closing member body. The inner shutter body 51*a* has a plate-like shape, faces the outer surface of the connection hole portion 33, and closely contacts the connection hole seal 36 by elastically deforming the connection hole seal 36. A front end wall 51*b* is formed so as to extend upward from the front end of the inner shutter body 51*a*.

At each of the left and right ends of the inner shutter body 51*a*, an inner guide rail 52 serving as an example of a guided portion of the first opening/closing member is formed so as to extend in the front-back direction. The inner guide rail 52 is supported by the inner shutter guides 33*b* so as to be movable in the front-back direction. The inner guide rail 52 according to the first exemplary embodiment includes inner shutter side walls 52*a* and guided portions 52*b*. The inner shutter side walls 52*a*, serving as an example of a side portion, extend upward from the left and right ends of the inner shutter body 51*a* and are disposed outside the inner shutter guides 33*b*. The guided portions 52*b* extend inward from the upper end of the inner shutter side walls 52*a* in the left-right direction, and are configured to be in contact with and guided by the upper surface of the inner shutter guides 33*b*.

Therefore, the inner shutter 51 according to the first exemplary embodiment is supported so as to be movable between an inner shutter closed position and an inner shutter open position with respect to the connection hole 33*a* as the inner guide rail 52 is guided by the inner shutter guides 33*b*. When the inner shutter 51 is at the inner shutter closed position serving as an example of a first closed position illustrated in FIG. 9, the inner shutter 51 closes the connection hole 33*a*. When the inner shutter 51 is at the inner shutter open position serving as an example of a first open position illustrated in FIG. 10, the connection hole 33*a* is open.

In a back part of the left one of the inner shutter side walls 52*a*, an inner shutter locked portion 53 serving as an example of an engaged portion is formed so as to be engageable with the lock body 17 of the inner shutter lock 14. Referring to FIG. 7C and FIGS. 15A to 15G, the inner shutter locked portion 53 according to the first exemplary embodiment has protrusions 53*a* and recesses 53*b* that are formed at a regular pitch so as to be engageable with the recesses 17*a* and the protrusions 17*b* of the lock body 17, so that the inner shutter locked portion 53 is saw-tooth shaped. Therefore, as illustrated in FIG. 7C, back surfaces 53*c* of the protrusions 53*a* of the locked portion of the inner shutter according to the first exemplary embodiment are formed so as to be inclined in the right backward direction so as to correspond to the front surfaces 17*c* and the back surfaces 17*d* of the protrusions 17*b*, and front surfaces 53*d* are formed so as to be inclined in the left forward direction.

Referring to FIGS. 14A to 15G, an outer shutter extension guide 54 serving as an example of a second opening/closing member guide portion and serving as an example of a removal restraining member is formed so as to protrude from the upper surface of the front end wall 51*b* of the inner shutter body 51*a*. The outer shutter extension guide 54 has a height that is smaller than that of the upper end of the inner guide rail 52. When the inner shutter 51 is at the inner shutter closed position, the outer shutter extension guide 54 according to the first exemplary embodiment is disposed on an extension line of the arc-shaped plate 41*b* of the outer shutter front guide 41 of the cartridge body 31.

A pushed projection 56 serving as an example of a pushed portion protrudes forward from a lower part of the front surface of the front end wall 51*b*. The pushed projection 56 according to the first exemplary embodiment is disposed in a middle part of the inner shutter body 51*a* with respect to the left-right direction and has a triangular shape that protrudes forward.

An engagement recess 57 serving as an example of a misassembly prevention member is formed in a right end part of the front end wall 51*b* so as to be recessed leftward. The engagement recess 57 according to the first exemplary embodiment includes a front engaging portion 57*a* and a back engaging portion 57*b*. The front engaging portion 57*a* is inclined from the front end thereof in the left backward direction. The back engaging portion 57*b* is inclined from the back end of the front engaging portion 57*a* in the right backward direction.

Description of Outer Shutter

Figure 16A:
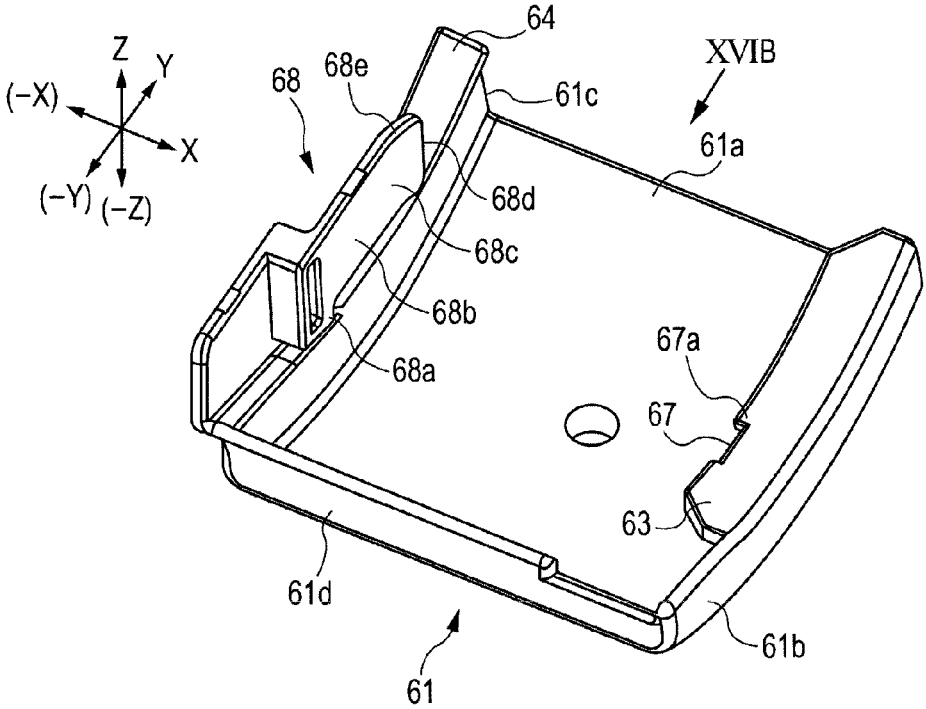
FIGS. 16A and 16B illustrate the outer shutter according to the first exemplary embodiment, FIG. 16A illustrating a top perspective view, and FIG. 16B illustrating a view seen in the direction of XVIB of FIG. 16A.
Figure 16B:
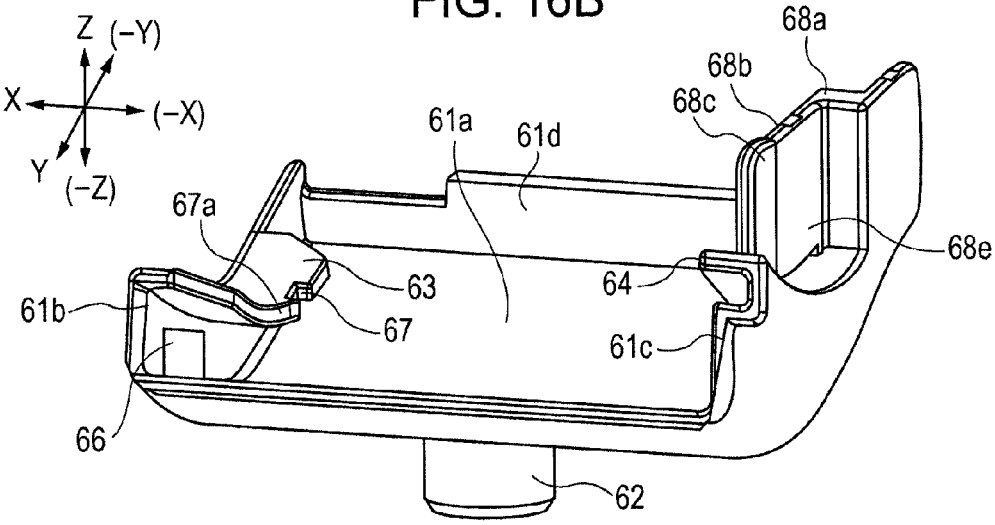

FIGS. 16A and 16B illustrate the outer shutter according to the first exemplary embodiment, FIG. 16A illustrating a top perspective view, and FIG. 16B illustrating a view seen in the direction of XVIB of FIG. 16A.

Figures 17A, 17B, 17C, 17D, 17E, 17F, 17G, 17H:
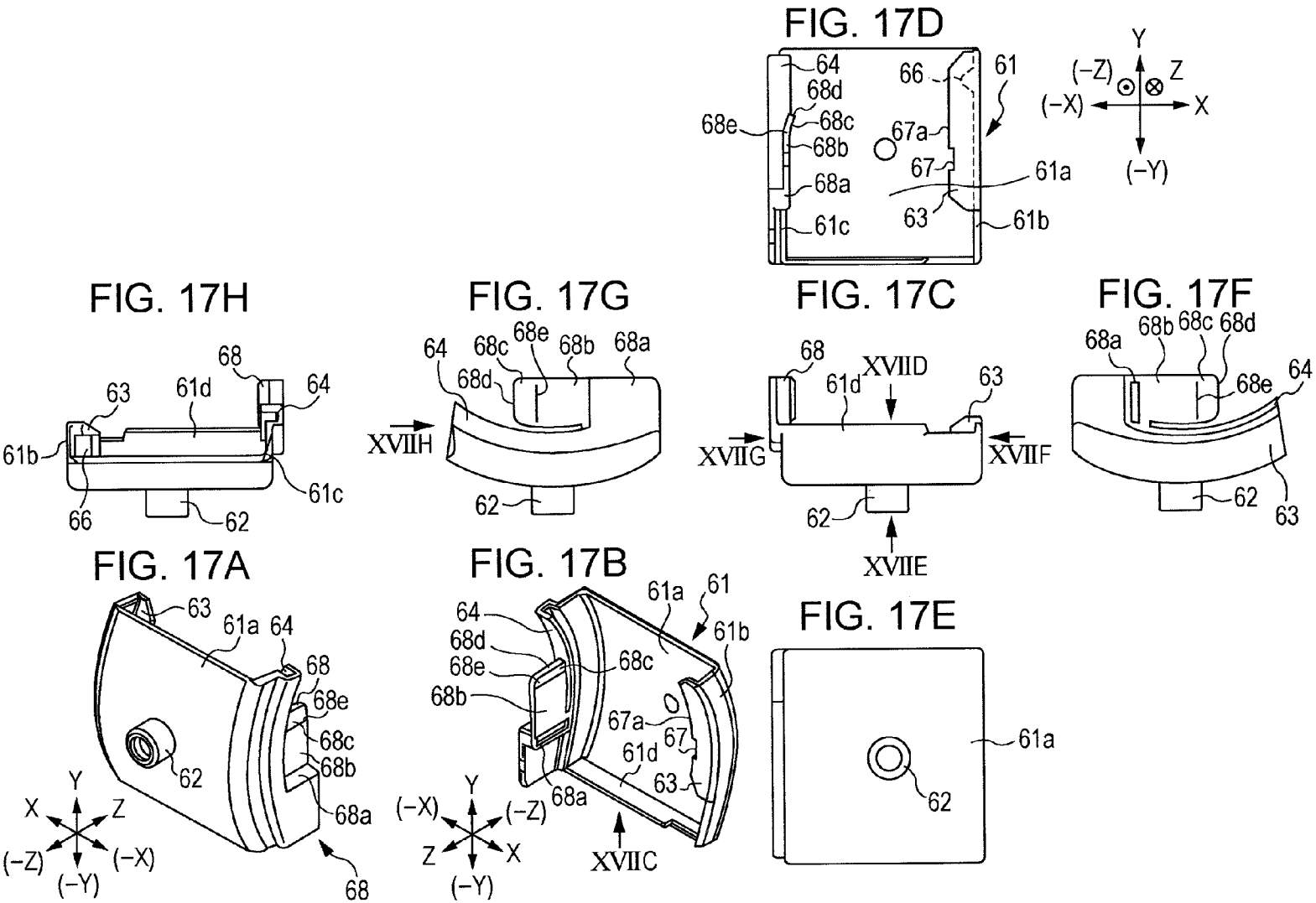
FIGS. 17A to 17H illustrate the outer shutter according to the first exemplary embodiment, FIG. 17A illustrating a back bottom perspective view, FIG. 17B illustrating a front top perspective view, FIG. 17C illustrating a view seen in the direction of arrow XVIIC of FIG. 17B, FIG. 17D illustrating a view seen in the direction of arrow XVIID of FIG. 17C, FIG. 17E illustrating a view seen in the direction of arrow XVIIE of FIG. 17C, FIG. 17F illustrating a view seen in the direction of arrow XVIIF of FIG. 17C, FIG. 17G illustrating a view seen in the direction of arrow XVIIG of FIG. 17C, and FIG. 17H illustrating a view seen in the direction of arrow XVIIH of FIG. 17G.

FIGS. 17A to 17H illustrate the outer shutter according to the first exemplary embodiment, FIG. 17A illustrating a back bottom perspective view, FIG. 17B illustrating a front top perspective view, FIG. 17C illustrating a view seen in the direction of arrow XVIIC of FIG. 17B, FIG. 17D illustrating a view seen in the direction of arrow XVIID of FIG. 17C, FIG. 17E illustrating a view seen in the direction of arrow XVIIE of FIG. 17C, FIG. 17F illustrating a view seen in the direction of arrow XVIIF of FIG. 17C, FIG. 17G illustrating a view seen in the direction of arrow XVIIG of FIG. 17C, and FIG. 17H illustrating a view seen in the direction of arrow XVIIH of FIG. 17G.

Referring to FIGS. 8 to 10, 16, and 17, an outer shutter 61 serving as an example of a second opening/closing member is supported outside the inner shutter 51 of the cartridge body 31. The outer shutter 61 according to the first exemplary embodiment includes a semicylindrical outer shutter body 61*a* serving as an example of a body of a second opening/closing member. The outer shutter body 61*a* extends along the bottom wall portion 31*a* of the cartridge body 31.

An outer opening/closing projection 62 serving as an example of an opening/closing contact portion of a second opening/closing member is formed so as to protrude outward from the outer surface of the outer shutter body 61*a*. The outer opening/closing projection 62 is configured to be fit into the opening/closing groove 3 formed in the holder body 2 and to be guided along the opening/closing groove 3. A front side portion 61*b* and a back side portion 61*c* is formed so as to extend upward from the front end and the back end of the outer shutter body 61*a*, respectively. A left side portion 61*d* extends upward from the left end of the outer shutter body 61*a*.

A front guide rail 63 serving as an example of a guided portion of a second opening/closing member and serving as an example of a restrained member for preventing removal is formed so as to extend backward from the upper end of the front side portion 61*b*. The front guide rail 63 is configured to be in contact with and is guided along the outer shutter front guide 41 and the upper surface of the outer shutter extension guide 54. The front guide rail 63 according to the first exemplary embodiment is formed so as to extend from the right end to a middle part of the front side portion 61*b*. The length of the front guide rail 63 in the left-right direction is smaller than the distance between the outer shutter right stopper 38 of the cartridge body 31 and the outer shutter front guide 41.

A back guide rail 64 serving as an example of a guided portion of a second opening/closing member is formed at the upper end of the back side portion 61*c*. The back guide rail 64 has an angular U-shape when seen from the right side, and is configured to be in contact with and guided by the upper surface of the outer shutter back guide 42. The front guide rail 63 and the back guide rail 64 constitute an outer guide rail 63+64 of the outer shutter 61 according to the first exemplary embodiment. Therefore, the outer shutter 61 is supported by the outer guide rail 63+64 so as to be movable between an outer shutter closed position serving as an example of a second closed position illustrated in FIG. 8 and an outer shutter open position serving as an example of a second open position illustrated in FIGS. 9 and 10. When the outer shutter 61 is at the outer shutter closed position, the connection hole 33*a* is doubly closed. When the outer shutter 61 is at the outer shutter open position, the connection hole 33*a* is opened and the inner shutter 51 is exposed to the outside.

The outer guide rail 63+64 of the first exemplary embodiment is supported with so-called backlash or play in the front-back direction with respect to the outer shutter front guide 41, the outer shutter back guide 42, and the outer shutter extension guide 54. Thus, outer guide rail 63+64 is supported so that backlash in the front-back direction and inclination are allowed and so that coming off from the cartridge body 31 is prevented.

Referring to FIGS. 16B and 17D, a pushing projection 66 serving as an example of a pushing portion is formed so as to project inward (i.e., backward) from a right end part of the inner surface of the front side portion 61*b*. The pushing projection 66 is disposed at a position corresponding to the pushed projection 56 of the inner shutter 51. When the outer shutter 61 moves toward the outer shutter closed position, the pushing projection 66 according to the first exemplary embodiment is capable of pushing the inner shutter 51 toward the inner shutter closed position by contacting the pushed projection 56 at a position upstream of the outer shutter closed position. When the outer shutter 61 is at the outer shutter closed position, the pushing projection 66 is at a position to the right of the pushed projection 56 and is separated from the pushed projection 56.

Referring to FIGS. 16A to 17D, an outer lock recess 67 serving as an example of an opening restrained portion is formed in a left back end part of the front guide rail 63. The outer lock recess 67 is formed at a position corresponding to the outer lock tab 34 so as to be recessed forward. The outer lock recess 67 according to the first exemplary embodiment has a size that allows the outer lock tab 34 to be held therein when the outer shutter 61 is at the outer shutter closed position. The right end surface 34*a* of the outer lock tab 34 engages with the outer lock recess 67 and thereby the outer shutter 61 is fixed, i.e., locked at the outer shutter closed position. An overhanging portion 67*a* is formed so as to protrude from the back end of the front guide rail 63 at a position to the right of the outer lock recess 67 according to the first exemplary embodiment, i.e., downstream in the closing direction of the outer shutter 61.

Referring to FIGS. 16A to 17H, a plate spring portion 68 serving as an example of an urging member is formed in a middle part of the back side portion 61*c* in the left-right direction at a position corresponding to the spring contact projection 43 of the cartridge body 31. The plate spring portion 68 according to the first exemplary embodiment includes a base end portion 68*a* at the left end, a plate spring body 68*b* extending rightward from the base end portion 68*a* and having a plate-like shape, and an inclined portion 68*c* that is inclined forward from the right end the plate spring body 68*b*.

An upstream contact portion 68*d* serving as an example of a first urging portion is formed at the front end of the inclined portion 68*c* according to the first exemplary embodiment. The upstream contact portion 68*d* is disposed at a position such that the upstream contact portion 68*d* contacts the spring contact projection 43 when the outer shutter 61 is located upstream of the outer shutter closed position in the closing direction of the outer shutter 61. A closing contact portion 68*e* serving as an example of a second urging portion is formed at the boundary between the inclined portion 68*c* and the plate spring body 68*b*. The closing contact portion 68*e* is disposed at a position such that the closing contact portion 68*e* contacts the spring contact projection 43 when the outer shutter 61 is in the outer shutter closed position.

Figure 18:
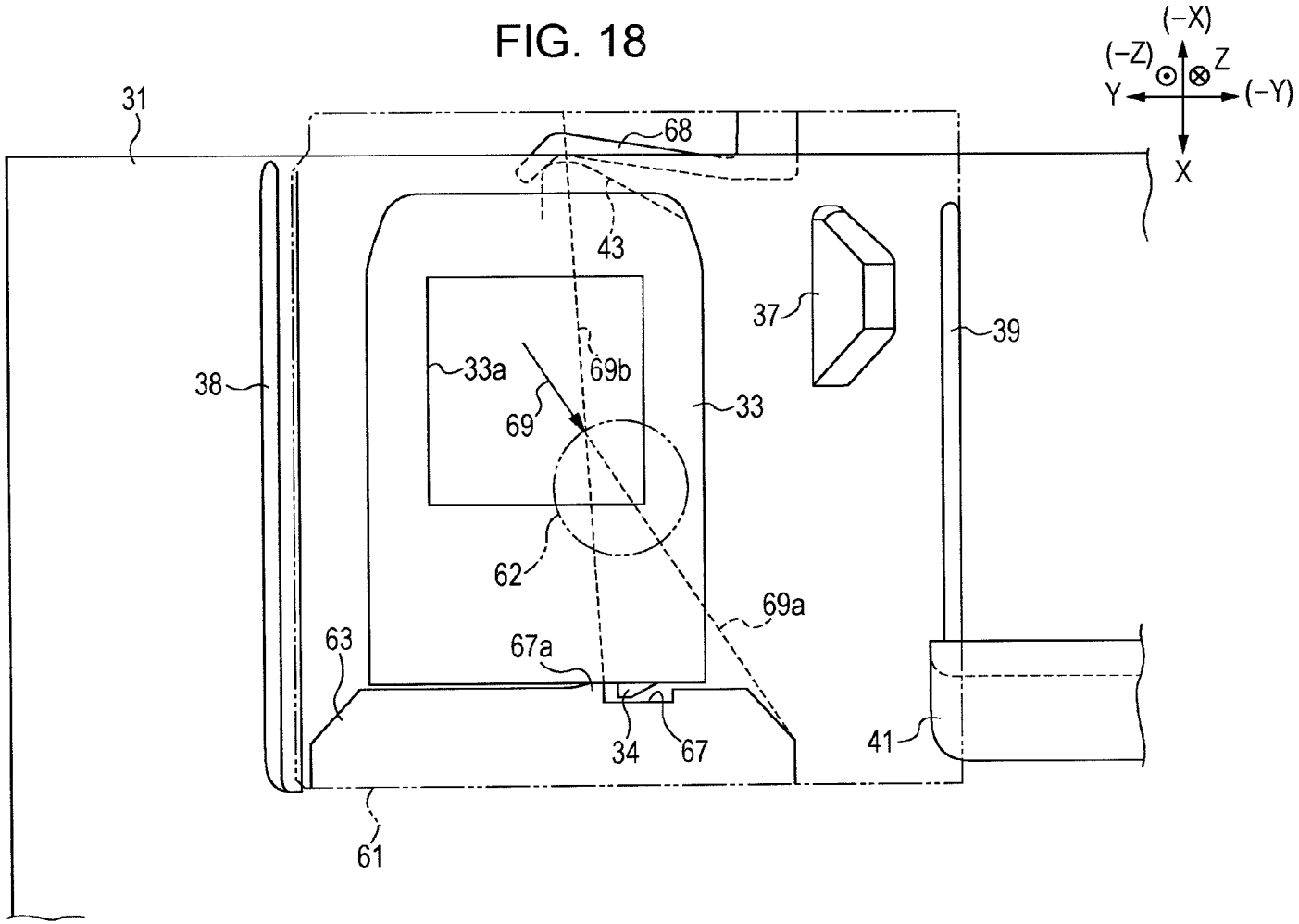
FIG. 18 illustrates the positional relationship among an outer opening/closing projection, a plate spring portion, and an outer lock recess of the outer shutter according to the first exemplary embodiment.

FIG. 18 illustrates the positional relationship among the outer opening/closing projection, the plate spring portion, and the outer lock recess of the outer shutter according to the first exemplary embodiment.

Referring to FIG. 18, in the outer shutter 61 according to the first exemplary embodiment, when the toner cartridge TC is inserted into the cartridge holder KH, an opening force 69, which is a reactive force from the spiral groove portion 3*b*, acts on the outer opening/closing projection 62 that contacts the spiral groove portion 3*b*. Due to the opening force 69, the outer shutter 61 slides rightward of FIG. 18 to a position at which the outer lock tab 34 engages with the outer lock recess 67 to lock the outer shutter 61. The outer shutter 61 according to the first exemplary embodiment is allowed to be inclined due to backlash of the outer guide rail 63+64. When the opening force 69 acts on outer opening/closing projection 62, a force oriented in the clockwise direction acts on the outer shutter 61 around a contact position at which the outer lock tab 34 contacts the outer lock recess 67 as described in FIG. 23A. The outer lock recess 67 according to the first exemplary embodiment is disposed at a position that is downstream of an imaginary line 69*a* extending in the direction of the opening force 69, i.e., downstream in the clockwise direction of FIG. 18. In the first exemplary embodiment, the contact portion at which the plate spring portion 68 contacts the spring contact projection 43 is located at a position that is upstream, with respect to the clockwise direction in FIG. 18, of an imaginary line 69*b* extending through the contact position at which the outer lock recess 67 contacts the outer lock tab 34 and the point of application at which the opening force 69 acts on the outer opening/closing projection 62 so as not to prevent the outer shutter 61 from being inclined.

Operation of First Exemplary Embodiment

In the printer U according to the first exemplary embodiment having the above-described structure, the developing device G develops a latent image formed on the surface of the photoreceptor PR in the developing region Q3, and the developer in the developing device G is consumed. As a developer in the developing device G is consumed, the supply auger V4 and the conveyer in the toner cartridge TC are driven in accordance with the consumed amount, and the developer is supplied from the toner cartridge TC.

When the developer in the toner cartridge TC has been depleted or the toner cartridge TC causes from a fault, the toner cartridge TC is pulled out from the printer body U1 in the front-back direction and replaced with a new toner cartridge TC.

Description of Installation of Cartridge

Figure 19A:
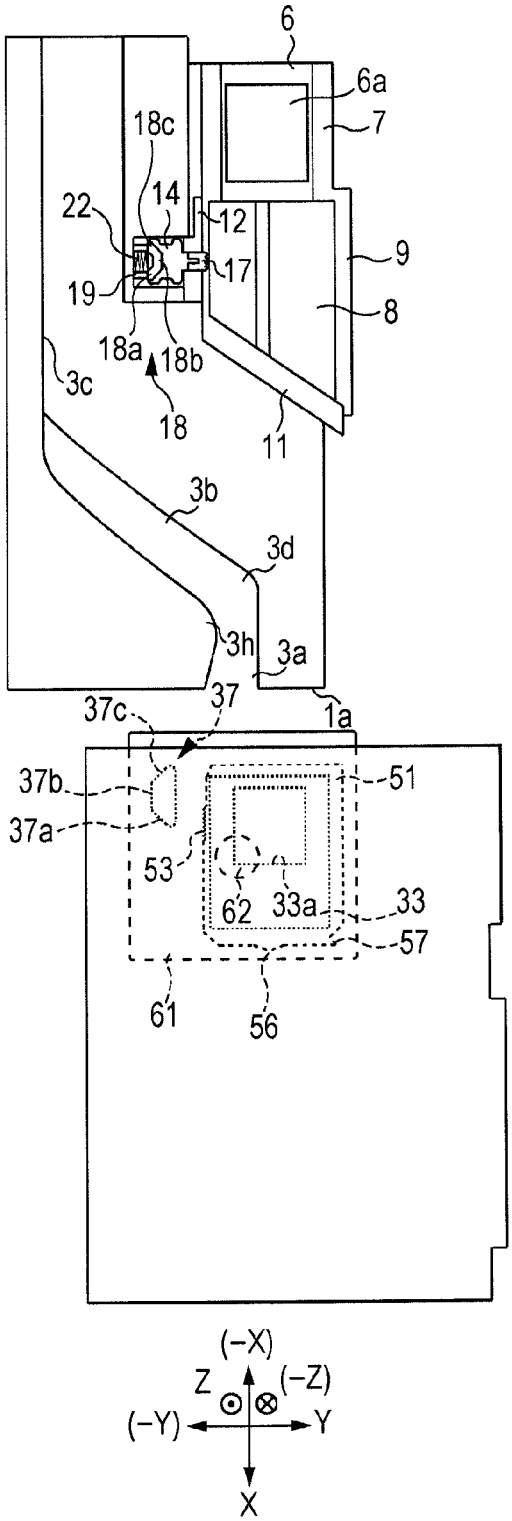
FIGS. 19A and 19B illustrate steps of installing the toner cartridge according to the first exemplary embodiment, FIG. 19A illustrating a state before the toner cartridge is inserted into the cartridge holder, and FIG. 19B illustrating a state in which the toner cartridge has been inserted from the state illustrated in FIG. 19A backward into the cartridge holder and the outer opening/closing projection has reached a front end of a spiral groove.
Figure 19B:
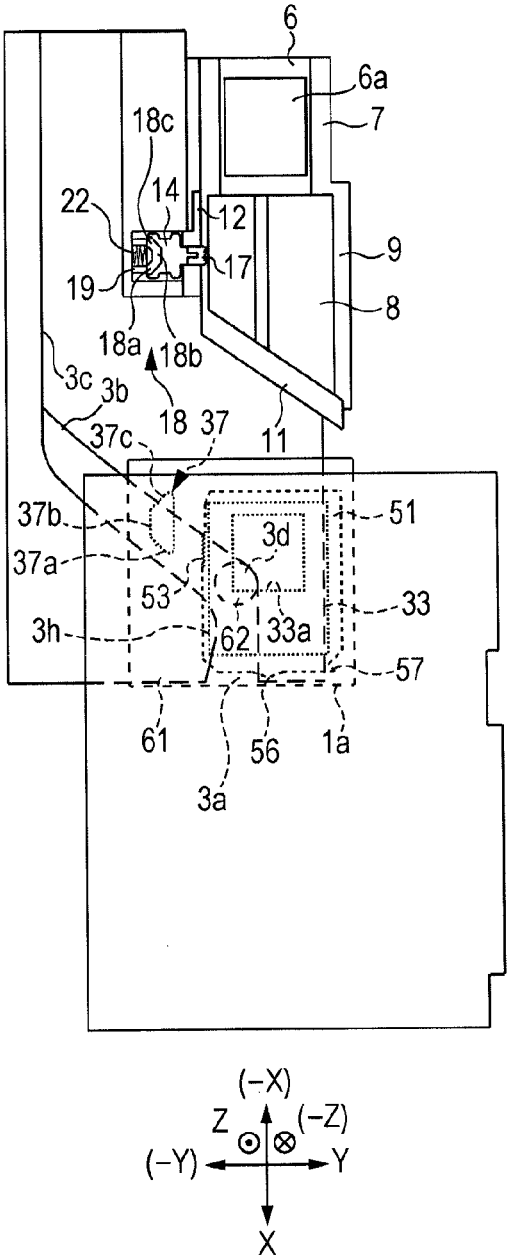

FIGS. 19A and 19B illustrate steps of installing the toner cartridge according to the first exemplary embodiment, FIG. 19A illustrating a state before the toner cartridge is inserted into the cartridge holder, and FIG. 19B illustrating a state in which the toner cartridge has been inserted from the state illustrated in FIG. 19A backward into the cartridge holder and the outer opening/closing projection has reached a front end of a spiral groove.

Referring to FIGS. 19A and 19B, when the toner cartridge TC is inserted into the cartridge holder KH from the front side, the outer opening/closing projection 62 of the outer shutter is fitted into the opening/closing groove 3, and as the toner cartridge TC is moved backward, the outer opening/closing projection 62 moves backward along the front groove portion 3*a* of the opening/closing groove 3. As illustrated in FIG. 19B, as the toner cartridge TC moves backward, the outer opening/closing projection 62 passes the front groove portion 3*a* and contacts the spiral groove portion 3*b*.

Figure 20A:
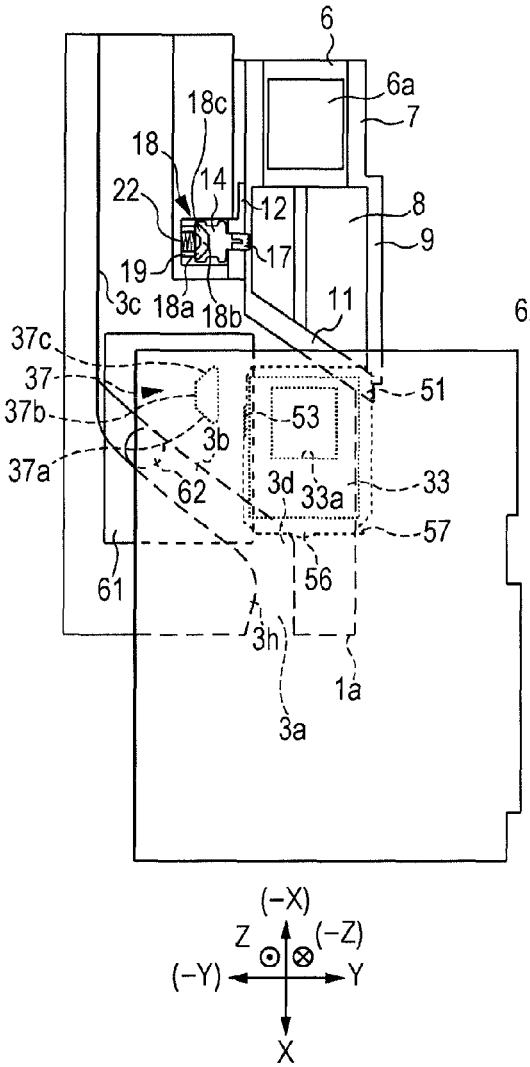
FIGS. 20A and 20B illustrate the following steps of installing the toner cartridge, FIG. 20A illustrating a state in which the toner cartridge is further inserted backward from the state illustrated in FIG. 19B and the outer shutter is partly opened, and FIG. 20B illustrating a state in which the toner cartridge is further inserted backward from the state illustrated in FIG. 20A and the lock release projection contacts the front side of the slider projection.
Figure 20B:
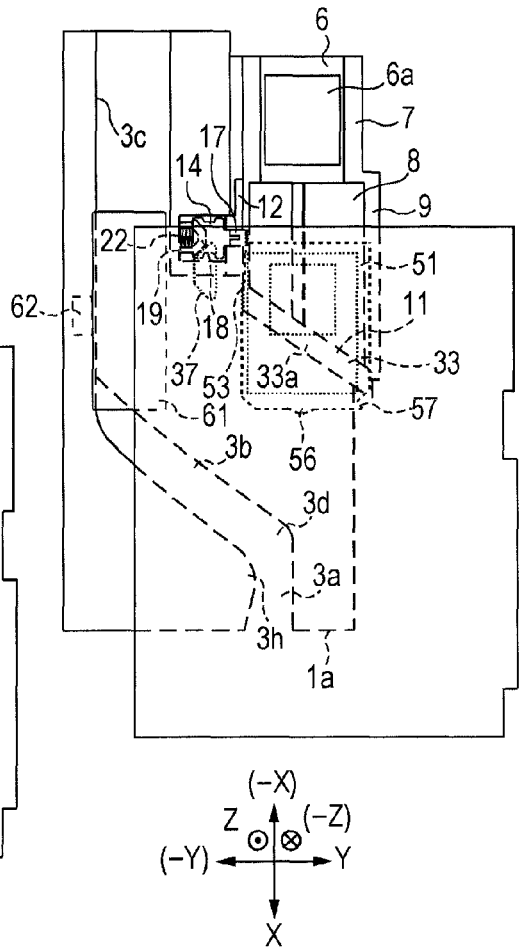

FIGS. 20A and 20B illustrate the following steps of installing the toner cartridge, FIG. 20A illustrating a state in which the toner cartridge is further inserted backward from the state illustrated in FIG. 19B and the outer shutter is partly opened, and FIG. 20B illustrating a state in which the toner cartridge is further inserted backward from the state illustrated in FIG. 20A and the lock release projection contacts the front side of the slider projection.

When the toner cartridge TC is further inserted backward from the state illustrated in FIG. 19B, the outer opening/closing projection 62 is guided leftward along the spiral groove portion 3*b*. As illustrated in FIG. 20A, as the outer opening/closing projection 62 moves leftward, the outer shutter 61 moves leftward along the outer peripheral surface of the cartridge body 31. Thus, the outer shutter 61 moves from the outer shutter closed position toward the outer shutter open position.

When the toner cartridge TC is further inserted backward from the state illustrated in FIG. 20A, the back end of the inner shutter 51, which is exposed downward, contacts the inclined surface 11 and is guided along the inclined surface 11 toward the inner shutter holding portion 8. The inclined surface 11 according to the first exemplary embodiment does not extend in the left-right direction along the back end surface of the inner shutter 51 and is inclined with respect to the left-right direction, so that the back end of the inner shutter 51 does not surface-contact the inclined surface 11 but gradually contacts the right end toward the left end of the inclined surface 11 as the toner cartridge TC is inserted. Therefore, the impact of contact between the inner shutter 51 and the inclined surface 11 is reduced, and a sharp increase in the force needed to insert the toner cartridge TC is suppressed.

In the first exemplary embodiment, the inclination of the inclined surface 11 corresponds to the inclination of the spiral groove portion 3*b*, so that a reactive force that the outer shutter 61 receives from the holder body 2 when the outer shutter 61 is opened and a reactive force that the inner shutter 51 receives when the inner shutter 51 contacts the inclined surface 11 are both oriented in the left forward direction, and the toner cartridge TC receives a force to push the toner cartridge TC leftward. Therefore, when the toner cartridge TC has been installed, the CRUM 46 reliably contacts the CRUM reader 4 that is disposed at a position to the left of the CRUM 46.

In the first exemplary embodiment, a front part of the inclined surface 11 in the front-back direction has the overlapping region 11*a* that overlaps a back part of the spiral groove portion 3*b* in the front-back direction. As compared to the case where the overlapping region 11*a* is not provided, the lengths of in the front-back direction of the cartridge holder KH and the toner cartridge TC having two shutters 51 and 61 are reduced.

When inserting the toner cartridge TC backward from the state illustrated in FIG. 20A, if the position of the inner shutter 51 in the left-right direction relative to the inner shutter holding portion 8 is displaced or the orientation of the inner shutter 51 is inclined due to backlash with respect to the connection hole portion 33 or the like, the right surface of the inner shutter 51 contacts the backlash reducing wall 9 and thereby the orientation of the inner shutter 51 is corrected. Therefore, as compared with the case where the backlash reducing wall 9 is not provided, misalignment that may be caused by insufficient engagement between the inner shutter 51 and the inner shutter lock 14 or the like is reduced.

Referring to FIGS. 20A and 20B, when the toner cartridge TC is inserted backward from the state FIG. 20A, the outer opening/closing projection 62 reaches the back groove portion 3*c* as illustrated in FIG. 20B, and the outer shutter 61 moves to the open position. At this time, the inner shutter 51 moves backward in the inner shutter holding portion 8 while contacting the guide rib 8*a*. Thus, as compared with the case where the guide rib 8*a* is not provided, friction is reduced and the toner cartridge TC is inserted without causing a sharp increase in the force for inserting the toner cartridge TC. Before the connection hole portion 33 contacts the inner shutter stopper surface 6*b* of the supply port portion 6, the back guided surface 37*c* of the lock release projection 37 contacts the front guide surface 18*a* of the slider projection 18 of the inner shutter lock 14.

Figure 21A:
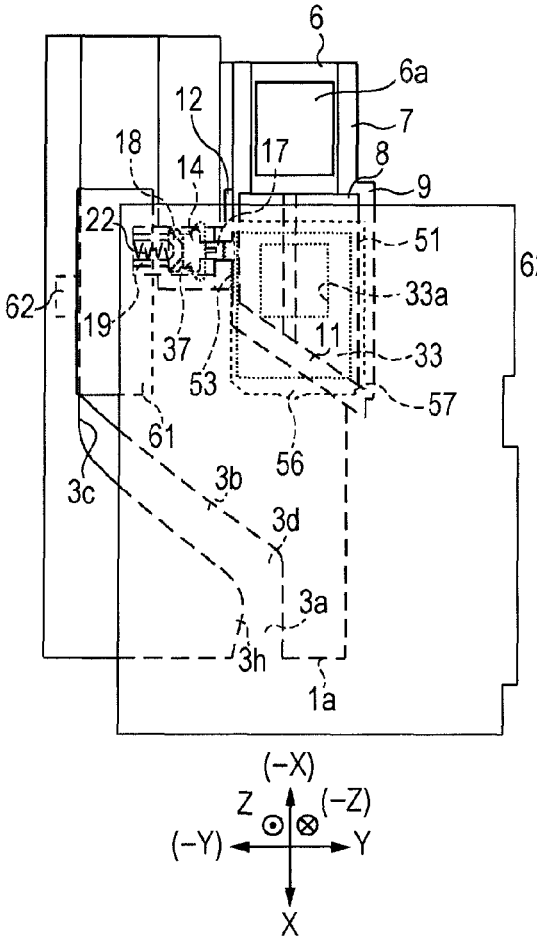
FIGS. 21A to 21D illustrate the following steps of installing the toner cartridge, FIG. 21A illustrating a state in which the toner cartridge is further inserted backward from the state illustrated in FIG. 20B and the lock release projection pushes the slider projection leftward, FIG. 21B illustrating an enlarged view of the inner shutter lock of FIG. 21A, FIG. 21C illustrating a state in which the toner cartridge is further inserted backward from the state illustrated in FIG. 21A and the inner shutter lock is located between the locked position and the unlocked position, and FIG. 21D illustrating an enlarged view of the inner shutter lock of FIG. 21C.
Figure 21C:
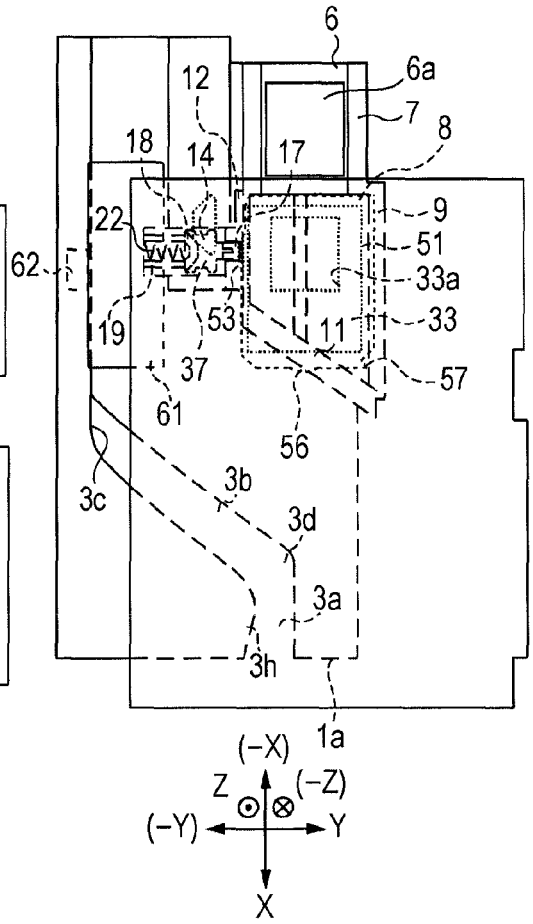
Figure 21B:
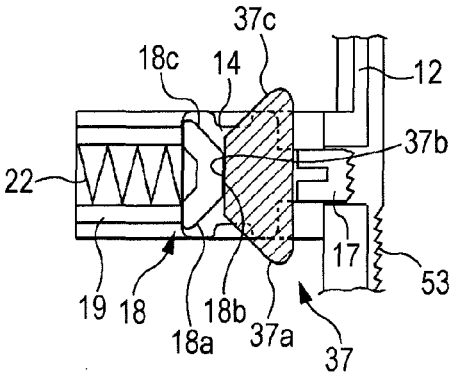
Figure 21D:
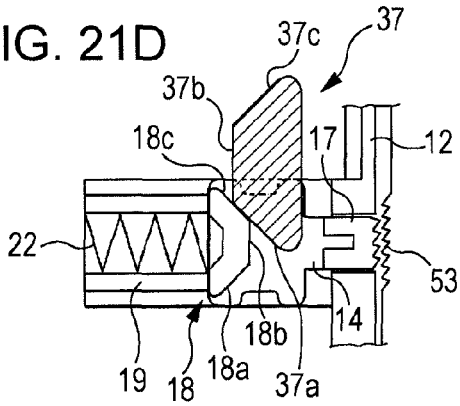

FIGS. 21A to 21D illustrate the following steps of installing the toner cartridge, FIG. 21A illustrating a state in which the toner cartridge is further inserted backward from the state illustrated in FIG. 20B and the lock release projection pushes the slider projection leftward, FIG. 21B illustrating an enlarged view of the inner shutter lock of FIG. 21A, FIG. 21C illustrating a state in which the toner cartridge is further inserted backward from the state illustrated in FIG. 21A and the inner shutter lock is located between the locked position and the unlocked position, and FIG. 21D illustrating an enlarged view of the inner shutter lock of FIG. 21C.

When the toner cartridge TC is further inserted backward from the state illustrated in FIG. 20B, the lock release projection 37 moves backward, and the inner shutter lock 14 moves leftward against the elastic force of the coil spring 22 as the back guided surface 37*c* and the front guide surface 18*a* contact each other. Therefore, the middle guide surface 18*b* and the middle guided surface 37*b* contact each other as illustrated in FIGS. 21A and 21B, the inner shutter lock 14 moves to the unlocked position, and the lock body 17 moves away from the inner shutter holding portion 8.

When the toner cartridge TC is inserted backward from the state illustrated in FIGS. 21A and 21B, as illustrated in FIGS. 21C and 21D, the back end of the connection hole portion 33 of the toner cartridge TC contacts the inner shutter stopper surface 6*b*, and the inner shutter 51 becomes held in the inner shutter holding portion 8. In this state, the front guided surface 37*a* of the lock release projection 37 is in contact with the back guide surface 18*c* of the slider projection 18, and the lock body 17 is a state of moving from the unlocked position toward the locked position.

Figure 22A:
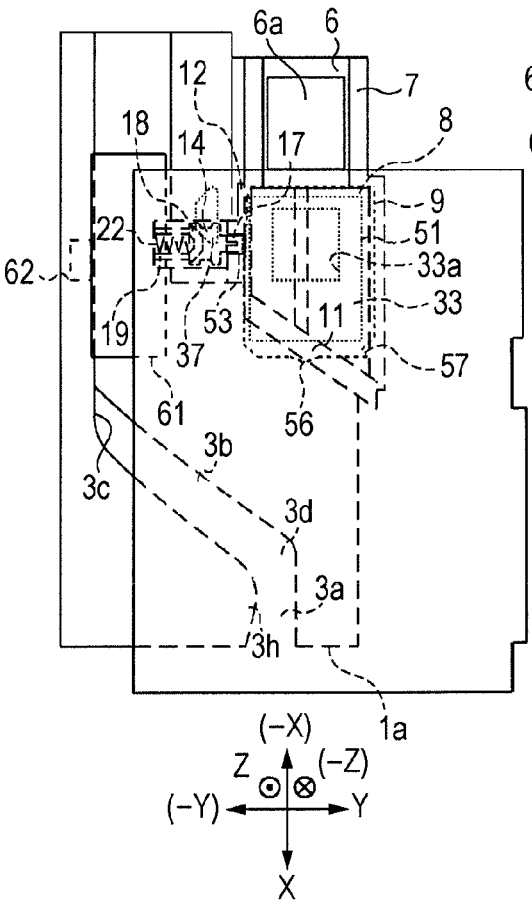
FIGS. 22A to 22D illustrate the following steps of installing the toner cartridge, FIG. 22A illustrating a state in which the toner cartridge is further inserted backward from the state illustrated in FIG. 21C and the lock release projection has moved to a position behind of the slider projection, FIG. 22B illustrating an enlarged view of the inner shutter lock of FIG. 22A, FIG. 22C illustrating a state in which the toner cartridge has been further inserted backward from the state illustrated in FIG. 22A and the installation has been finished, and FIG. 22D illustrating an enlarged view of the inner shutter lock of FIG. 22C.
Figure 22C:
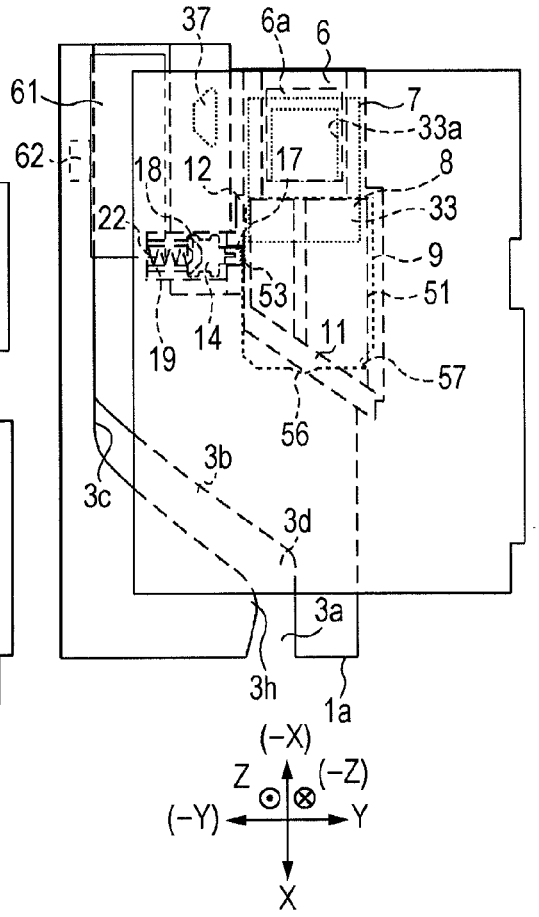
Figure 22B:
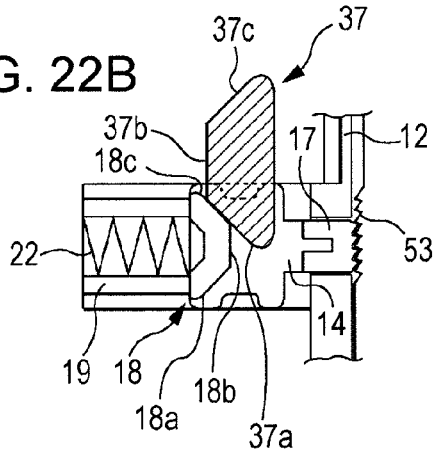
Figure 22D:
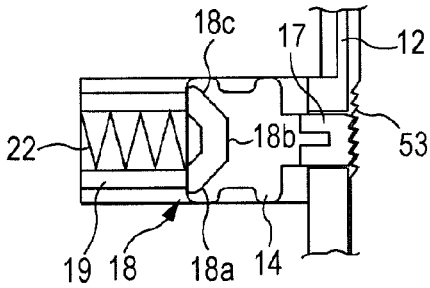

FIGS. 22A to 22D illustrate the following steps of installing the toner cartridge, FIG. 22A illustrating a state in which the toner cartridge is further inserted backward from the state illustrated in FIG. 21C and the lock release projection has moved to a position behind the slider projection, FIG. 22B illustrating an enlarged view of the inner shutter lock of FIG. 22A, FIG. 22C illustrating a state in which the toner cartridge has been further inserted backward from the state illustrated in FIG. 22A and the installation has been finished, and FIG. 22D illustrating an enlarged view of the inner shutter lock of FIG. 22C.

When the toner cartridge is further inserted backward from the state illustrated in FIGS. 21C and 21D, the lock release projection 37 moves to a position behind the back guide surface 18*c* of the slider projection 18 as illustrated in FIGS. 22A and 22B, and the inner shutter lock 14 moves to the locked position. When the inner shutter lock 14 has moved to the locked position, the lock body 17 engages with the inner shutter locked portion 53, and the inner shutter 51 is fixed in the front-back direction, i.e., locked.

In the first exemplary embodiment, as illustrated in FIG. 7C, the lock body 17 and the inner shutter locked portion 53 are configured such that the back surfaces 17*d* of the protrusions 17*b* are inclined in the left forward direction and the front surfaces 53*d* of the protrusions 53*a* are inclined in the left forward direction. Therefore, even if the lock body 17 has not been retracted to the unlocked position before the inner shutter locked portion 53 reaches the lock body 17 or even if the lock body 17 has returned to the locked position before the back end of the inner shutter 51 reaches the inner shutter stopper surface 6*b* due to a manufacturing error or an assembly error of the lock release projection 37 or the slider projection 18, the front surfaces 53*d* of the protrusions 53*a* applies a force to the back surfaces 17*d* of the protrusions 17*b* of the lock body 17 in the left forward direction as the toner cartridge TC is inserted, whereby a leftward component of the force acts on the lock body 17. Thus, the inner shutter lock 14 moves leftward to the unlocked position, and the protrusions 53*a* are allowed to move forward by passing over the protrusions 17*b* of the inner shutter lock 14.

When the toner cartridge TC moves backward from the state illustrated in FIGS. 22A and 22B, the inner shutter 51 contacts the inner shutter stopper surface 6*b* and the inner shutter lock 14 is locked, the movement of the inner shutter 51 is stopped, and the connection hole portion 33 moves backward while being guided by the holder-side guides 7 of the supply port portion 6. That is, the inner shutter 51 moves relative to the connection hole 33*a*, and the inner shutter 51 moves from the inner shutter closed position to the inner shutter open position.

When the toner cartridge TC has moved to the back end of the cartridge holder KH, as illustrated in FIG. 22C, the inner shutter 51 moves to the inner shutter open position, the connection hole 33*a* and the supply port 6*a* are connected to each other, and the installation of the toner cartridge TC is finished. Accordingly, the toner cartridge TC becomes ready to supply developer into the printer body U1.

With toner cartridge TC according to the first exemplary embodiment, by performing one operation of inserting the toner cartridge TC backward, both the outer shutter 61 and the inner shutter 51 are opened and the connection hole 33*a* and the supply port 6*a* are connected to each other. Therefore, as compared with existing structures that require two operations of inserting a toner cartridge an then opening a shutter, insertion of the toner cartridge is simplified.

With the toner cartridge TC according to the first exemplary embodiment, the inner shutter 51 guides the outer shutter 61 when opening and closing the outer shutter 61. If the inner shutter 51 does not guide the outer shutter 61, the operation of opening/closing the outer shutter 61 may become unstable. If a guide member for guiding the outer shutter 61 is provided not to the inner shutter 51 but to the cartridge body 31, the guide member may hinder the operation of opening and closing the inner shutter 51, whereby the two shutters 51 and 61 may not be used or the guide member may make the structure of the toner cartridge TC complex. In contrast, with the first exemplary embodiment, the extension guide 54 of the inner shutter 51 guides the outer shutter 61, so that the movement of the outer shutter 61 is stabilized, the inner shutter 51 and the extension guide 54 are integrated, whereby the structure of the toner cartridge TC is simplified and a guide member that may hinder the operation of opening and closing the inner shutter 51 is not necessary.

Description of Removal of Cartridge

When removing the toner cartridge TC after a developer in the toner cartridge TC has been depleted, the toner cartridge TC is pulled out from the state illustrated in FIG. 22C. At this time, the inner shutter lock 14 is locking the inner shutter 51, thereby restraining backward movement of the inner shutter 51. Therefore, if, for example, the downstream end of the shutter in the pull-out direction is clamped, a gap extending in the direction in which the shutter is extracted is inevitably generated between the clamped portion and the shutter due to a manufacturing error or the like. In this case, when pulling out the toner cartridge, the shutter may be displaced in the downstream direction, so that a gap may appear between the shutter and the supply port portion and the developer may leak from the gap.

In contrast, with the first exemplary embodiment, movement of the inner shutter 51 in a lateral direction with respect to the front-back direction in which the toner cartridge TC is removed is restrained, so that a gap in the front-back direction of the inner shutter 51 does not appear. Therefore, when pulling out the toner cartridge TC, the inner shutter 51 is not easily separated from the inner shutter stopper surface 6*b*, and a gap does not easily appear between the inner shutter 51 and the inner shutter stopper surface 6*b*. Thus, when the connection hole portion 33 passes a space above the inner shutter 51 and the inner shutter stopper surface 6*b*, a developer is prevented from flowing downward through the connection hole 33*a* and accumulated in such a gap. Thus, the inner shutter 51 is prevented from being smeared with overflowed developer, and smearing of the cartridge holder KH and the toner cartridge TC is suppressed. Moreover, an operator and a floor on which the printer U is placed are prevented from being smeared.

In particular, as illustrated in FIG. 7C, in the lock body 17 and the inner shutter locked portion 53 according to the first exemplary embodiment, the front surfaces 17*d* of the protrusions 17*b* are inclined in the right forward direction and the back surfaces 53*c* of the protrusions 53*a* are inclined in the left backward direction. Therefore, as the toner cartridge TC is pulled out forward, the back surfaces 53*c* of the protrusions 53*a* apply a force to the front surfaces 17*c* of the protrusions 17*b* of the lock body 17 in the right backward direction, whereby a rightward component of the force acts on the lock body 17. Thus, the inner shutter lock 14 receives a force to move the inner shutter lock 14 further rightward, and a force that may push the inner shutter lock 14 toward the unlocked position does not act on the inner shutter lock 14. Therefore, even if a force that may move the inner shutter 51 forward is generated by friction when the toner cartridge TC moves forward, a force is applied in a direction such that the inner shutter lock 14 and the inner shutter locked portion 53 become engaged with each other, whereby locking of the inner shutter 51 is not released and backward movement of the inner shutter 51 is restrained.

In the first exemplary embodiment, the lock side wall 12 is disposed on the front and back sides of the lock body 17. Therefore, even if a backward force is applied to the lock body 17, the lock side wall 12 contacts the lock body 17 and restrains the lock body 17 from being inclined or collapsed. Therefore, as compared with the case where the lock side wall 12 is not provided, backward movement of the inner shutter 51 is further reliably restrained.

Referring to FIG. 22A, when the toner cartridge TC has been pulled out from the state illustrated in FIG. 22A to the state illustrated in FIG. 22C, the inner shutter 51 moves relative to the connection hole 33*a*, and the inner shutter 51 closes the connection hole 33*a*. In this state, the front guided surface 37*a* of the lock release projection 37 has moved to the back of the back guide surface 18*c* of the slider projection 18, and the inner shutter lock 14 is held at the locked position.

When the toner cartridge TC has been pulled out from the state illustrated in FIG. 22A to the state illustrated in FIG. 21C, the lock release projection 37 contacts the slider projection 18 of the inner shutter lock 14, and the inner shutter lock 14 starts moving toward the unlocked position. Thus, the inner shutter lock 14 becomes separated from the inner shutter 51, and the inner shutter 51 is unlocked. Accordingly, the inner shutter 51 becomes ready to move forward, and as the toner cartridge TC is pulled out forward, the inner shutter 51 is integrally moved forward as illustrated in FIGS. 21A and 20B.

When the toner cartridge TC is pulled out from the state illustrated in FIG. 20B, the outer opening/closing projection 62, which has been guided by the back groove portion 3*c*, passes the spiral groove portion 3*b* as illustrated in FIG. 20A, and the outer shutter 61 moves rightward along the cartridge body 31, i.e., toward the outer shutter closed position.

When the toner cartridge TC is further pulled out from the state illustrated in FIG. 20A, the outer opening/closing projection 62 moves along the spiral groove portion 3*b*, and the outer shutter 61 closes the outside of the inner shutter 51 and moves toward the outer shutter closed position as illustrated in FIG. 19B. At this time, in the first exemplary embodiment, the cartridge holder KH includes the protuberance 3*h* protruding rightward at the front end of the spiral groove portion 3*b*, so that the outer opening/closing projection 62 is pressed rightward, i.e., toward the outer shutter closed position. Therefore, as compared with the case where the protuberance 3*h* is not provided, the outer shutter 61 is easily moved toward the outer shutter closed position, and the possibility of the occurrence of half-open state, which is a state in which the outer shutter 61 is not properly moved to the outer shutter closed position, is reduced.

When the toner cartridge TC has been further pulled from the state in FIG. 19B, the toner cartridge TC is removed from the printer body U1 as illustrated in FIG. 19A. Thus, with the first exemplary embodiment, by performing one operation of pulling out the toner cartridge TC forward, both the outer shutter 61 and the inner shutter 51 are closed in this order and the connection hole 33*a* is closed. Therefore, as compared a structure that requires two operations, pulling out of the toner cartridge is simplified.

Moreover, in the toner cartridge TC according to the first exemplary embodiment, the opening/closing direction of the inner shutter 51 intersects the opening/closing direction of the outer shutter 61. When the opening/closing direction of the two shutters are the same, it is necessary to move the outer shutter in a range that is larger than the range in which the inner shutter is moved, so that the movement distance of the outer shutter becomes large, which may raise a problem in that the size of the toner cartridge TC is increased. In the first exemplary embodiment, the two shutters 51 and 61 move in directions that intersect each other, whereby the size of the toner cartridge TC may be reduced.

Description of Movement when Opening Outer Shutter

Figure 23A:
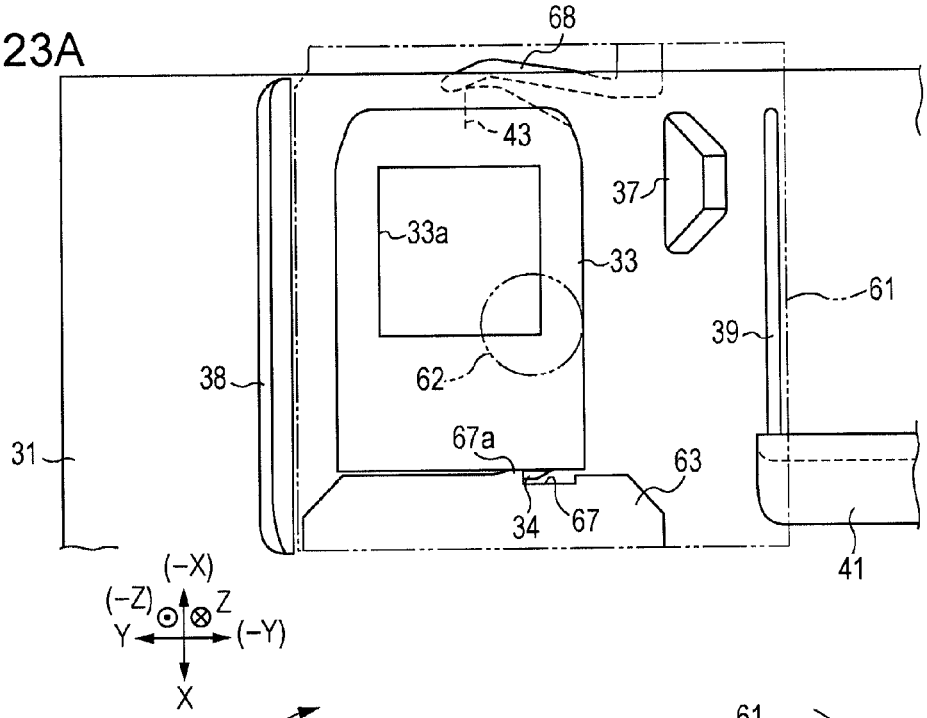
FIGS. 23A and 23B illustrate the outer shutter according to the first exemplary embodiment, FIG. 23A illustrating a state in which the outer shutter has moved from the state illustrated in FIG. 18 toward the outer shutter open position, and FIG. 23B illustrating a state in which the outer shutter is inclined from the state illustrated in FIG. 23A, and FIG. 23C illustrating the plate spring portion before and after being inclined.
Figure 23B:
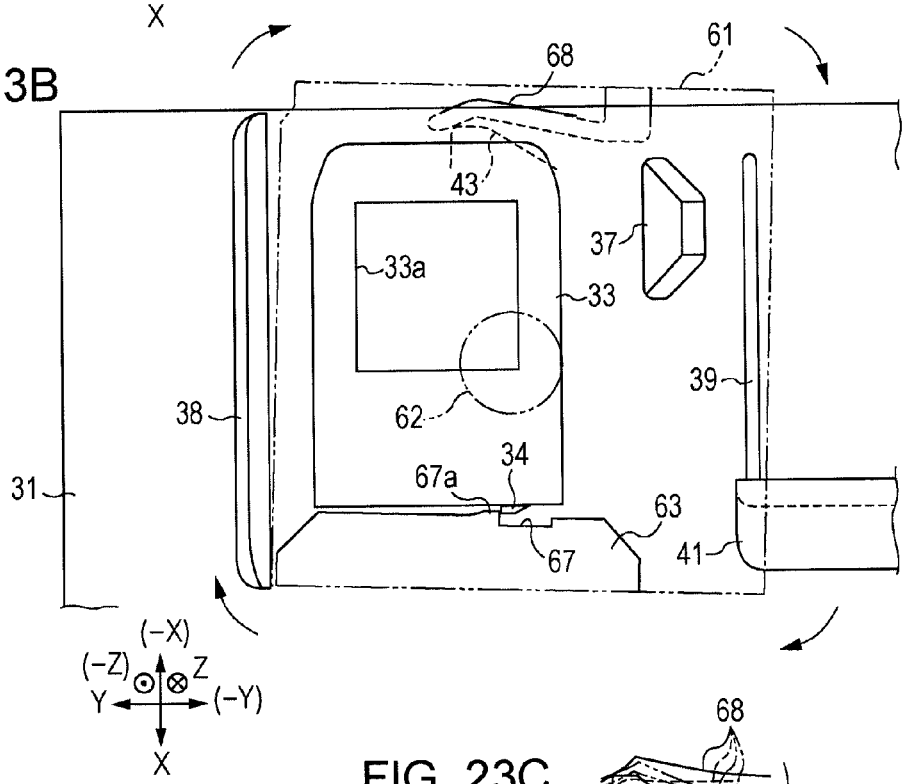
Figure 23C:
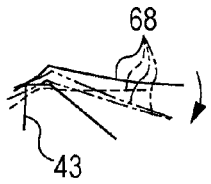

FIGS. 23A and 23B illustrate the outer shutter according to the first exemplary embodiment, FIG. 23A illustrating a state in which the outer shutter has moved from the state illustrated in FIG. 18 toward the outer shutter open position, and FIG. 23B illustrating a state in which the outer shutter is inclined from the state illustrated in FIG. 23A, and FIG. 23C illustrating the plate spring portion before and after being inclined.

When the toner cartridge TC according to the first exemplary embodiment is removed from the printer body U1, as illustrated in FIG. 18, the plate spring portion 68 is elastically deformed by being pushed by the spring contact projection 43, and the outer shutter 61 is urged backward. Therefore, the outer lock tab 34 engages with the outer lock recess 67 of the outer shutter 61. Therefore, if an external force that may move the outer shutter 61 leftward toward the outer shutter open position acts on the outer shutter 61 when, for example, an operator or the like touches the outer shutter 61, the outer lock recess 67 and the right end surface 34*a* of the outer lock tab 34 contact each other, so that rotation of the outer shutter 61 is restrained as illustrated in FIG. 23A.

When the toner cartridge TC is inserted into the cartridge holder KH and the outer opening/closing projection 62 of the outer shutter 61 contacts the spiral groove portion 3*b*, the opening force 69 oriented in the left forward direction is applied to the outer opening/closing projection 62 as illustrated in FIG. 18. A forward component of the opening force 69 is cancelled out by a force generated by the plate spring portion 68, which urges the outer shutter 61 backward. Therefore, a leftward component of the opening force 69 acts on the outer shutter 61, and the outer shutter 61 is moved toward the outer shutter open position until the outer lock recess 67 and the right end surface 34*a* of the outer lock tab 34 contact each other as illustrated in FIG. 23A. That is, backlash is reduced until the outer shutter 61 contacts the outer lock tab 34.

When the outer shutter 61 has moved to the position illustrated in FIG. 23A, as described above, movement of the outer shutter 61 is restrained due to contact between the outer lock recess 67 and the outer lock tab 34. Referring to FIGS. 18 and 23A, in the first exemplary embodiment, a contact point at which the outer lock recess 67 contacts the outer lock tab 34 is located downstream of the extension line 69*a* of the opening force 69 with respect to the clockwise direction. When the opening force 69 is generated in the state illustrated in FIG. 23A, the outer shutter 61 receives a force that rotates the outer shutter 61 around the contact point between the outer lock recess 67 and the outer lock tab 34. Therefore, the outer shutter 61 becomes inclined clockwise in FIGS. 18 and 23B while the outer lock recess 67 remains in contact with the outer lock tab 34. As illustrated in FIG. 23B, the outer shutter 61 becomes inclined until the left end of the back guide rail 64 of the outer shutter 61 contacts the outer shutter back guide 42. In the state illustrated in FIG. 23B, as the outer shutter 61 becomes inclined, the outer lock recess 67 is moved in the right forward direction, i.e., in a direction away from the outer lock tab 34, and engagement between the outer lock recess 67 and the outer lock tab 34 becomes loose.

Referring to FIG. 23B, as the outer shutter 61 becomes inclined, the base end portion 68*a* of the plate spring portion 68 also becomes inclined and is moved forward. Referring to FIG. 23C, a solid line illustrates the plate spring portion 68 before the outer shutter 61 is inclined, and a two-dot chain line illustrates the plate spring portion 68 after the outer shutter 61 has been inclined. That is, with respect to the state in which the plate spring portion 68 is not elastically deformed, which is illustrated with a broken line and a dotted-chain line in FIG. 23C, the amount of elastic deformation of the plate spring portion 68 before the outer shutter 61 is inclined is smaller than the amount of elastic deformation of the plate spring portion 68 after the outer shutter 61 has been inclined. Therefore, in the state illustrated in FIG. 23B, a force generated by the plate spring portion 68 to urge the outer shutter 61 backward is smaller than the force in the state illustrated in FIG. 23A.

In the state illustrated in FIG. 23B, when the opening force 69 acts on the outer shutter 61, the outer shutter 61, which is restrained from being moved leftward and from being inclined, counteracts the urging force of the plate spring portion 68 and moves forward due to the forward component of the force. At this time, in the first exemplary embodiment, as described above, an urging force generated by the plate spring portion 68 to urge the outer shutter 61 backward is reduced, so that a force needed to move the outer shutter 61 forward is smaller than that when the urging force is not reduced. Therefore, when inserting the toner cartridge TC, a load and an insertion resistance applied to the operator is reduced.

At this time, in the first exemplary embodiment, as illustrated in FIG. 23B, the degree of engagement between the outer lock recess 67 and the outer lock tab 34 is decreased as the outer shutter 61 becomes inclined, so that the outer lock recess 67 may be disengaged from the outer lock tab 34 with a small forward movement of the outer shutter 61. That is, the deformation amount of the plate spring portion 68 when the outer shutter 61 moves forward is reduced, whereby a load and an insertion resistance applied to an operator is reduced.

Figure 24A:
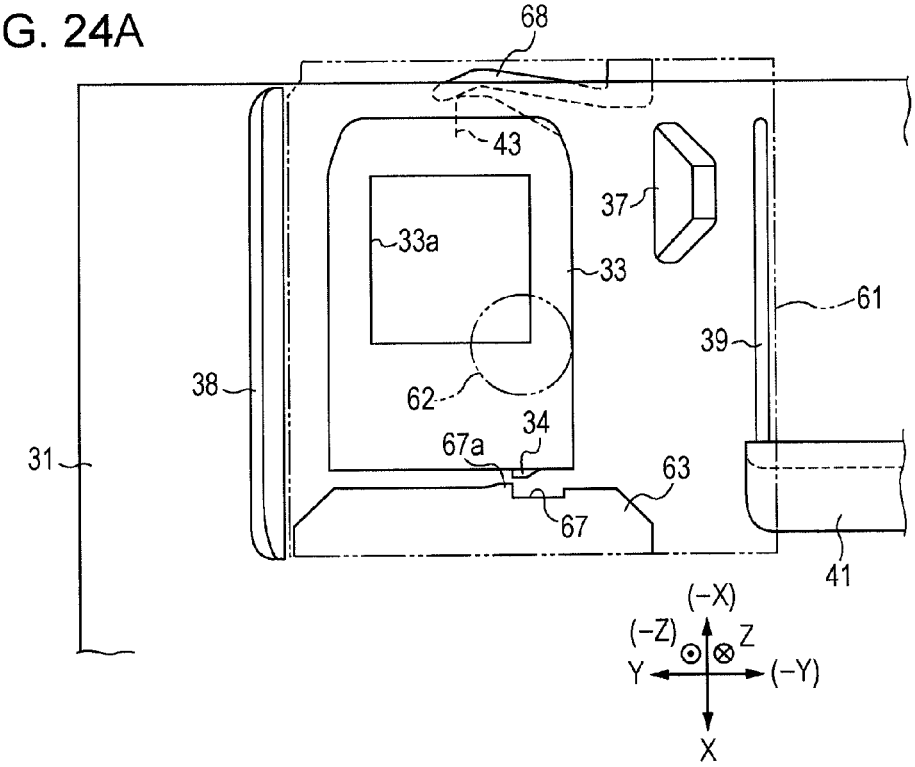
FIGS. 24A and 24B illustrate the outer shutter according to the first exemplary embodiment, FIG. 24A illustrating a state in which the outer shutter is unlocked from the state illustrated in FIG. 23B, and FIG. 24B illustrating a state in which the outer shutter has moved toward the outer shutter open position from the state illustrated in FIG. 24A.
Figure 24B:
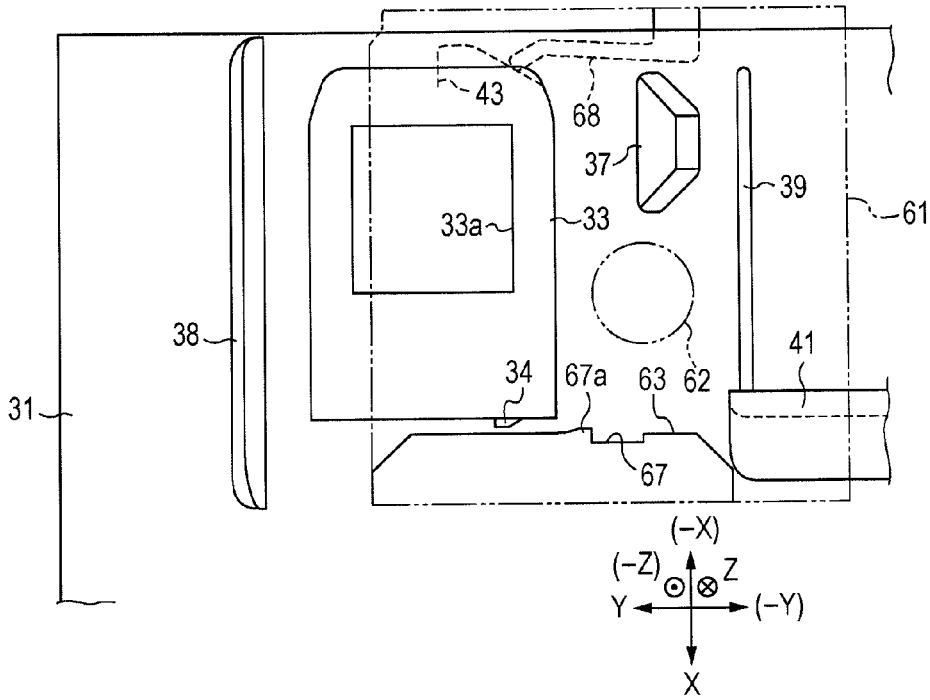

FIGS. 24A and 24B illustrate the outer shutter according to the first exemplary embodiment, FIG. 24A illustrating a state in which the outer shutter is unlocked from the state illustrated in FIG. 23B, and FIG. 24B illustrating a state in which the outer shutter has moved toward the outer shutter open position from the state illustrated in FIG. 24A.

Referring to FIGS. 23B and 24A, when the outer shutter 61 is moved forward due to the opening force 69, the outer lock recess 67 becomes disengaged from the outer lock tab 34 as illustrated in FIG. 24A, and the outer shutter 61 becomes unlocked.

Referring to FIGS. 24A and 24B, in the state illustrated in FIG. 24A, the outer shutter 61 is allowed to move leftward, i.e., toward the outer shutter open position, and the outer shutter 61 is moved toward the outer shutter open position due to the leftward component of the opening force 69 as illustrated in FIG. 24B.

Description of Movement when Closing Inner Shutter

Referring to FIGS. 22A and 21C, when removing the toner cartridge TC from the printer body U1, the inner shutter 51 moves to the inner shutter closed position in which the inner shutter 51 closes the connection hole 33*a*. However, it may happen that the inner shutter 51 is not properly located at the inner shutter closed position due to a manufacturing error or an assembly error in components and the inner shutter 51 is not completely closed although the connection hole 33*a* is closed.

In particular, if the time at which the inner shutter lock 14 is separated from the inner shutter 51 is set to be the same as the time at which the inner shutter 51 reaches the inner shutter closed position, the time at which the inner shutter lock 14 is separated may be delayed from the time at which the inner shutter 51 reaches the inner shutter closed position due to a manufacturing error. In this case, when pulling out the toner cartridge TC, if the inner shutter 51 is to be further moved forward from the inner shutter closed position, lock is not released and the cartridge TC may not be allowed to be pulled out. Therefore, it is set that the inner shutter lock 14 is separated from the inner shutter 51 before the inner shutter 51 reaches the inner shutter closed position, and the toner cartridge TC moves forward before the inner shutter 51 has been completely closed.

Figure 25A:
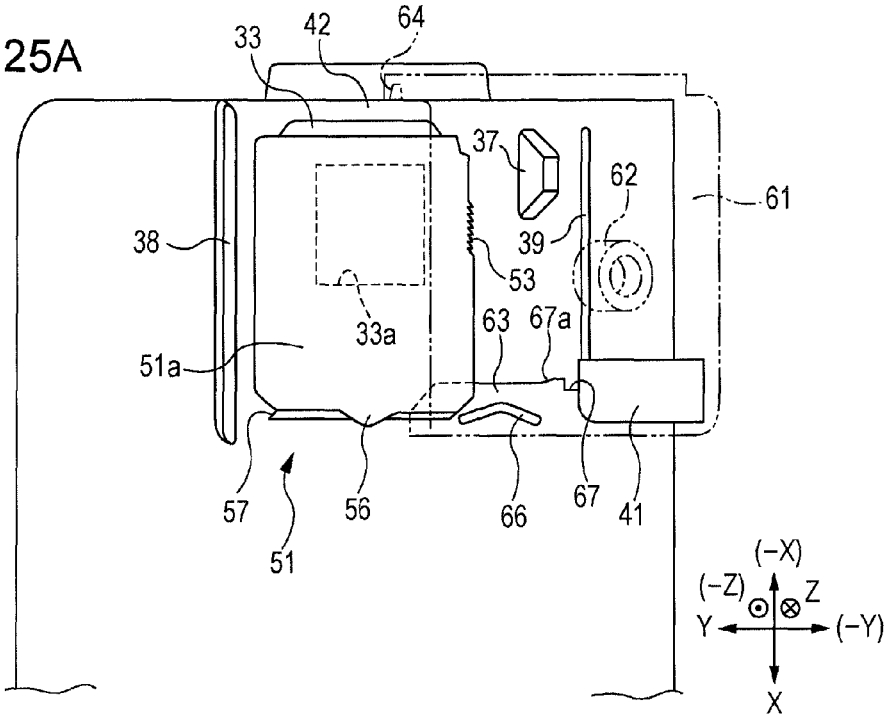
FIGS. 25A and 25B illustrate states in which the outer shutter according to the first exemplary embodiment moves to the outer shutter closed position, FIG. 25A illustrating a state in which the outer shutter is moving toward the outer shutter closed position, and FIG. 25B illustrating a state in which the outer shutter has moved further toward the outer shutter closed position from the state illustrated in FIG. 25A and the pushing projection has started to contact the pushed projection.
Figure 25B:
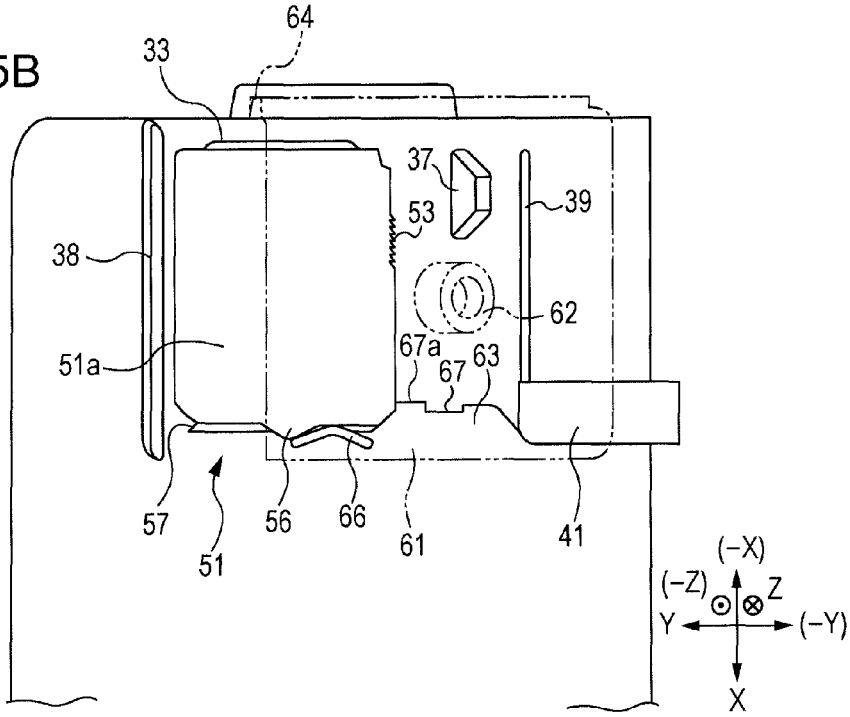

FIGS. 25A and 25B illustrate states in which the outer shutter according to the first exemplary embodiment moves to the outer shutter closed position, FIG. 25A illustrating a state in which the outer shutter is moving toward the outer shutter closed position, and FIG. 25B illustrating a state in which the outer shutter has moved further toward the outer shutter closed position from the state illustrated in FIG. 25A and the pushing projection has started to contact the pushed projection.

Referring to FIG. 25A, if the toner cartridge TC is pulled out when the inner shutter 51 is not completely closed, the outer opening/closing projection 62 of the outer shutter 61 contacts the spiral groove portion 3*b* and the outer shutter 61 starts to move toward the outer shutter closed position. Referring to FIG. 25B, as the outer shutter 61 moves toward the outer shutter closed position, the pushing projection 66 of the outer shutter 61 contacts the pushed projection 56 of the inner shutter 51. At this time, a distal end portion of the plate spring portion 68 of the outer shutter 61 starts contacting the spring contact projection 43, and the plate spring portion 68 starts to elastically deform.

Figure 26A:
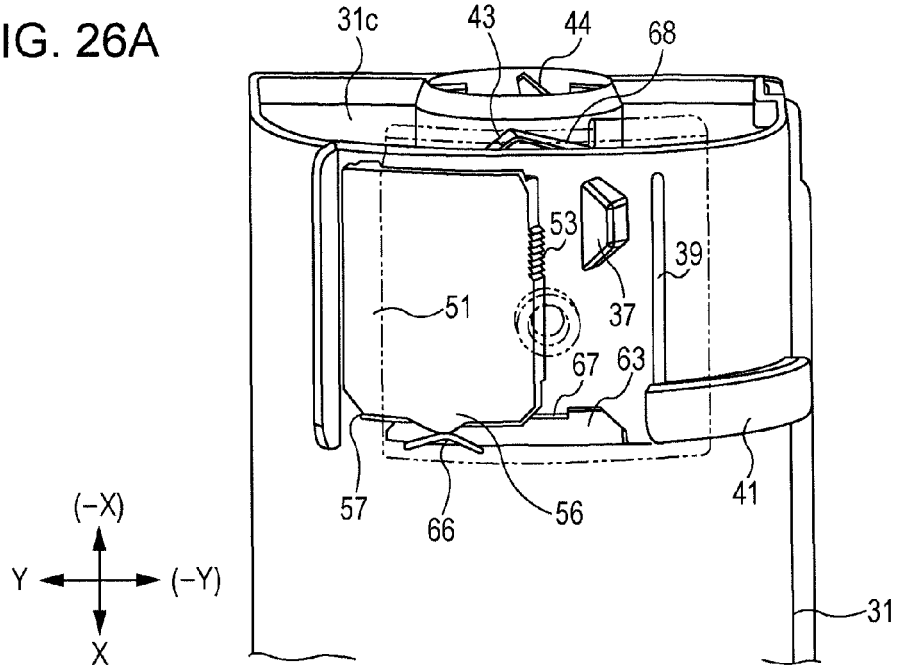
FIGS. 26A and 26B illustrate states continuing on from that of FIG. 25B, FIG. 26A illustrating a state in which the outer shutter has moved further toward the outer shutter closed position from the state illustrated in FIG. 25B and the pushing projection has pushed the pushed projection, and FIG. 26B illustrating a state in which the outer shutter has moved further toward the outer shutter closed position from the state illustrated in FIG. 26A and the pushing projection has passed the position of the pushed projection.
Figure 26B:
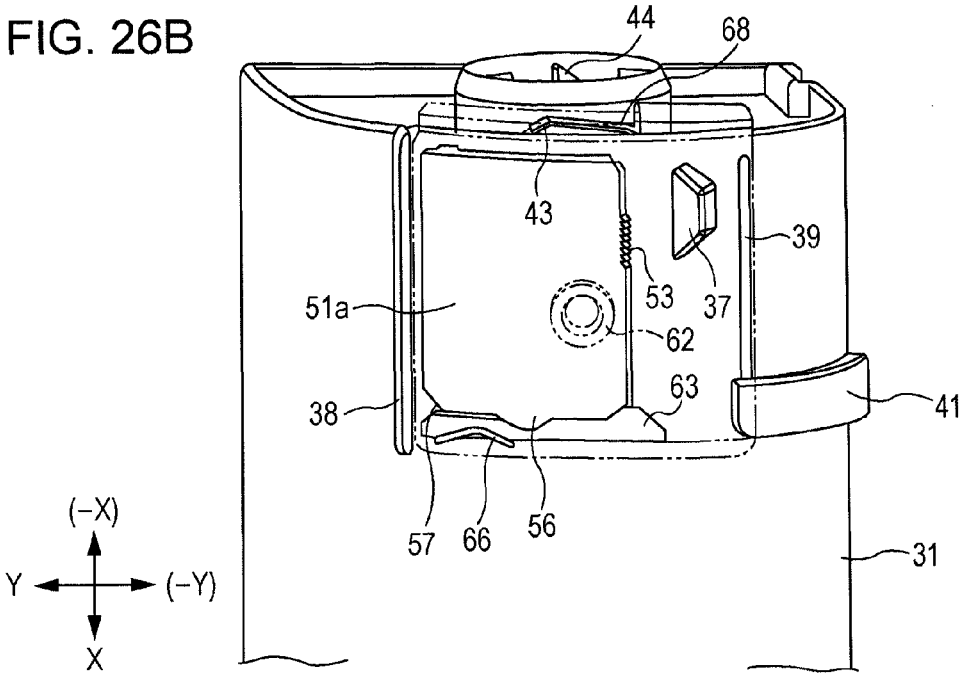

FIGS. 26A and 26B illustrate states continuing on from that of FIG. 25B, FIG. 26A illustrating a state in which the outer shutter has moved further toward the outer shutter closed position from the state illustrated in FIG. 25B and the pushing projection has pushed the pushed projection, and FIG. 26B illustrating a state in which the outer shutter has moved further toward the outer shutter closed position from the state illustrated in FIG. 26A and the pushing projection has passed the position of the pushed projection.

When the outer shutter 61 further moves toward the outer shutter closed position from the state illustrated in FIG. 25B, the front end of the pushed projection 56 contacts the back end of the pushing projection 66 as illustrated in FIG. 26A, so that the inner shutter 51 moves toward the inner shutter closed position. Therefore, as the outer shutter 61 rotates, the inner shutter 51 reaches the inner shutter closed position.

In particular, in the first exemplary embodiment, when the pushed projection 56 is in contact with the pushing projection 66, the plate spring portion 68 is in contact with the spring contact projection 43 and is elastically deformed, so that a force is applied to the inner shutter 51 in a direction such that the outer shutter 61 is moved backward, i.e., toward the inner shutter closed position. Thus, the inner shutter 51 is moved to the inner shutter closed position using the urging force of the plate spring portion 68, so that the inner shutter 51 is reliably moved to the inner shutter closed position as compared with the structure in which the urging force of the plate spring portion 68 is not applied to the inner shutter 51.

In the first exemplary embodiment, the pushed projection 56 is disposed in a middle part of the inner shutter 51 in the left-right direction. If the pushed projection 56 is disposed at an end part in the left-right direction, when the pushed projection 56 is pushed, the inner shutter 51 receives a force that rotates and inclines the inner shutter 51, so that a force that moves the inner shutter 51 to the inner shutter closed position is not efficiently transmitted to the inner shutter 51 and the inner shutter 51 may not reach the inner shutter closed position. In contrast, in the first exemplary embodiment, the pushed projection 56 is disposed in the middle part of the inner shutter 51 in the left-right direction, so that the force that moves the inner shutter 51 to the inner shutter closed position is efficiently transmitted to the inner shutter 51, whereby the inner shutter 51 is easily moved to the inner shutter closed position.

Figure 27:
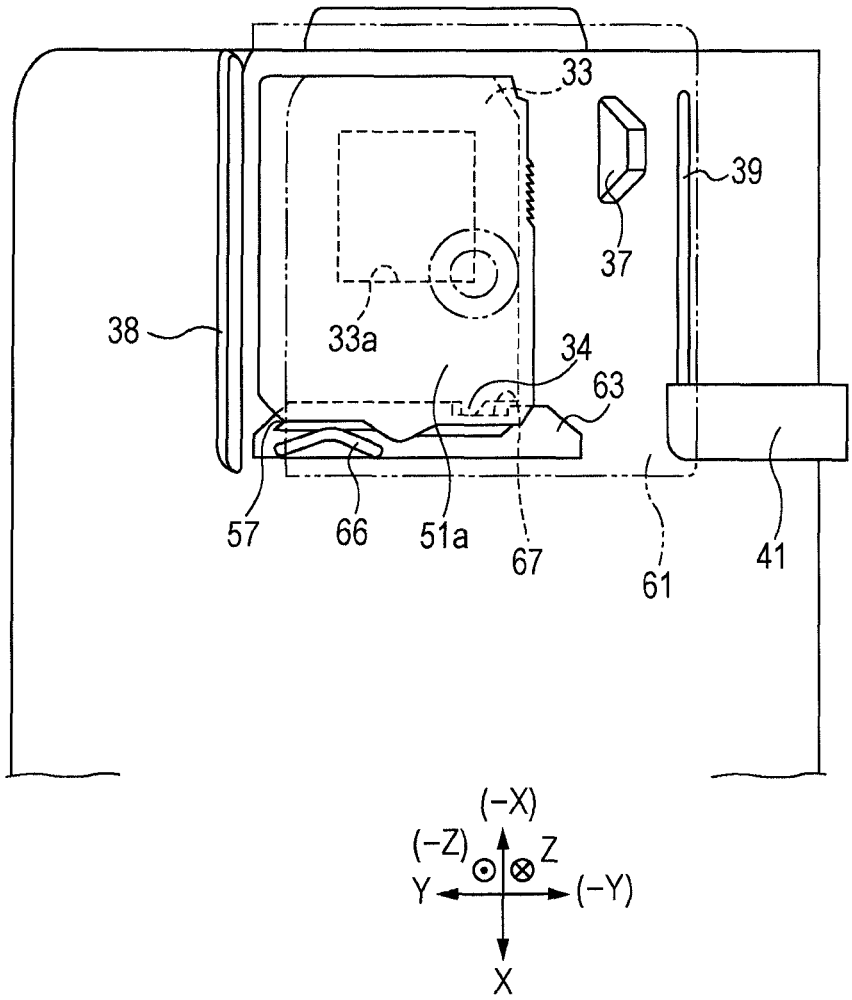
FIG. 27 illustrates a state, continuing from that of FIG. 26B, in which the outer shutter has moved to the outer shutter closed position from the state illustrated in FIG. 26B.

FIG. 27 illustrates the next state of FIG. 26 in which the outer shutter has moved to the outer shutter closed position from the state illustrated in FIG. 26B.

Referring to FIGS. 26A and 26B, when the outer shutter 61 moves from the state illustrated in FIG. 26A, the pushing projection 66 passes the position of the pushed projection 56, and the contact between the pushing projection 66 and the pushed projection 56 is released as illustrated in FIG. 26B. As illustrated in FIG. 27, the pushed projection 56 remains disengaged from the pushing projection 66 even if the outer shutter 61 is moved backward by the urging force of the plate spring portion 68, so that the outer shutter 61 is not prevented from being inclined as illustrated in FIG. 23.

The toner cartridge TC may be vibrated during transportation and handling and the inner shutter 51 may receive a force oriented toward the inner shutter open position. In such a case, in the first exemplary embodiment, the inner shutter 51 is prevented from being opened because the outer shutter 61 covers the inner shutter 51 and the outer lock tab 34 locks the outer shutter 61. In particular, when the inner shutter 51 starts moving toward the inner shutter open position, the pushed projection 56 immediately contacts the front side portion 61*b* of the outer shutter 61, so that movement of the inner shutter 51 is restrained before the connection hole 33*a* is opened inside the outer shutter 61.

Description of Movement of Outer Shutter

Figure 28A:
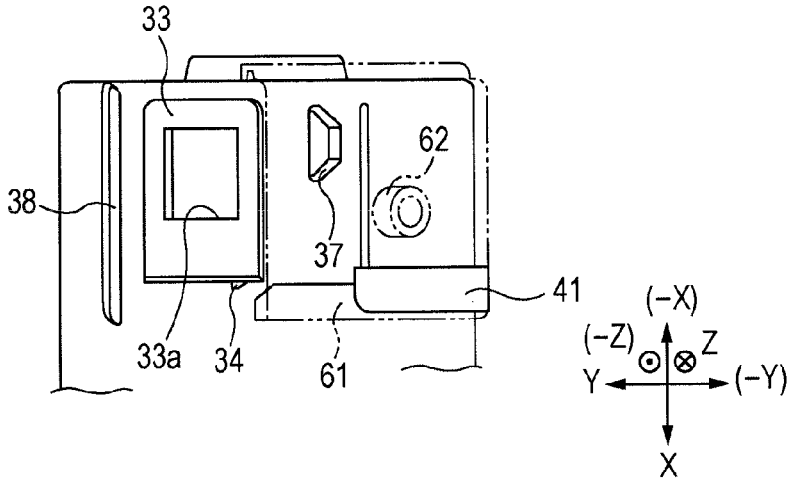
FIGS. 28A to 28C illustrate states in which the outer shutter according to the first exemplary embodiment moves to the outer shutter closed position, FIG. 28A illustrating a state in which the outer shutter is moving toward the outer shutter closed position, FIG. 28B illustrating a state in which the outer shutter has further moved toward the outer shutter closed position from the state illustrated in FIG. 28A and the front guide rail starts contacting the outer lock tab, and FIG. 28C illustrating a state in which the back end surface of the front guide rail is guided by the outer lock tab and the outer shutter is moving toward the outer shutter open position.
Figure 28B:
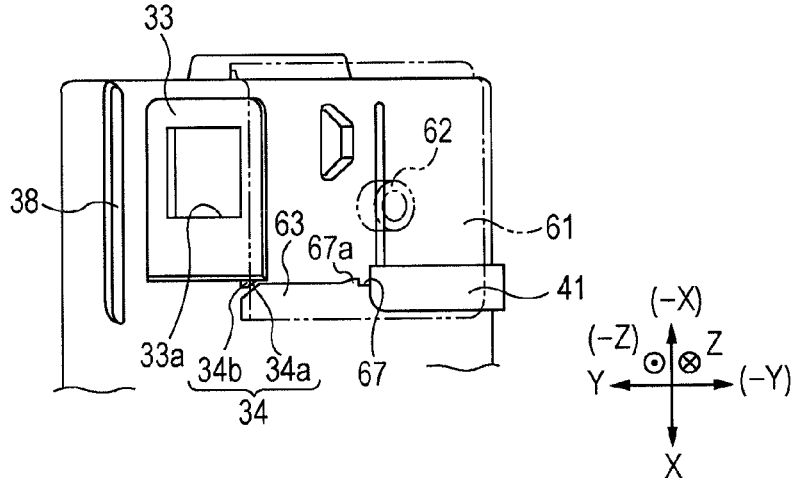
Figure 28C:
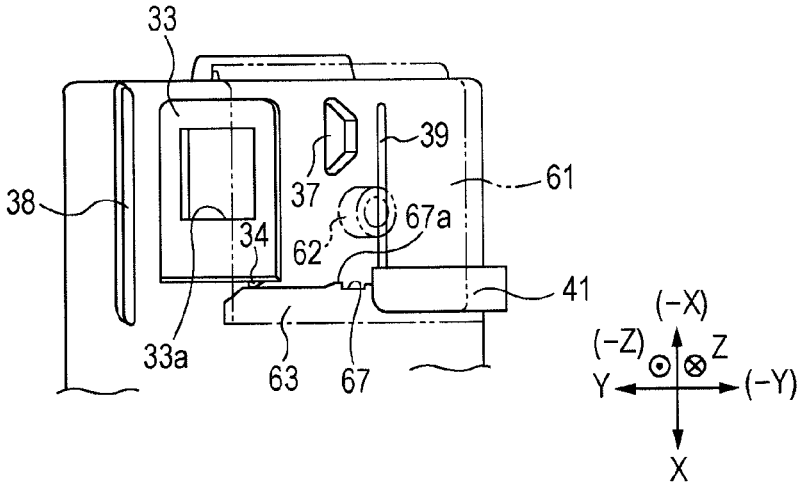

FIGS. 28A to 28C illustrate states in which the outer shutter according to the first exemplary embodiment moves to the outer shutter closed position, FIG. 28A illustrating a state in which the outer shutter is moving toward the outer shutter closed position, FIG. 28B illustrating a state in which the outer shutter has further moved toward the outer shutter closed position from the state illustrated in FIG. 28A and the front guide rail starts contacting the outer lock tab, and FIG. 28C illustrating a state in which the back end surface of the front guide rail is guided by the outer lock tab and the outer shutter is moving toward the outer shutter open position.

To facilitate understanding of the movement of the outer shutter 61, the inner shutter 51 is not illustrated in FIGS. 28A to 31B.

Referring to FIG. 28, when the outer shutter 61 according to the first exemplary embodiment moves toward the outer shutter closed position, the front guide rail 63 of the outer shutter 61 is guided by the outer shutter front guide 41 and the outer shutter extension guide 54 and moves rightward.

Referring to FIG. 28B, if the outer shutter 61 moves toward the outer shutter closed position while being displaced backward, the right end of the front guide rail 63 is guided by the outer lock guide surface 34*b* of the outer lock tab 34 and moved forward, that is, backlash is reduced. Therefore, when the outer shutter 61 further moves toward the outer shutter closed position from the state illustrated in FIG. 28B, the back end surface of the front guide rail 63 moves rightward while being guided by the outer lock tab 34 as illustrated in FIG. 28C.

Figure 29A:
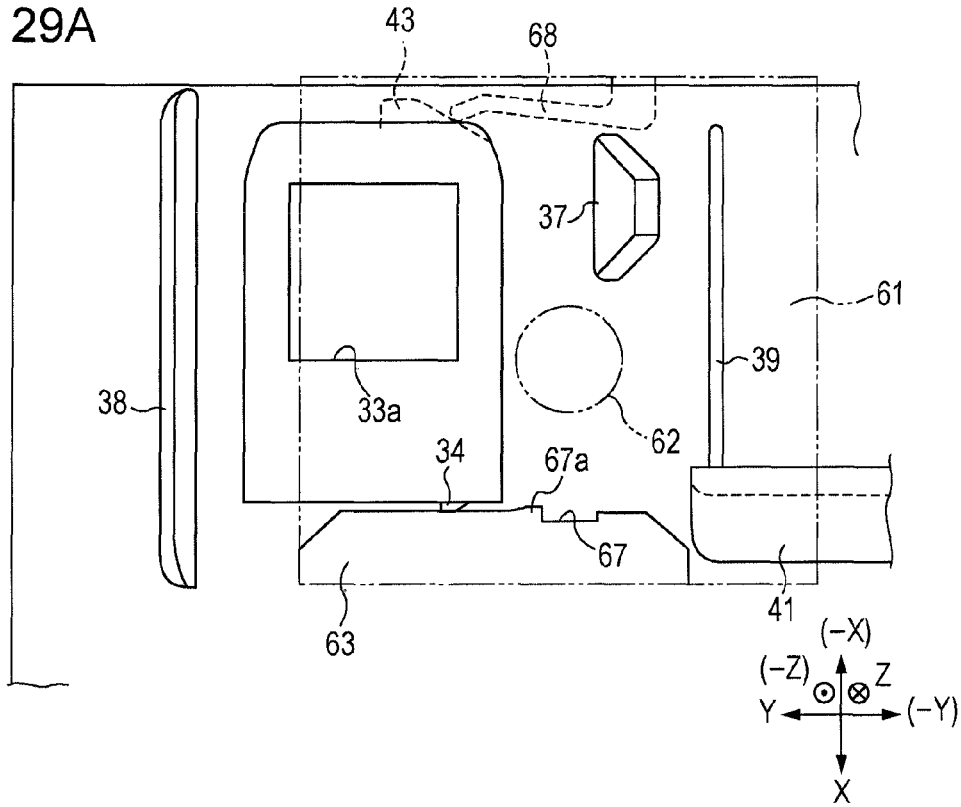
FIGS. 29A and 29B illustrate states continuing on from that of FIG. 28C, FIG. 29A illustrating a state in which the plate spring portion starts to contact the spring contact projection, and FIG. 29B illustrating a state in which the outer shutter has further moved toward the outer shutter closed position from the state illustrated in FIG. 29A and just before the outer lock recess engages with the outer lock tab.
Figure 29B:
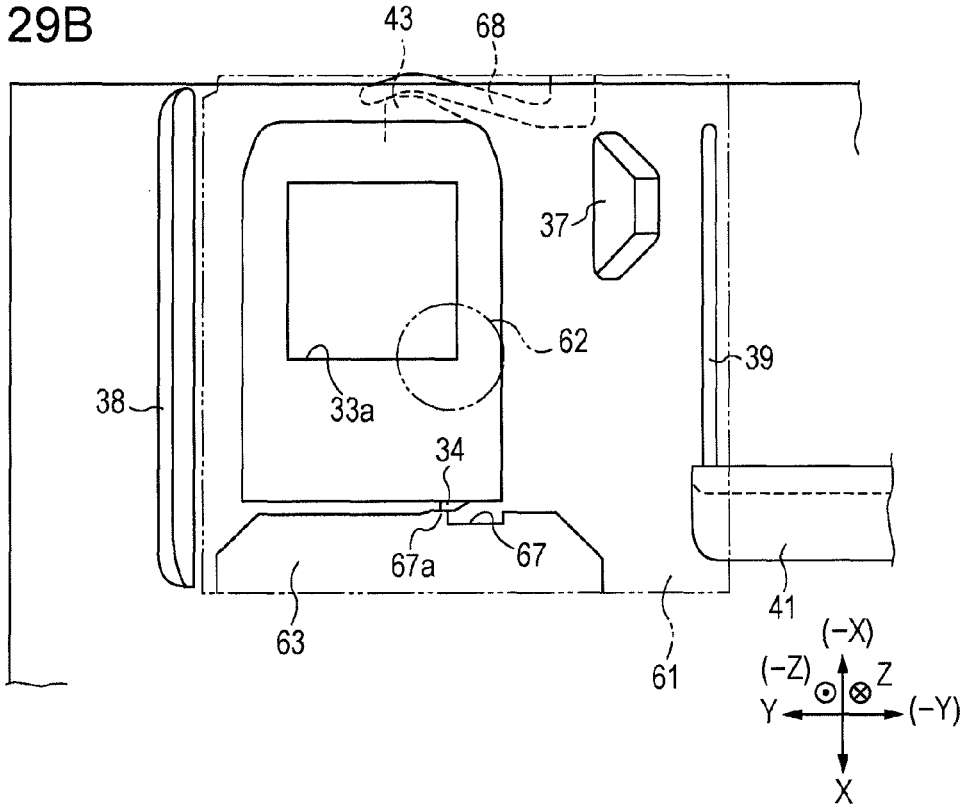

FIGS. 29A and 29B illustrate states continuing on from that of FIG. 28C, FIG. 29A illustrating a state in which the plate spring portion starts to contact the spring contact projection, and FIG. 29B illustrating a state in which the outer shutter has further moved toward the outer shutter closed position from the state illustrated in FIG. 29A and just before the outer lock recess engages with the outer lock tab.

When the outer shutter 61 moves toward the outer shutter closed position from the state illustrated FIG. 28C while being guided by the outer lock tab 34, the upstream contact portion 68*d* of the plate spring portion 68 starts contacting the spring contact projection 43 and the plate spring portion 68 starts to be bent as illustrated in FIG. 29A. That is, the plate spring portion 68 starts to be elastically deformed, so that an elastic force that urges the outer shutter 61 backward is started to be generated.

In FIGS. 29A and 29B, when the outer shutter 61 moves from the state illustrated in FIG. 29A toward the outer shutter closed position, the outer lock tab 34 contacts the overhanging portion 67*a* of the front guide rail 63 at a position before the outer lock recess 67 as illustrated in FIG. 29B. Thus, the outer shutter 61 moves so as to be shifted forward, the degree of bending of the plate spring portion 68 increases as the outer shutter 61 moves forward, and the generated elastic force increases.

Figure 30A:
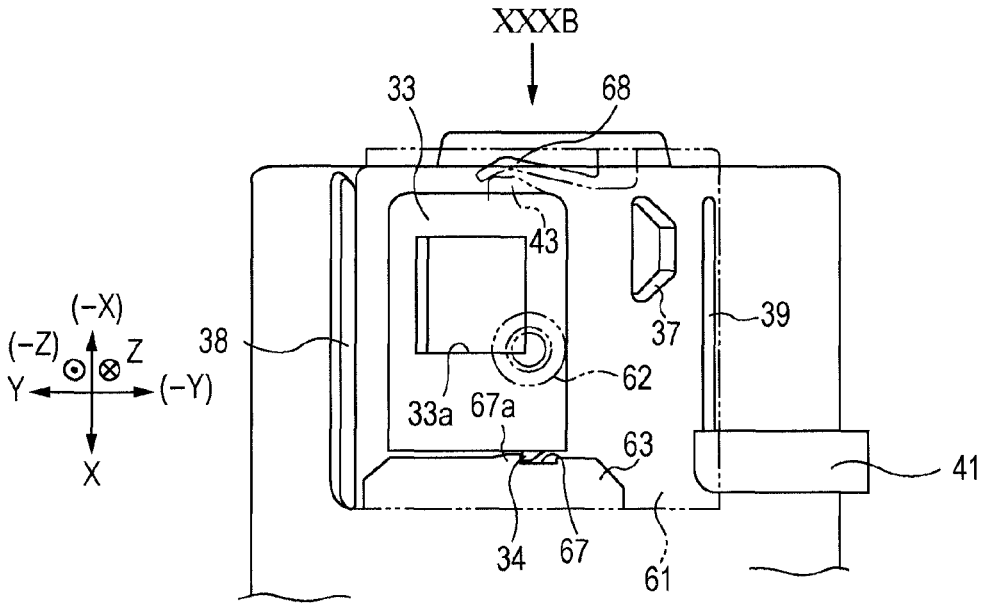
FIGS. 30A and 30B illustrate states continuing on from that FIG. 29B, FIG. 30A illustrating a state in which the outer shutter has further moved toward the outer shutter closed position from the state illustrated in FIG. 29B and the outer lock recess engages with the outer lock tab, and FIG. 30B illustrating a view of FIG. 30A seen in the direction of arrow XXXB.
Figure 30B:
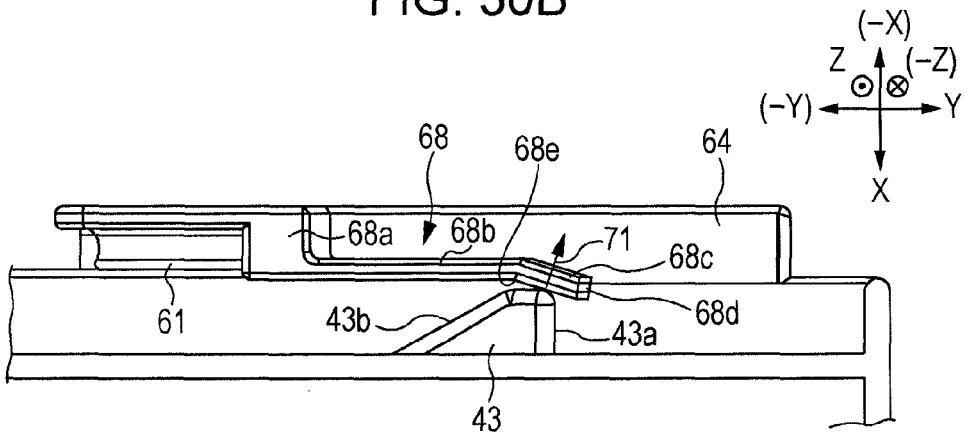

FIGS. 30A and 30B illustrate states continuing on from that FIG. 29B, FIG. 30A illustrating a state in which the outer shutter has further moved toward the outer shutter closed position from the state illustrated in FIG. 29B and the outer lock recess engages with the outer lock tab, and FIG. 30B illustrating a view of FIG. 30A seen in the direction of arrow XXXB.

When the outer shutter 61 further moves toward the outer shutter closed position from the state illustrated in FIG. 29B, the outer lock tab 34 engages with the outer lock recess 67 as illustrated in FIG. 30. At this time, the plate spring portion 68 is generating a large elastic force and urges the outer shutter 61 backward as illustrated in FIG. 29B. Therefore, for example, even if the toner cartridge TC is rapidly pulled out and the outer shutter 61 is rapidly moved toward the outer shutter closed position, the outer lock tab 34 is reliably engaged with the outer lock recess 67, thereby locking the outer shutter 61.

Figure 31A:
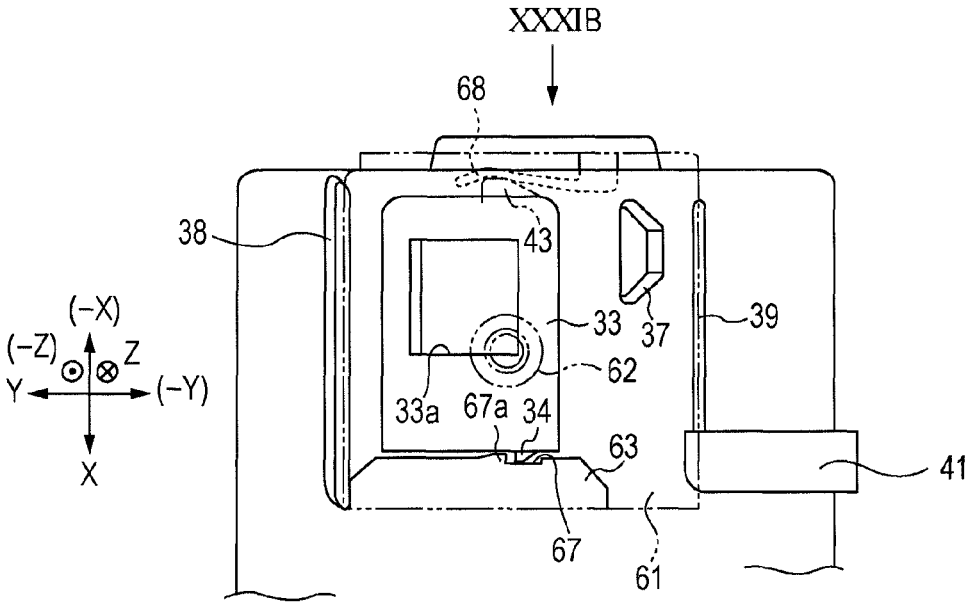
FIGS. 31A and 31B illustrate states continuing on from those of FIGS. 30A and 30B, FIG. 31A illustrating a state in which the outer shutter has reached the outer shutter closed position, and FIG. 31B illustrating a view of FIG. 31A seen in the direction of arrow XXXIB.
Figure 31B:
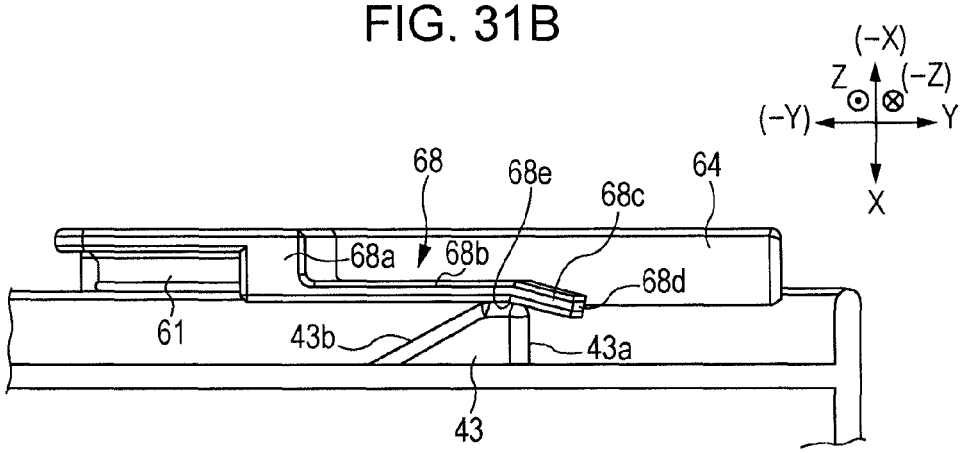

FIGS. 31A and 31B illustrate states continuing on from those of FIGS. 30A and 30B, FIG. 31A illustrating a state in which the outer shutter has reached the outer shutter closed position, and FIG. 31B illustrating a view of FIG. 31A seen in the direction of arrow XXXIB.

Referring to FIGS. 30A and 30B, at this time, the outer shutter 61 according to the first exemplary embodiment has not reached the outer shutter closed position, and there is a gap between the right end of the outer shutter 61 and the outer shutter right stopper 38. Regarding the plate spring portion 68 according to the first exemplary embodiment, the inclined portion 68*c* is in contact with the spring contact projection 43 and the closing contact portion 68*e* is not in contact with the spring contact projection 43 as illustrated in FIG. 30B. Therefore, in the state illustrated in FIG. 30B, a reactive force 71 that the inclined portion 68*c* receives from the spring contact projection 43 has a rightward component, whereby the outer shutter 61 receives a force oriented rightward, i.e., toward the outer shutter closed position.

Thus, the spring contact projection 43 is guided along the surface of the inclined portion 68*c*, and the outer shutter 61 moves from the state illustrated in FIG. 30A to the position illustrated in FIG. 31A, and the outer shutter 61 reaches the outer shutter closed position. In the state illustrated in FIGS. 31A and 31B, the outer lock tab 34 is in contact with the closing contact portion 68*e*. As compared with the case where the outer lock tab 34 is in contact with the inclined portion 68*c*, the degree of bending of the plate spring portion 68 is small and generated elastic force is small. If the outer lock tab 34 contacts a part of the plate spring body 68*b* between the close contact position 68*e* and the base end portion 68*a*, the degree of bending of the plate spring portion 68 is increased and a large elastic force is generated, so that the outer lock tab 34 is returned to the close contact position 68*e*, at which a smaller elastic force is generated. Thus, with the structure of the first exemplary embodiment, the outer shutter 61 is naturally held at the outer shutter closed position so that the outer lock tab 34 is in contact with the close contact position 68*e*, at which the elastic force generated by the plate spring portion 68 is the minimum.

Description of Function of Preventing Removal of Outer Shutter

The outer shutter 61 according to the first exemplary embodiment is attached to the cartridge body 31 by fitting the back guide rail 64 of the outer shutter 61 into the outer shutter back guide 42 from the state illustrated in FIG. 12. At this time, the inner shutter 51 has not been attached to the connection hole portion 33 as illustrated in FIG. 14C, so that the outer shutter 61 may be attached without causing interference between the front guide rail 63 and the inner shutter 51. Moreover, as illustrated in FIGS. 29A to 31B, when the inner shutter 51 is not present, the outer shutter 61 may be attached without causing interference between the front guide rail 63 and the outer shutter front guide 41.

FIG. 11 illustrates a state in which the outer shutter 61 has been moved to the outer shutter open position from this state.

In the state illustrated in FIG. 11, the back guide rail 64 of the outer shutter 61 is fitted into the outer shutter back guide 42 and the front guide rail 63 is fitted into the outer shutter front guide 41, so that the outer shutter 61 is prevented from being removed from the cartridge body 31.

When the outer shutter 61 is at the outer shutter open position, the inner shutter 51 may be attached to the connection hole portion 33 by attaching the inner shutter 51 from the front side of the cartridge body 31 and moving the inner shutter 51 from the inner shutter open position illustrated in FIG. 10 to the inner shutter closed position illustrated in FIG. 9.

When outer shutter 61 is moved to the outer shutter closed position from the state illustrated in FIG. 9 in which the inner shutter 51 has been attached to the cartridge body 31, the outer shutter 61 is closed as illustrated in FIG. 8. At this time, the front guide rail 63 of the outer shutter 61 is supported by the extension guide 54 of the inner shutter 51 as illustrated in FIG. 14A. Therefore, when the inner shutter 51 is attached, the outer shutter 61 contacts the extension guide 54 of the inner shutter 51 as illustrated in FIGS. 14A and 14C, and the outer shutter 61, which is at the outer shutter closed position, is prevented from being removed from the cartridge body 31. Thus, the inner shutter 51 according to the first exemplary embodiment guides the outer shutter 61 and prevents the outer shutter 61 from being removed. Accordingly, the inner shutter 51 performs the following three functions: opening/closing the connection hole 33*a*, guiding the outer shutter 61, and preventing removal of the outer shutter 61.

Description of Function of Preventing Misassembly of Inner Shutter

Figure 32A:
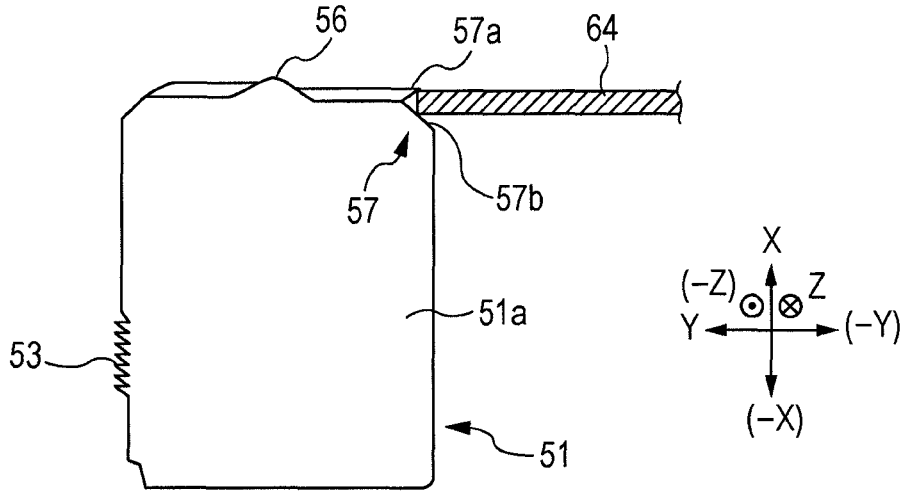
FIGS. 32A and 32B illustrate prevention of misassembly according to the first exemplary embodiment, FIG. 32A illustrating a state in which the inner shutter according to the first exemplary embodiment has been misassembled, and FIG. 32B illustrating a configuration in which a misassembly prevention member is provided.
Figure 32B:
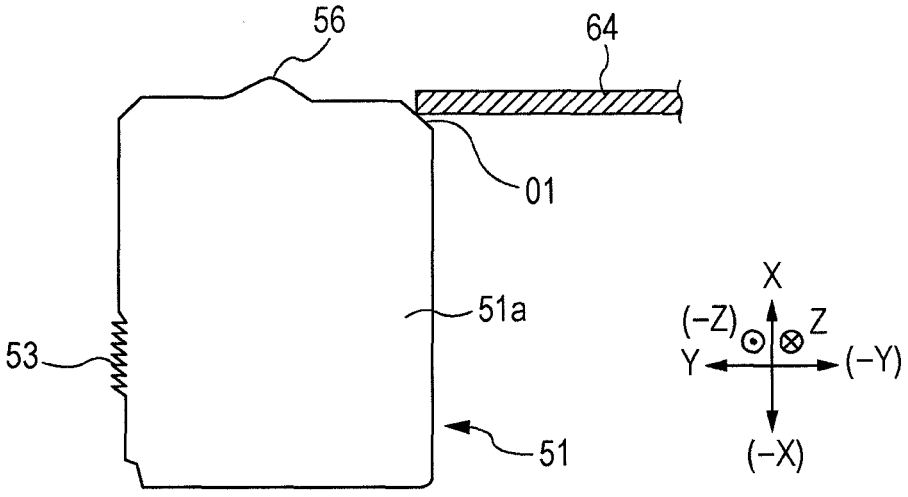

FIGS. 32A and 32B illustrate prevention of misassembly according to the first exemplary embodiment, FIG. 32A illustrating a state in which the inner shutter according to the first exemplary embodiment has been misassembled, and FIG. 32B illustrating a configuration in which a misassembly prevention member is not provided.

Referring to FIGS. 10 and 9, the inner shutter 51 according to the first exemplary embodiment is attached to the connection hole portion 33 from the front side. However, the inner shutter 51 might be mistakenly attached from the back side, i.e., might be misassembled. In such a case, the front end wall 51*b* of the inner shutter 51 contacts the back end of the connection hole portion 33 and stopped. In the first exemplary embodiment, in this state, the engagement recess 57 is disposed at a position at which the engagement recess 57 interferes with the back guide rail 64 of the outer shutter 61 and the back side portion 61*c*. Therefore, if the outer shutter 61 moves toward the outer shutter closed position when the inner shutter 51 has been misassembled as illustrated in FIG. 32A, the back guide rail 64 engages with the engagement recess 57, and the outer shutter 61 becomes unable to move toward the outer shutter closed position.

Referring to FIG. 32B, with the structure in which the engagement recess 57 is not provided, when the back guide rail 64 contacts the corner portion 01 of the inner shutter 51 and if the outer shutter 61 has backlash or the like, the back guide rail 64 may pass over the corner portion 01 and the outer shutter 61 may move toward the outer shutter closed position. That is, the outer shutter 61 may be closed in the state in which the inner shutter has been misassembled. To prevent this, the engagement recess 57 according to the first exemplary embodiment includes the front engaging portion 57*a* and the back engaging portion 57*b*. When the back guide rail 64 engages with the engagement recess 57, the back guide rail 64 is guided toward a middle part of the recess, so that the back guide rail 64 is not moved in a direction such that the back guide rail 64 becomes disengaged from the engagement recess 57. Therefore, the possibility that the outer shutter 61 is closed in the state in which the inner shutter 51 has been misassembled is reduced.

Second Exemplary Embodiment

Figure 33A:
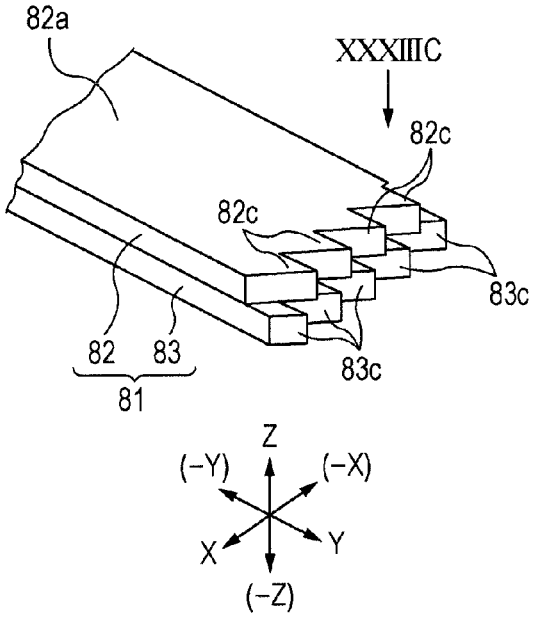
FIGS. 33A to 33C illustrate an inner shutter lock according to a second exemplary embodiment, FIG. 33A illustrating a perspective view, FIG. 33B illustrating a state in which a first engaging portion and a second engaging portion are separated from each other, and FIG. 33C illustrating a view of FIG. 33A seen in the direction of arrow XXXIIIC.
Figure 33B:
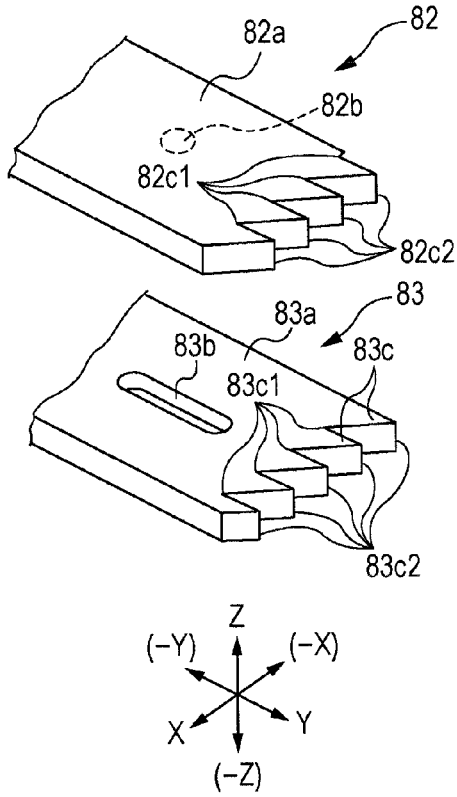
Figure 33C:
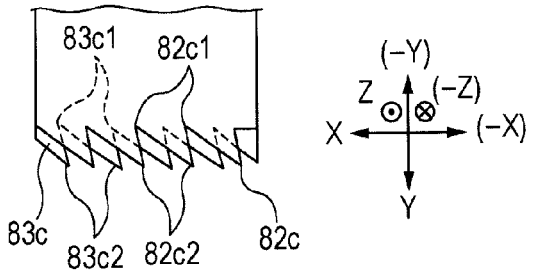

FIGS. 33A to 33C illustrate an inner shutter lock according to a second exemplary embodiment, FIG. 33A illustrating a perspective view, FIG. 33B illustrating a state in which a first engaging portion and a second engaging portion are separated from each other, and FIG. 33C illustrating a view of FIG. 33A seen in the direction of arrow XXXIIIC.

Figure 34A:
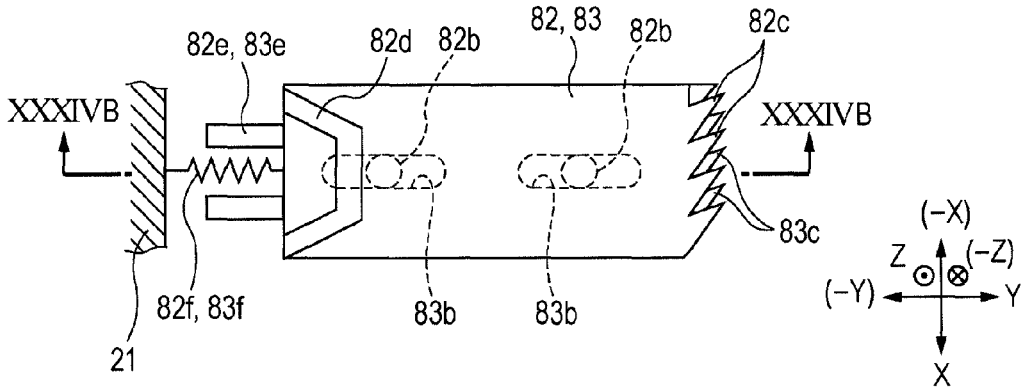
FIGS. 34A and 34B illustrate the inner shutter lock according to the second exemplary embodiment, FIG. 34A illustrating a plan view, and FIG. 34B illustrating a sectional view taken along line XXXIVB-XXXIVB of FIG. 34A.
Figure 34B:
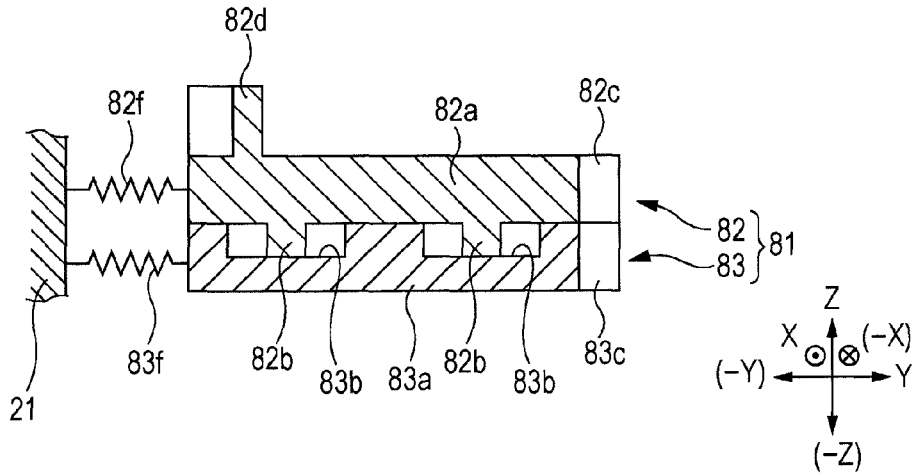

FIGS. 34A and 34B illustrate the inner shutter lock according to the second exemplary embodiment, FIG. 34A illustrating a plan view, and FIG. 34B illustrating a sectional view taken along line XXXIVB-XXXIVB of FIG. 34A.

In the following description of the second exemplary embodiment of the present invention, elements of the second exemplary embodiment corresponding to those of the first exemplary embodiment will be denoted by the same numerals and detailed description of such elements will be omitted.

The second exemplary embodiment differs from the first exemplary embodiment in the following respects, and has the same configuration as the first exemplary embodiment in other respects.

Referring to FIGS. 33A to 34B, an inner shutter lock 81 serving as an example of a movement restraining member of an opening/closing member according to the second exemplary embodiment includes an upper lock portion 82 serving as an example of a first engaging portion. The inner shutter lock 81 has a thickness in the up-down direction that is half the thickness of the inner shutter lock 14 according to the first exemplary embodiment. The upper lock portion 82 according to the second exemplary embodiment includes an upper lock slider 82*a* and a pair of left and right interlocking projections 82*b*. The thickness in up-down direction of the upper lock slider 82*a* is half the thickness of the lock slider 16 according to the first exemplary embodiment. The interlocking projections 82*b* serving as an example of a movement restraining interlocking portion each have a cylindrical shape, are disposed on the left and the right sides of the upper lock portion 82, and protrude from the lower surface of the upper lock slider 82*a*. The upper lock portion 82 according to the second exemplary embodiment includes a first upper lock body 82*c*, a slider projection 82*d*, an upper spring holding portion 82*e*, and an upper coil spring 82*f* supported by the spring support portion 21. These members are respectively the same as the lock body 17 of the inner shutter lock 14, the slider projection 18, the spring holding portion 19, the spring support portion 21, and the coil spring 22 according to the first exemplary embodiment, except that each of these members according to the second exemplary embodiment has a thickness that is half that of a corresponding member according to the first exemplary embodiment.

A lower lock portion 83 serving as an example of a second engaging portion and having the same thickness as the upper lock portion 82 is disposed below and adjacent to the upper lock portion 82. The lower lock portion 83 according to the second exemplary embodiment includes a lower lock slider 83*a* that is disposed so as to face the upper lock slider 82*a* of the upper lock portion 82. A pair of interlocking recesses 83*b* serving as an example of a movement restraining interlocked portion are formed in the lower lock slider 83*a*. The interlocking recesses 83*b* are disposed on the left and right sides of the lower lock slider 83*a* so as to correspond to the interlocking projections 82*b* and each have a slot-like shape extending in the left-right direction. The lower lock portion 83 includes a lower lock body 83*c*, a lower spring holding portion 83*e*, and a lower coil spring 83*f* supported by the spring support portion 21. These members are respectively the same as the upper lock body 82*c*, the upper spring holding portion 82*e*, and the upper coil spring 82*f*.

In the lower lock body 83*c* of the lower lock portion 83 according to the second exemplary embodiment, the recesses 83*c*1 and the protrusions 83*c*2 respectively have the same shape as those of the recesses 82*c*1 and the protrusions 82*c*2 of the upper lock body 82*c*, and are formed so as to be displaced from the recesses 82*c*1 and the protrusions 82*c*2 in the front-back direction. The upper lock portion 82 and the lower lock portion 83 constitute the inner shutter lock 81 according to the second exemplary embodiment.

Figure 35A:
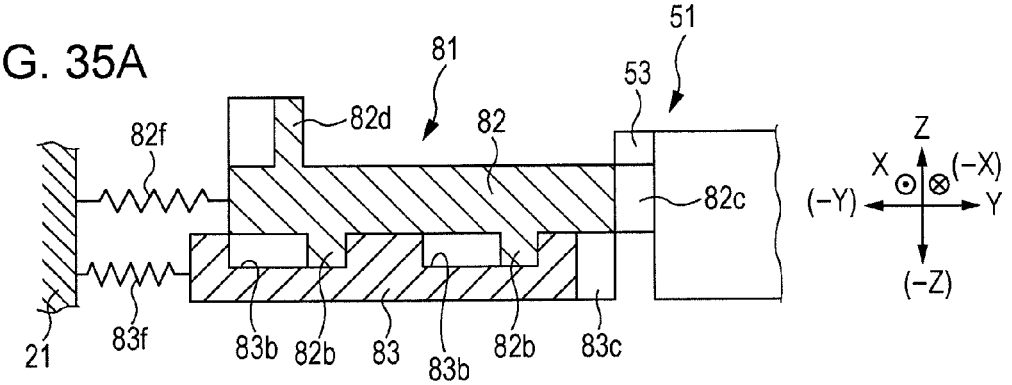
FIGS. 35A to 35D illustrate states of the inner shutter lock according to the second exemplary embodiment while the inner shutter lock is moving, FIG. 35A illustrating a state in which an upper lock portion engages with the locked portion of the inner shutter, FIG. 35B illustrating a state in which a lower lock portion is engaged with the locked portion of the inner shutter, FIG. 35C illustrating a state in which the inner shutter lock is moving toward the unlocked position, and FIG. 35D illustrating a state in which the inner shutter lock has moved to the unlocked position.
Figure 35B:
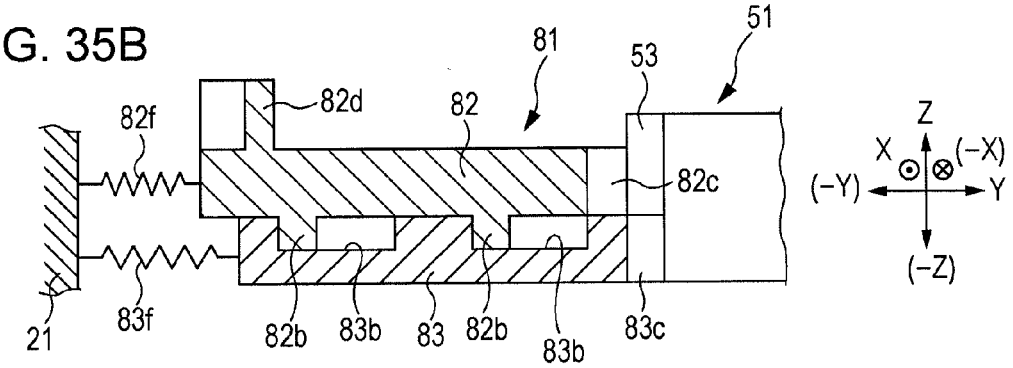
Figure 35C:
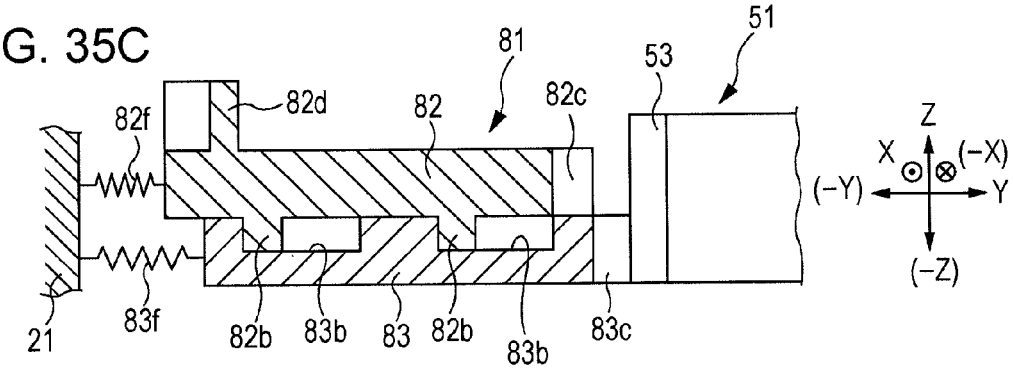
Figure 35D:
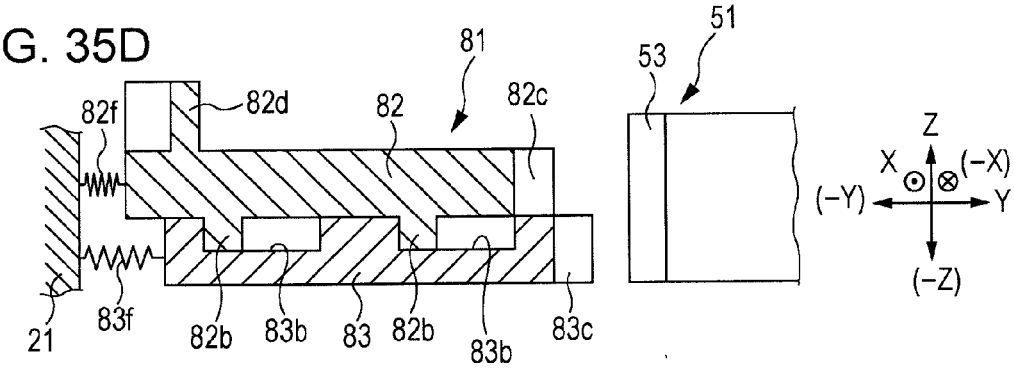

FIGS. 35A to 35D illustrate states of the inner shutter lock according to the second exemplary embodiment while the inner shutter lock is moving, FIG. 35A illustrating a state in which the upper lock portion engages with the locked portion of the inner shutter, FIG. 35B illustrating a state in which the lower lock portion is engaged with the locked portion of the inner shutter, FIG. 35C illustrating a state in which the inner shutter lock is moving toward the unlocked position, and FIG. 35D illustrating a state in which the inner shutter lock has moved to the unlocked position.

Referring to FIGS. 35A to 35D, in the inner shutter lock 81 according to the second exemplary embodiment, when the lock release projection 37 is not in contact with the slider projection 82*d*, the upper lock portion 82 and the lower lock portion 83 are movable in the left-right direction. Therefore, as illustrated in FIGS. 35A and 35B, in accordance with the position of the locked portion 53 of the inner shutter 51 in the front-back direction, one of the upper lock portion 82 and the lower lock portion 83 engages with the locked portion 53 and locks the inner shutter 51, and the other of the upper lock portion 82 and the lower lock portion 83 contacts the outer surface of the locked portion 53.

When the lock release projection 37 contacts the slider projection 82*d*, as the inner shutter lock 81 moves leftward, the interlocking projection 82*b* of the upper lock portion 82 contacts the left end surface of the interlocking recess 83*b* of the lower lock portion 83 as illustrated in FIGS. 35C and 35D, and moves the lower lock portion 83 leftward. That is, the upper lock portion 82 and the lower lock portion 83 move to the unlocked position while being interlocked. Therefore, whichever of the upper lock portion 82 and the lower lock portion 83 has been engaged with the locked portion 53, the lock is released.

Operation of Second Exemplary Embodiment

In the printer U having the structure according to the second exemplary embodiment, the pitches of the protrusions/depressions of upper lock portion 82 and the lower lock portion 83 of the inner shutter lock 81 are different from each other. Therefore, one of the upper and lower lock portions 82 and 83 may be engaged with the inner shutter locked portion 53 of the inner shutter 51 while the inner shutter 51 is in contact with the inner shutter stopper surface 6*b*, even if the inner shutter 51 has variations due to a manufacturing error or the like or the position of the inner shutter locked portion 53 may vary. Therefore, even if the inner shutter 51 has variations, the gap between the inner shutter 51 and the inner shutter stopper surface 6*b* is reduced.

Third Exemplary Embodiment

Figure 36A:
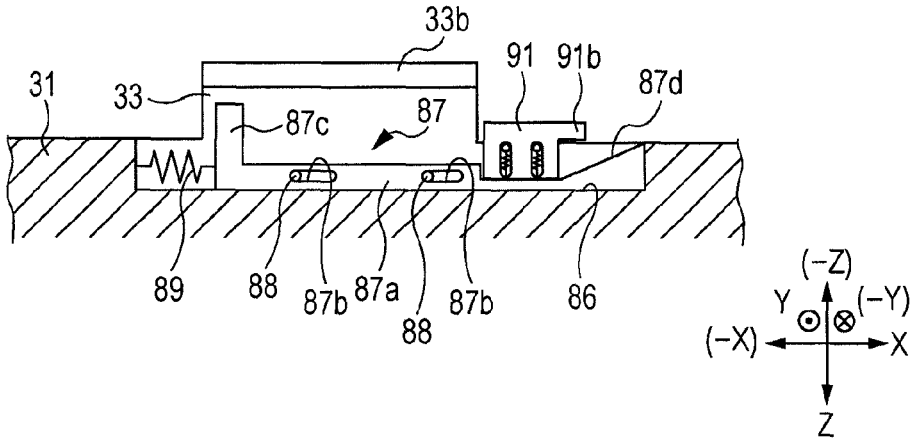
FIGS. 36A to 36C illustrate a removal restraining portion according to a third exemplary embodiment, FIG. 36A illustrating a state in which the inner shutter is not attached.
Figure 36B:
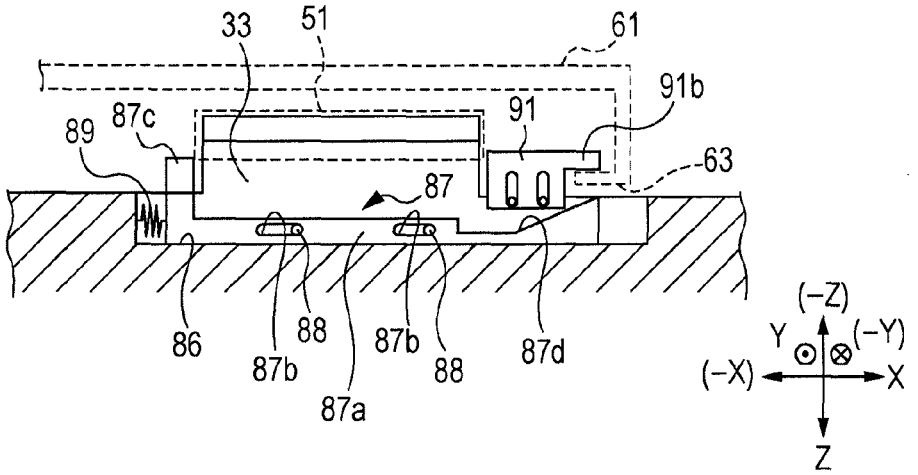
Figure 36C:
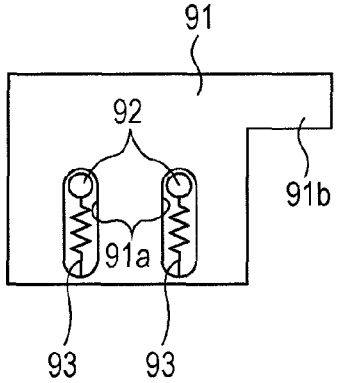

FIGS. 36A to 36C illustrate a removal restraining portion according to a third exemplary embodiment, FIG. 36A illustrating a state in which the inner shutter is not attached, FIG. 36B illustrates a state in which the inner shutter is attached, and FIG. 36C illustrating an enlarged view of the removal restraining member of FIG. 36A.

In the following description of the third exemplary embodiment of the present invention, elements of the third exemplary embodiment corresponding to those of the first exemplary embodiment will be denoted by the same numerals and detailed description of such elements will be omitted.

The third exemplary embodiment differs from the first exemplary embodiment in the following respects, and has the same configuration as the first exemplary embodiment in other respects.

Referring to FIGS. 36A to 36C, in the third exemplary embodiment, a groove portion 86 serving as an example of a containing portion of a removal restraining portion is formed in a side portion of the cartridge body 31 in the left-right direction so as to extend in the front-back direction.

An interlocking arm 87 serving as an example of an interlocking member of a removal restraining portion is supported in the groove portion 86 so as to be movable in the front-back direction. The interlocking arm 87 includes an arm body 87*a* serving as an example of an interlocking member body and extending in the left-right direction. A pair of front and back guide slots 87*b* serving as an example of a guided portion are formed in the arm body 87*a* so as to extend in the left-right direction. Lateral guide pins 88 serving as an example of a guide member supported by the groove portion 88 extend through the guide slots 87*b*. Thus, the interlocking arm 87 according to the third exemplary embodiment is supported so as to be movable in the front-back direction.

An inner shutter contact portion 87*c* serving as an example of a contact portion is formed at the back end arm body 87*a* so as to extend upward. A cam surface 87*d* serving as an example of a lifting portion is formed at the front end of the arm body 87*a* so as to be inclined in the front downward direction.

A coil spring 89 serving as an example of an urging member for urging the interlocking arm 87 forward is supported between the back end of the arm body 87*a* and the back end surface of the groove portion 86.

A removal restraining member 91 is disposed on the upper front surface of the arm body 87*a*. A pair of front and back vertical guide slots 91*a* serving as an example of a guided portion are formed in the removal restraining member 91 according to the third exemplary embodiment so as to extend in the up-down direction. Vertical guide pins 92 serving as an example of a guide member extend through the vertical guide slots 91*a*. Referring to FIG. 36C, coil springs 93 serving as an example of an urging member are disposed between the vertical guide pins 92 and inner surfaces of the vertical guide slots 91*a*, and the coil springs 93 urge the removal restraining member 91 upward.

Therefore, the removal restraining member 91 is supported by the vertical guide pins 92 and the vertical guide slots 91*a* so as to be movable in the up-down direction. Normally, the removal restraining member 91 is urged upward by an elastic force of the coil spring 93. A removal restraining rib 91*b* serving as an example of a removal restraining portion is formed at the lower end of the removal restraining member 91 so as to extend forward and so as to correspond to the front guide rail 63 of the outer shutter 61.

Operation of Third Embodiment

In the printer U having the above-described structure according to the third exemplary embodiment, before the inner shutter 51 is attached, the interlocking arm 87 has been moved forward by the elastic force of the coil spring 89 and the removal restraining member 91 is at an unrestrained position, which in the groove portion 86, as illustrated in FIG. 36A. Therefore, in this state, the outer shutter 61 may be attached or removed at the outer shutter closed position before the inner shutter 51 is attached.

When the inner shutter 51 is attached, the inner shutter contact portion 87*c* contacts the inner shutter 51 and is pushed back as illustrated in FIG. 36B. Therefore, the coil springs 89 and 93 are elastically deformed, the interlocking arm 87 is moved backward, and the removal restraining member 91 is pushed by the cam surface 87*d* to a removal restraining position at which the removal restraining member 91 protrudes downward. Therefore, when the inner shutter 51 is attached in the state in which the outer shutter 61 is at the outer shutter open position, the removal restraining member 91 protrudes downward, and when the outer shutter 61 moves to the outer shutter closed position, the outer shutter 61 becomes engaged with the front guide rail 63. Therefore, removal of the outer shutter 61 in the downward direction is restrained.

Modifications

The present invention is not limited to the exemplary embodiments described above, and may be modified in various ways within the spirit and scope of the present invention described in claims. Modifications (H01) to (H018) of the exemplary embodiments of the present invention will be described below.

(H01) In the above-described exemplary embodiments, the printer U is used as an example of an image forming apparatus. However, the image forming apparatus is not limited thereto, and may be a copier, a facsimile machine, or a multifunctional device. The image forming apparatus is not limited to an apparatus for forming a monochrome image and may be an apparatus for forming a multicolor image.

(H02) In the above-described exemplary embodiments, the toner cartridge TC for containing a developer to be supplied to the developing device G is used as an example of a developer container. However, the developer container is not limited thereto, and may be, for example, a waste toner box for containing the developer that has been recovered from the photoreceptor cleaner CLp or the belt cleaner CLb, or a removable developing device G that contains the developer.

(H03) In the above-described exemplary embodiments, the shapes of the toner cartridge TC and the cartridge holder KH may be appropriately changed.

(H04) In the above-described exemplary embodiments, the shape of the opening/closing groove 3 may be appropriately changed. For example, the front groove portion 3*a* may be omitted, and the spiral groove portion 3*b* may extend from the front end, and the angle and the like of the spiral groove portion 3*b* may be appropriately changed. The protuberance 3*h* may be omitted.

(H05) In the above-described exemplary embodiments, the structures and the positions of the CRUM reader 4 and the CRUM 46 may be appropriately changed. A method for sending and receiving information between the CRUM reader 4 and the CRUM 46 for is not limited to a wired (contact-type) method, and may be a wireless method.

(H06) In the above-described exemplary embodiments, the guide rib 8*a*, the backlash reducing wall 9, the inclined surface 11, and the lock side wall 12 may be omitted. The angle of the inclined surface 11 may correspond to that of the spiral groove portion 3*b*. The angle may be larger than or smaller than that of the spiral groove portion 3*b*, or may be so large as to allow the inclined surface 11 to extend in a horizontal direction. The overlapping region 11*a* may be omitted. A shutter may be disposed in the supply port 6*a*.

(H07) In the above-described exemplary embodiments, the shapes of the slider projection 18 and the lock release projection 37 are not limited to those described in the exemplary embodiment and may be appropriately changed. For example, the middle guide surface 18*b* and the middle guided surface 37*b* may be omitted.

(H08) In the above-described exemplary embodiments, the rib 39 may be omitted.

(H09) In the above-described exemplary embodiments, the outer shutter front guide 41 and the outer shutter back guide 42 and the outer guide rail 63+64 are not limited to those described in the exemplary embodiments, and the positions, the sizes, and the lengths and the like of these members may be appropriately changed.

(H010) In the above-described exemplary embodiments, the extension guide 54 for guiding the outer shutter 61 may be provided to the inner shutter 51. However, the extension guide 54 may be omitted or may be provided to the cartridge body 31.

(H011) In the above-described exemplary embodiments, the mechanism for locking the outer shutter 61 is not limited to the combination of the outer lock tab 34 and the outer lock recess 67 described in the exemplary embodiment, and the position and the structure of such a mechanism may be appropriately changed. For example, the relationship between the tab and the recess may be opposite to that of the exemplary embodiments, or the tab and the recess may be disposed not on the front side but on the back side of the outer shutter 61. The overhanging portion 67*a* may be provided, or may be omitted. The mechanism for locking the outer shutter 61 and the mechanism for restraining movement of the inner shutter 51 may be provided, or may be omitted.

(H012) In the above-described exemplary embodiments, the engagement recess 57 is used as a misassembly prevention member. However, the shape, the position, the size, and the like of the engagement recess 57 are not limited thereto, and may be appropriately changed. The misassembly prevention member may be provided, or may be omitted.

(H013) In the above-described exemplary embodiments, the shape, the size, the position, and the like of the outer opening/closing projection 62 may be appropriately changed. For example, if the spiral groove portion 3*b* is wide enough to guide the entirety of the outer shutter 61, the outer opening/closing projection 62 may be omitted.

(H014) In the above-described exemplary embodiments, the structures of the inner shutter lock 14 and the locked portion 53 of the inner shutter 51 are not limited to those described in the exemplary embodiments, and may be appropriately changed. For example, the recesses may have shapes that allow the recesses to pass over the protrusions when installation is performed as described in the exemplary embodiments and allow the recesses to engage with the protrusions when removal is performed. Alternatively, the recesses may have shapes that allow the recesses to pass over the protrusions during installation and removal. The recesses and protrusions may be formed at a regular pitch so as to have a saw-tooth shape. Alternatively, for example, one of the inner shutter lock and the locked portion may be saw-tooth shaped and the other may have only one protrusion, or one of the inner shutter lock and the locked portion may have protrusions and the other may have recesses. The structure of the inner shutter lock 14 is not limited to the structure that allows contact from a side thereof, and may have an appropriate structure.

(H015) In the above-described exemplary embodiments, the extension guide 54 of the inner shutter 51 may also function as the removal restraining portion of the outer shutter 61. However, this is not limited thereto, and the removal restraining member may be disposed at a position different from that of the extension guide 54 of the inner shutter 51. Alternatively, for example, a removal restraining member that has a snap-fitting structure and that is capable of being fitted into the front guide rail 63 of the outer shutter 61 may be provided to the cartridge body 31. A removal restraining portion may be provided to the outer shutter 61, or may be omitted.

(H016) In the above-described exemplary embodiments, the shapes of the plate spring portion 68 and the spring contact projection 43 are not limited to those described in the exemplary embodiments, and the positions and the shapes thereof may be appropriately changed. For example, the inclined portion 68*c* may be formed in the plate spring portion 68, or may be omitted. Alternatively, the plate spring portion may be provided to the cartridge body 31, and the spring contact projection may be provided to the outer shutter 61. The plate spring portion 68 and the spring contact projection 43 may be provided, or may be omitted.

(H017) In the above-described exemplary embodiments, the inner shutter 51 is pushed by using the pushed projection 56 and the pushing projection 66. The position, the shape, the size, and the like of the pushed projection 56 and the pushing projection 66 may be appropriately changed. For example, the pushed projection 56 may be disposed at an end in the left-right direction or on the lower surface of the inner shutter 51, and the shape of the pushed projection 56 may have a shape other than triangular, such as trapezoidal. The pushed projection 56 and the pushing projection 66 may push the inner shutter, or may be omitted.

(H018) In the above-described exemplary embodiments, the outer shutter 61 may be inclined while being opened to reduce an increase in the operation force. However, the structure of the outer shutter 61 is not limited thereto, and the outer shutter 61 may move forward to release the lock, and then may move leftward. That is, backlash or play between the outer guide rail 63+64 and each of the guides 41, 42, and 54 may be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container comprising:

a containing portion that is capable of containing a developer therein, the containing portion having an opening through which the developer passes;

a first opening/closing member that is supported by the containing portion so as to be movable between a first open position at which the opening is open and a first closed position at which the first opening/closing member closes the opening; and a second opening/closing member that is supported by the containing portion so as to be movable between a second closed position at which the second opening/closing member doubly closes the opening by covering an outside of the first opening/closing member and a second open position at which the first opening/closing member is exposed to the outside, wherein the second opening/closing member rotates by an operation of inserting the developer container in an image forming apparatus without performing an operation of rotating the container portion, wherein the first opening/closing member is supported so as to be movable in an installation direction, which is a direction in which the developer container is removably installed into the image forming apparatus, wherein the second opening/closing member is supported so as to be movable in a circumferential direction centered around the installation direction, and wherein the second opening/closing member includes an opening/closing contact portion that contacts an opening/closing contacted portion provided to the image forming apparatus, the opening/closing contacted portion extending in a spiral shape with respect to the installation direction, moves the second opening/closing member from the second closed position to the second open position as the developer container moves in the installation direction, and moves the second opening/closing member from the second open position to the second closed position as the developer container moves in a removal direction, which is a direction in which the developer container is removed from the image forming apparatus.

2. The developer container according to claim 1, wherein the opening/closing contact portion is guided by a protrusion that is disposed at a connection portion through which a passage and the opening/closing contacted portion are connected to each other, the passage extending in the removal direction from a downstream end of the opening/closing contacted portion in the removal direction and allowing the opening/closing contact portion to pass therethrough, the protrusion protruding on a side in which the spiral shape of the opening/closing contacted portion extends with respect to a direction in which the passage extends.

3. The developer container according to claim 2, wherein the containing portion includes a containing portion guide portion that supports the second opening/closing member and guides the movement of the second opening/closing member, and wherein the first opening/closing member includes a second opening/closing member guide portion that is capable of guiding the movement of the second opening/closing member when the first opening/closing member is at the first closed position.

4. The developer container according to claim 3, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

5. The developer container according to claim 2, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

6. The developer container according to claim 1, wherein the containing portion includes a containing portion guide portion that supports the second opening/closing member and guides the movement of the second opening/closing member, and wherein the first opening/closing member includes a second opening/closing member guide portion that is capable of guiding the movement of the second opening/closing member when the first opening/closing member is at the first closed position.

7. The developer container according to claim 6, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

8. The developer container according to claim 1, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

9. The developer container according to claim 1, further comprising:

an opening restraining portion that restrains movement of the second opening/closing member toward the second open position when the second opening/closing member is at the second closed position by contacting the second opening/closing member.

10. The developer container according to claim 1, wherein the second opening/closing member rotates about a linear axis by performing the operation of inserting the developer container along the linear axis into the image forming apparatus.

11. The developer container according to claim 1, wherein the containing portion includes a first curved surface in which the opening is formed, wherein the second opening/closing member includes a second curved surface that covers the opening, wherein the second curved surface rotates along the first curved surface by the operation of inserting the developer container in the image forming apparatus without performing the operation of rotating the containing portion.

12. A developer container comprising:

a containing portion that is capable of containing a developer therein, the containing portion having an opening through which the developer passes;

a first opening/closing member that is supported by the containing portion so as to be movable between a first open position at which the opening is open and a first closed position at which the first opening/closing member closes the opening; and a second opening/closing member that is supported by the containing portion so as to be movable between a second closed position at which the second opening/closing member doubly closes the opening by covering an outside of the first opening/closing member and a second open position at which the first opening/closing member is exposed to the outside, wherein the second opening/closing member rotates by an operation of inserting the developer container in an image forming apparatus without performing an operation of rotating the container portion, wherein the containing portion includes a containing portion guide portion that supports the second opening/closing member and guides the movement of the second opening/closing member, and wherein the first opening/closing member includes a second opening/closing member guide portion that is capable of guiding the movement of the second opening/closing member when the first opening/closing member is at the first closed position.

13. The developer container according to claim 12, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

14. A developer container comprising:

a containing portion that is capable of containing a developer therein, the containing portion having an opening through which the developer passes;

a first opening/closing member that is supported by the containing portion so as to be movable between a first open position at which the opening is open and a first closed position at which the first opening/closing member closes the opening; and a second opening/closing member that is supported by the containing portion so as to be movable between a second closed position at which the second opening/closing member doubly closes the opening by covering an outside of the first opening/closing member and a second open position at which the first opening/closing member is exposed to the outside, wherein the second opening/closing member rotates by an operation of inserting the developer container in an image forming apparatus without performing an operation of rotating the container portion, wherein the first opening/closing member includes a pushed portion, and wherein the second opening/closing member includes a pushing portion that pushes, when the second opening/closing member moves toward the second closed position, the first opening/closing member in a direction in which the first opening/closing member is moved toward the first closed position by contacting the pushed portion of the first opening/closing member in accordance with the movement of the second opening/closing member.

* * * * *